US005453568A

United States Patent [19]

Tajima et al.

[11] Patent Number: 5,453,568

[45] Date of Patent: Sep. 26, 1995

[54] AUTOMATIC PLAYING APPARATUS WHICH DISPLAYS IMAGES IN ASSOCIATION WITH CONTENTS OF A MUSICAL PIECE

[75] Inventors: Yoichiro Tajima, Kunitachi; Mayumi Ohya, Hamamatsu, both of Japan

[73] Assignee: Casio Computer Co., Ltd., Tokyo, Japan

[21] Appl. No.: 945,481

[22] Filed: Sep. 15, 1992

[30] Foreign Application Priority Data

| | | | |
|---|---|---|---|
| Sep. 17, 1991 | [JP] | Japan | 3-265211 |
| Oct. 11, 1991 | [JP] | Japan | 3-292368 |
| Dec. 25, 1991 | [JP] | Japan | 3-357548 |
| Dec. 26, 1991 | [JP] | Japan | 3-357865 |
| Dec. 27, 1991 | [JP] | Japan | 3-360750 |

[51] Int. Cl.[6] ..... G10H 7/00; A63H 5/00; G04B 13/00

[52] U.S. Cl. ..... 84/609; 84/626; 84/611

[58] Field of Search ..... 84/609, 626, 634, 84/611

[56] References Cited

U.S. PATENT DOCUMENTS

| | | | |
|---|---|---|---|
| 4,506,587 | 3/1985 | Tanaka . | |
| 4,993,306 | 2/1991 | Ueta et al. | 84/601 |
| 5,005,459 | 4/1991 | Adachi et al. | 84/453 |
| 5,048,390 | 9/1991 | Adachi et al. | 84/464 R |
| 5,225,618 | 7/1993 | Wadhams | 84/645 X |
| 5,241,125 | 8/1993 | Miyamoto | 84/609 |
| 5,247,126 | 9/1993 | Okamura et al. | 84/609 |
| 5,250,747 | 10/1993 | Tsumura | 84/645 |
| 5,262,583 | 11/1993 | Shimada | 84/609 |
| 5,262,584 | 11/1993 | Shimada | 84/609 |
| 5,270,477 | 12/1993 | Kawashima | 84/622 |
| 5,278,347 | 1/1994 | Konishi | 84/613 |
| 5,278,348 | 1/1994 | Eitaki et al. | 84/636 |
| 5,286,908 | 2/1994 | Jungleib | 84/603 |
| 5,286,909 | 2/1994 | Shibukawa | 84/609 |

FOREIGN PATENT DOCUMENTS

| | | |
|---|---|---|
| 63-170697 | 7/1988 | Japan . |
| 64-57298 | 3/1989 | Japan . |
| 64-43398 | 3/1989 | Japan . |
| 64-91173 | 4/1989 | Japan . |

*Primary Examiner*—William M. Shoop, Jr.
*Assistant Examiner*—Jeffrey W. Donels
*Attorney, Agent, or Firm*—Frishauf, Holtz, Goodman & Woodward

[57] ABSTRACT

An indication or image on a display unit is switched in response to changes in performance data of a tune which is being played automatically. Tone pitch data included in the performance data are detected, and the indication on the display unit is switched in response to changes in the detected tone pitch data. Velocity data and tone color data in the performance data may be used in place of the tone pitch data. If a tune is automatically played based on a plurality of performance data which are simultaneously read out, the indication on the display unit is switched based on changes in either of the plurality of performance data. If switching data representing changes of rhythm of the tune is included in the performance data, the switching data are detected, and are used to change a way of switching the indication (image) on the display unit. The indication or image on the display unit may be switched at timings based on beats or strong beats or at timings of measures. If performance data for automatically playing a tune are input while a user of a musical instrument is playing the instrument, the indication or image on the display unit is switched based on the number of keys which the user operates simultaneously, touch data or tone area data.

7 Claims, 89 Drawing Sheets

TNR:TONE-COLOR REGISTER

VER:VELOCITY REGISTER

OCR:OCTAVE REGISTER

KER:KEY REGISTER

ZGR:PREVIOUS-INDICATION REGISTER n:TONE-GENERATING LINE REGISTER

G:INDICATION-NUMBER REGISTER

STEP-TIME DATA
00~FE

GATE-TIME DATA
00~FE

STR : STEP-TIME REGISTER

GTR : GATE-TIME REGISTER

SC : STEP COUNTER

LGT : LINE-GATE TIME REGISTER

TC : TIMING COUNTER

AUTOMATIC PLAYING APPARATUS WHICH DISPLAYS IMAGES IN ASSOCIATION WITH CONTENTS OF A MUSICAL PIECE

BACKGROUND OF THE INVENTION

1. Field of the Invention

The present invention relates to an automatic playing apparatus and an electronic musical instrument, in which an image indication is switched in association with tune data played by a player or tune data automatically played.

2. Description of the Related Art

With recent progress in functions of electronic musical instruments and automatic playing apparatus, there have been developed such electronic musical instruments and automatic playing apparatus as not only allows a performance with a mono musical tone but also are capable of generating a plurality of musical tones simultaneously. Further, an electronic musical instrument and automatic playing apparatus provided with a display unit have been put on the market.

The display units of the automatic playing apparatus and the electronic musical instrument are used to indicate a title of a tune to be automatically performed and are also used to teach a player how to operate the instrument or how to use the functions of apparatus.

Some of these conventional electronic musical instruments and automatic playing apparatus are provided with a demonstration mode in addition to a playing mode to display image data for demonstration in place of tune titles and how to operate the musical instrument. Further, there has been proposed to put these instruments at store fronts and to indicate image data for demonstration on the display unit for sales promotion.

These conventional automatic playing apparatus with a display unit hold image data which have nothing to do with performance data of tunes or musical programs to be automatically played. Therefore, these automatic playing apparatus display image data on the display unit independently of performance of musical programs, so that the indication on the display unit are not changed in accordance with performance of musical programs. As a result, the indication or image on the display unit tells nothing about transition of contents of performance of a musical program and composition of the musical program. The indication on the display unit can not be used conveniently and gives nothing interesting to customers.

To overcome these problems of dull indication on the display unit, there has been proposed a solution, in which continuous image data corresponding to a moving image are previously stored, and indication on the display unit is changed in accordance with the continuous image data to display an indication that changes as a musical program is being played. But this solution needs large memory capacity. Another solution therefore has been proposed, in which a plurality of picture data corresponding to a plurality of still pictures are previously stored, and these picture data are selectively switched and sent to a display unit, and whereby the indication on the display unit is switched every switching timing to display picture data, as if a moving picture is displayed (a false moving picture). The false moving picture is displayed for demonstration to excite customers' purchase interest, for example, at store fronts where electronic musical instruments are displayed for sale.

To display the false moving picture, there must be stored switching data for switching the indication on the display unit in addition to a series of performance data for performing an automatic-playing operation, i.e., tone-pitch data, tone-length data and velocity data of musical tones, which compose a musical program. The switching data for switching the indication are inserted into the above series of performance data and are stored in a memory provided for storing the performance data, and otherwise the switching data must be stored in a memory which is specialized for storing the same. In either event, the automatic playing apparatus needs memory capacity for storing the switching data that is larger than memory capacity required for storing performance data. With use of memory capacity required only for storing the performance data, the false moving picture can not be displayed.

Some of conventional electronic musical instruments are provided with display units, but they display only a musical score or functions of the instrument, but do not display data in association with input musical tones. Therefore, these electronic musical instruments do not show the inherent features as an electronic musical instrument. In particular, it is hard for a player to visually understand dynamism of performance (for example, velocity data such as intensity and velocity of a depressed key, number of musical tones as being simultaneously generated, change in tone pitches) with the conventional electronic musical instrument.

In other words, the conventional electronic musical instrument with a display unit displays an indication that is independent of input performance data, and are lack of attraction, raising no marketable value.

SUMMARY OF THE INVENTION

The present invention has been made to overcome the above problems, and has an object to provide an automatic playing apparatus with a display unit, in which an indication or image displayed on the display unit changes in association with contents of a tune being automatically played, whereby the indication on the display unit can be used conveniently and further the indication or image can be made to be attractive.

According to one aspect of the invention, there is provided an automatic playing apparatus with a display unit, which comprises:

performance-data storing means for storing a series of performance data necessary for executing an automatic playing operation, the performance data comprising plural sorts of data elements;

reading means for sequentially reading out performance data from said performance-data storing means;

musical-tone signal generation instruction means for instructing to generate a musical-tone signal based on the performance data read out by said reading means;

indication-data storing means for storing plural sorts of indication data necessary for displaying an indication or image;

indication-data selecting means for selecting either of the indication data stored in said indication-data storing means in response to change in predetermined data elements, the data elements composing the performance data read out by said reading means; and display means for displaying an indication based on the indication data selected by said indication-data selecting means.

With the above arrangement of the automatic playing apparatus, indication data is selectively displayed in accordance with performance data and contents of indication or image on the display unit are changed in association with contents of a tune which is automatically played, so that the contents of indication tell change in contents of the tune and the composition of the tune. As a result, indication of the display unit can be used more conveniently and can be very attractive one.

It is another object of the present invention to provide an automatic playing apparatus with a display unit, in which an indication or image displayed on the display unit changes in association with contents of a tune to be automatically played, and shows change of a flow of a performance of a tune such as modulation of the tune.

According to one aspect of the invention, there is provided an automatic playing apparatus with a display unit, which comprises:

performance-data storing means for storing a series of performance-data necessary for performing an automatic playing operation and switching data inserted into the performance data in association with the performance data;

playing means for sequentially reading out performance data from said performance-data storing means, and performing an automatic playing operation based on the read out performance data;

indication-data storing means for storing a plurality of indication data;

indication selecting means for selecting anyone of the indication data stored in said indication-data storing means on the basis of change in the performance data which are sequentially read out from said performance-data storing means by said playing means;

selection control means for, on the basis of the performance data, making indication data different from that selected before switching data is read out, when said playing means reads out switching data from said performance-data storing means, the indication data being selected by said indication selecting means; and display means for displaying an indication or image based on the indication data selected by said indication selecting means.

As described above, switching data are inserted to a position in the performance data, where modulation of the tune to be automatically played is changed, allowing the indication or image on the display unit to show changes in flow of the performance.

It is yet another object of the invention to provide an automatic playing apparatus with a display unit, in which a plurality of performance data are simultaneously read out, and a tune is automatically played based on the read out data, and further the display unit shows various attractive indications or image in association with the read out performance data.

According to yet another aspect of the invention, there is provided an automatic playing apparatus with a display unit which comprises:

performance-data storing means for dividing a series of performance-data necessary for performing an automatic playing operation and stores the divided performance data in a plurality of memory areas;

playing means for sequentially reading out performance data stored in the memory areas of said performance-data storing means in a predetermined order, and performing an automatic playing operation based on the read out performance data;

memory-area selecting means for selecting anyone of the memory areas of said performance-data storing means;

indication-data storing means for storing a plurality of indication data;

indication selecting means for selecting anyone of the indication-data stored in said indication-data storing means on the basis of change in the performance data which are sequentially read out by said playing means from the memory area of said performance-data storing means selected by said memory-area selecting means; and display means for displaying a relevant indication or image based on the indication data selected by said indication selecting means.

With the above arrangement of the automatic playing apparatus, the indication or image on the display unit changes in association with contents of a tune to be automatically played, and is made very attractive, and further the indication or image changes in association with a particular performance data which is selected from among a plurality of performance data composing the tune.

It is other object of the invention to provide an automatic playing apparatus with a display unit, in which the indication or image on the display unit changes in accordance with progress of beats of a tune to be automatically played, displaying changes in contents of the tune and the tune composition.

According to other aspect of the invention, there is provided an automatic playing apparatus with a display unit which comprises:

performance-data storing means for storing performance data of a musical piece to be automatically played;

playing means for sequentially reading out performance data stored in said performance-data storing means at predetermined playing timings, and performing an automatic playing operation based on the read out performance data;

indication-data storing means for storing a plurality of indication data;

indication selecting means for detecting timings of respective beats from playing timings at which said playing means performs an automatic playing operation and selecting anyone of the indication data stored in said indication-data storing means on the basis of the detected timings of respective beats; and display means for displaying an indication or image based on the indication data selected by said indication selecting means.

With the above arrangement of the automatic playing apparatus, the indication or image on the display unit changes in association with the progress of beats of the tune to be automatically played, showing changes in contents of the played tune.

It is yet other object of the invention to provide an automatic playing apparatus with a display unit, in which the indication or image on the display unit is allowed with a simpler arrangement to change in accordance with progress of beats of a tune to be automatically played.

According to yet other object of the invention, there is provided an automatic playing apparatus with a display unit which comprises:

performance-data storing means for storing a series of performance data necessary for performing an automatic playing operation and switching data inserted into the performance data in association with beats;

playing means for sequentially reading out performance data stored in said performance-data storing means, and performing an automatic playing operation based on the read out performance data;

indication-data storing means for storing a plurality of indication data;

indication selecting means for selecting anyone of the indication-data stored in said indication-data storing means when said playing means reads out switching data from said performance-data storing means; and display means for displaying an indication or image based on the indication data selected by said indication selecting means.

With the above arrangement of the automatic playing apparatus, progress of beats of a tune can be detected with no a special structure for detecting timings of beats, and the indication or image shows transitions of a played tune and the tune composition.

It is yet object of the invention to provide an automatic playing apparatus with a display unit, in which the indication or image on the display unit changes in accordance with progress of measures of a tune to be automatically played, displaying transitions of the tune and the tune composition.

According to yet other aspect of the invention, there is provided an automatic playing apparatus with a display unit which comprises:

performance-data storing means for storing a series of performance data necessary for performing an automatic playing operation and switching data inserted into the performance data every measures;

playing means for sequentially reading out performance data stored in said performance-data storing means, and performing an automatic playing operation based on the read out performance data;

indication-data storing means for storing a plurality of indication data;

indication selecting means for selecting anyone of the indication data stored in said indication-data storing means when said playing means reads out switching data from said performance-data storing means; and display means for displaying an indication or image based on the indication data selected by said indication selecting means.

With the above arrangement of the automatic playing apparatus, the indication or image on the display unit changes in accordance with progress of measures of the tune to be automatically played, displaying transitions of the tune and the tune composition.

It is still other object of the invention to provide an automatic playing apparatus with a display unit, in which the indication or image on the display unit changes in accordance with progress of strong beats of a tune to be automatically played, displaying changes in contents of the tune and the tune composition.

According to other aspect of the invention, there is provided an automatic playing apparatus with a display unit which comprises:

performance-data storing means for storing a series of performance data necessary for performing an automatic playing operation and switching data inserted into the performance data every strong beats;

playing means for sequentially reading out performance data stored in said performance-data storing means, and performing an automatic playing operation based on the read out performance data;

indication-data storing means for storing a plurality of indication data;

indication selecting means for selecting anyone of the indication data stored in said indication-data storing means when said playing means reads out switching data from said performance-data storing means; and display means for displaying an indication or image based on the indication data selected by said indication selecting means.

With the above arrangement of the automatic playing apparatus, the indication or image on the display unit changes in association with the progress of strong beats of the tune to automatically played, showing changes in contents of the played tune.

It is still another object of the invention to provide an electronic musical instruments, a display unit of which displays indication in association with performance data externally input to the instrument, and in particular display or images indication in association with number of tones to be simultaneously generated, to help a player to visually understand dynamism of performance.

According to still another aspect of the invention, there is provided an electronic musical instrument which comprises:

a plurality of performance operators each for designating a tone pitch of a musical tone to be generated;

simultaneous operation number detecting means for detecting number of performance operators which are simultaneously operated;

musical-tone generation instruction means for instructing to generate a musical tone of a tone pitch corresponding to an operated performance operator;

indication-data storing means for storing plural sorts of indication data necessary for displaying an indication;

indication-data selecting means for selecting either of the indication data stored in said indication-data storing means in accordance with number of the performance operators detected by said simultaneous operation number detecting means, the performance operators being simultaneously operated; and display means for displaying an indication or image based on the indication data selected by said indication-data selecting means.

With the above arrangement of the electronic musical instrument, the indication or image on the display unit can be switched in association with the externally input performance data, particularly, such as number of tones to be simultaneously generated, and inherent features of an electronic musical instrument can be expressed to help the player to visually understand the dynamism of performance.

It is further object of the invention to provide an electronic musical instrument, a display unit of which displays indication or image in association with performance data externally input to the instrument, and in particular displays indication in association with touch data, to help a player to visually understand dynamism of performance.

According to further aspect of the invention, there is provided an electronic musical instrument which comprises:

a plurality of performance operators each for designating a tone pitch of a musical tone to be generated;

touch-data detecting means for detecting touch data corresponding to operating speeds or operating force of performance operator;

musical-tone generation instruction means for instructing to generate a musical tone of a tone pitch corresponding to an operated performance operator;

indication-data storing means for storing plural sorts of indication data necessary for displaying an indication;

indication-data selecting means for selecting either of the indication data stored in said indication-data storing means in accordance with touch data detected by said touch-data detecting means; and display means for displaying an indication or image based on the indication or image data selected by said indication-data selecting means.

With the above arrangement of the electronic musical instrument, the indication on the display unit can be switched in association with the externally input performance data, particularly, such as touch data, and inherent features of an electronic musical instrument can be expressed to help the player to visually understand the dynamism of performance.

It is further other object of the invention to provide an electronic musical instrument, a display unit of which displays an indication or image in association with performance data externally input to the instrument, and in particular displays an indication or image in association with a tone range to which a tone pitch of a musical tone to be generated, to help a player to visually understand dynamism of performance.

According to further other aspect of the invention, there is provided an electronic musical instrument which comprises:

a plurality of performance operators each for designating a tone pitch of a musical tone to be generated;

tone-range detecting means for detecting a tone range to which a tone pitch designated by said performance operator belongs;

musical-tone generation instruction means for instructing to generate a musical tone of the tone pitch corresponding to an operated performance operator;

indication-data storing means for storing plural sorts of indication data necessary for displaying an indication;

indication-data selecting means for selecting either of the indication data stored in said indication-data storing means in accordance with the tone range detected by said tone-range detecting means; and display means for displaying an indication or image based on the indication data selected by said indication-data selecting means.

With the above arrangement of the electronic musical instrument, the indication or image on the display unit can be switched in association with the externally input performance data, particularly, such as the tone range to which the tone pitch of a musical tone to be generated, and inherent features of an electronic musical instrument can be expressed to help the player To visually understand the dynamism of performance.

The other objects and features of the invention will be understood by those skilled in the art from the description of preferred embodiments of the invention and the accompanying drawings.

BRIEF DESCRIPTION OF THE DRAWINGS

FIG. 18 is a flow chart of a part of tone-generation process and an indication-display process executed by CPU in an embodiment (a fourteenth embodiment) of an electronic musical instrument according to the invention.

DETAILED DESCRIPTION OF THE PREFERRED EMBODIMENT

Figure 1:
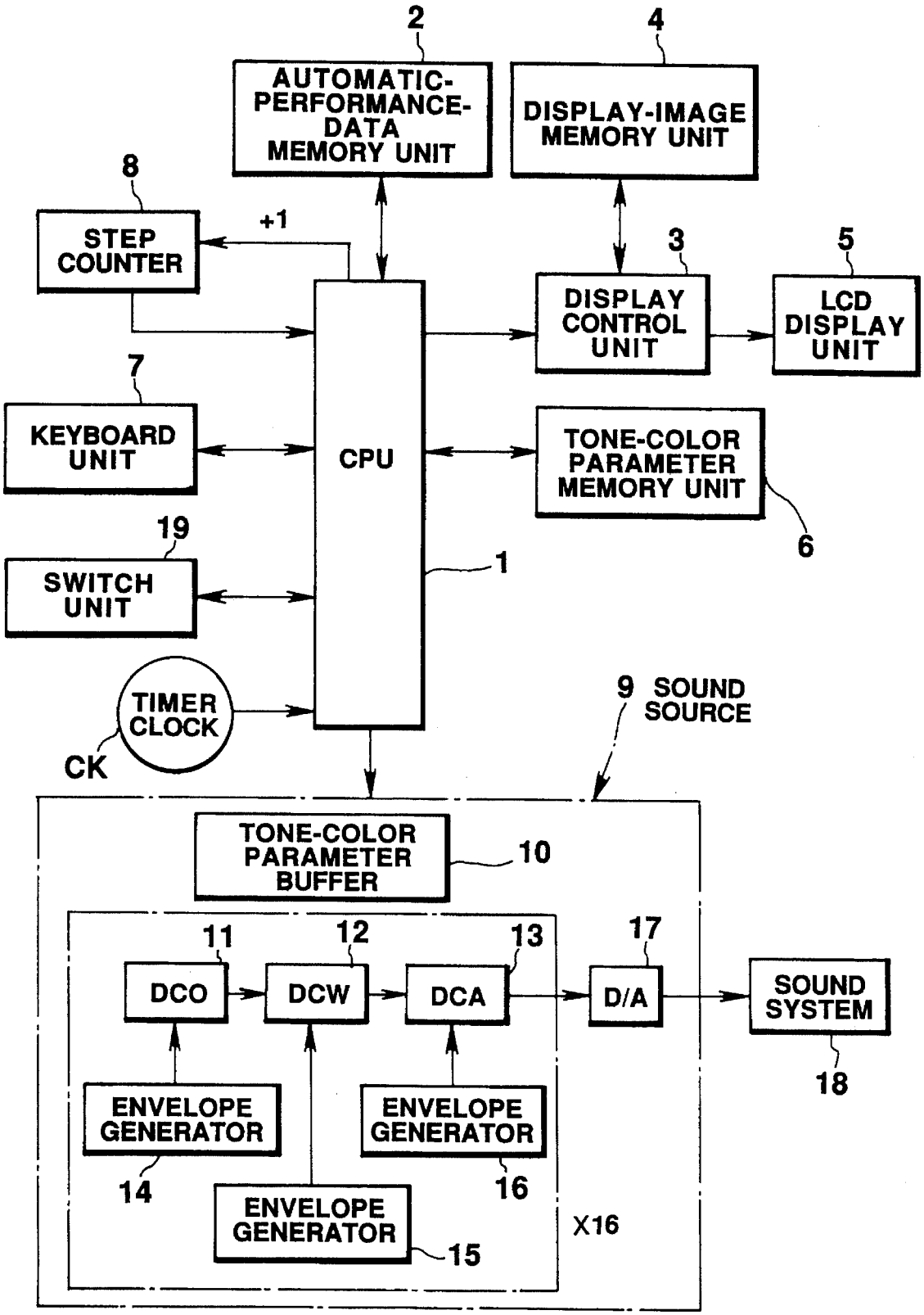
FIG. 1 is a whole block diagram of a first embodiment of an electronic musical instrument according to the invention.

Now, the first embodiment of the electronic musical instrument according to the invention will be described with reference to the accompanying drawings. FIG. 1 is a block diagram of the whole structure of the embodiment of the electronic musical instrument provided with an automatic playing apparatus. CPU 1 receives a clock pulse signal of a given period from a timer clock CK. CPU 1 reads out performance data stored in an automatic performance data memory unit 2 in internal RAM, executes a process necessary for an automatic playing operation and controls a display control unit 3 on the basis of program memorized in an internal ROM and data stored in an internal RAM. The performance data stored in the automatic performance data memory unit 2 comprises step data of 4 bytes from the first byte to fourth byte shown in FIGS. 2(*a*), 2(*b*), and 2(*c*), each corresponding to a musical tone (a musical note) to be generated. A series of performance data composed of 4 byte data form a performance data necessary for automatically playing a tune.

Figure 2A:
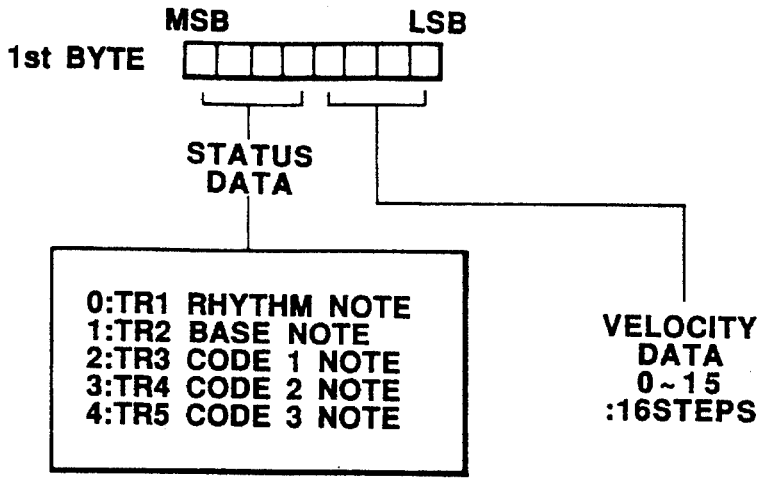
FIGS. 2(*a*), 2(*b*) and 2(*c*) are views illustrating step data which compose performance data used in the embodiment for executing automatic performance.
Figure 2B:
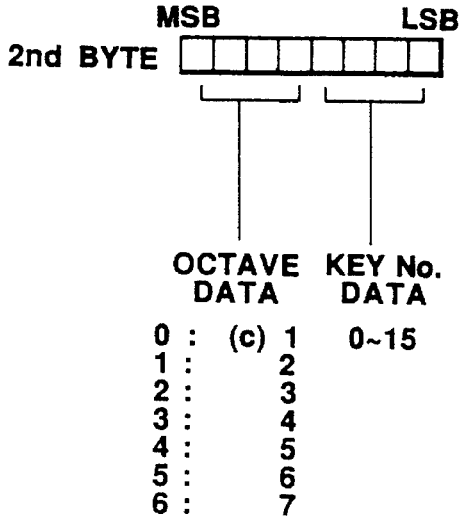
Figure 2C:
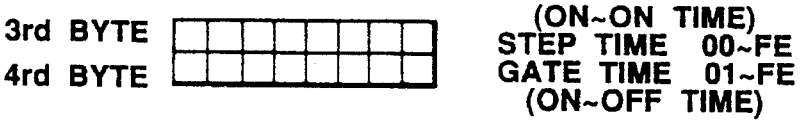

In data of the first byte shown at (a) of FIG. 2, the first 4 more significant bits compose status data representative of sorts of a musical tone (a musical note), and are stored with the following values:

0: Tr1 rhythm note

1: Tr2 base note

2: Tr3 code 1 note

3: Tr4 code 2 note

4: Tr5 code 3 note

More specifically, an automatic performance is composed of a rhythm tone, a base tone and three sorts of code tones, and either of values from 0 to 4 representative of respective tones are stored in the first 4 more significant bits of the first byte. Tr1 to Tr5 represent track numbers (tone-generation lines) respectively which are assigned at tone generation. Meanwhile, 4 less significant bits of the first byte store strength of key touch, i.e., velocity data of 16 steps from 0 to 15, which determine tone volume and tone quality of a musical tone to be generated.

The second byte shown in FIG. 2(*b*) memorizes tone-pitch data of a musical tone to be generated, and tone-pitch data is composed of 4 more significant bits representative of octaves (1st of 7th octave) and 4 less significant bits representative of key numbers (0 to 15) in an octave. The third byte shown in FIG. 2(*c*) memorizes a step time which represents a time period from a current step on to the following step on, i.e., memorizes a tone length of values 00 to FE. The fourth byte shown in FIG. 2(*c* ) memorizes a time period from a gate on to a gate off, i.e., memorizes a gate time of values 01 to FE.

The above described data of 4 bytes are sequentially read out every step in accordance with values of a step counter 8 which are incremented by a signal from CPU 1. At the leading portion of the series of performance data, there is stored time data of one byte which is representative of a time period between a time when a start switch is depressed and a time when an automatic playing operation starts, and at the tail portion of the performance data, there is stored STEP TIME=11111111 (FF) representative of an end of the automatic playing operation.

Figure 3:
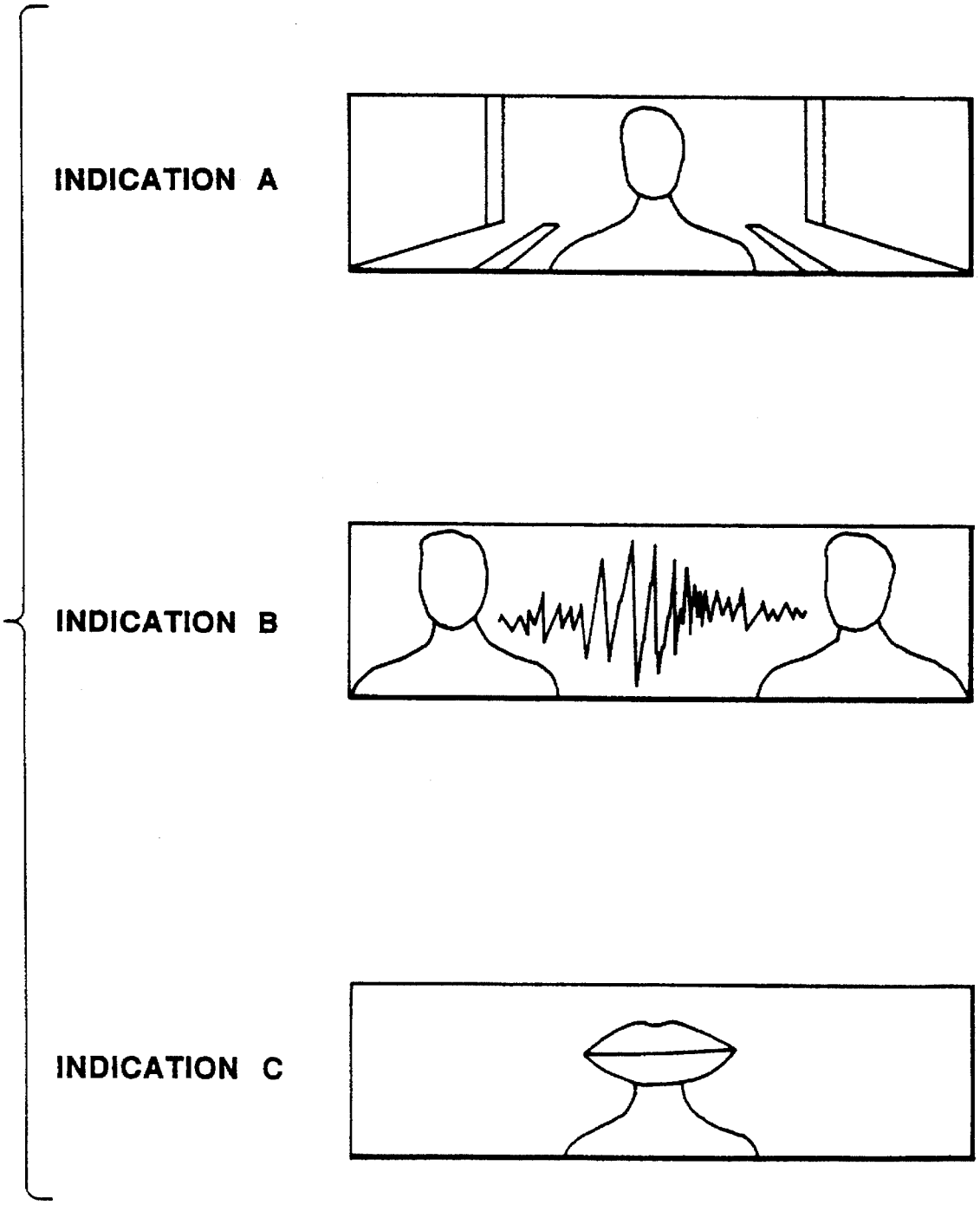
FIG. 3 is a view illustrating displays on a liquid crystal display (LCD) unit of the embodiment.
Figure 4:
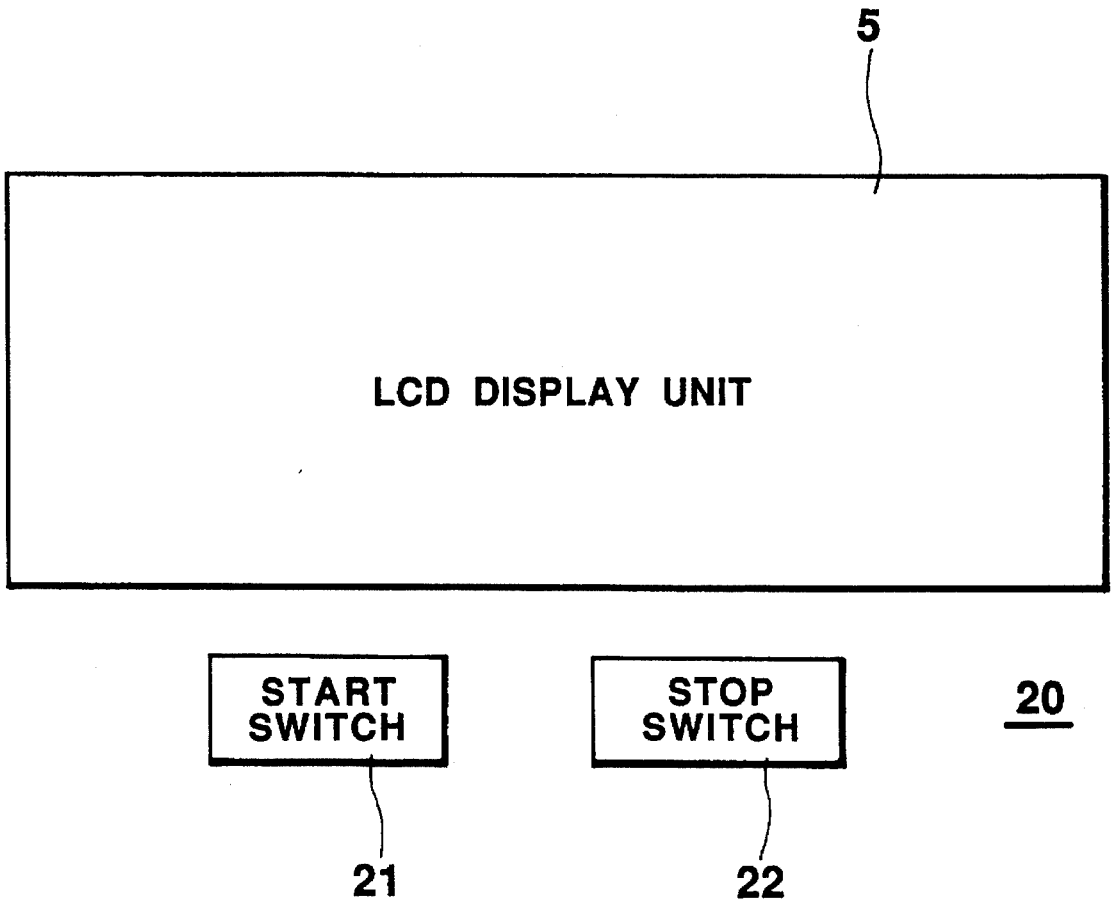
FIG. 4 is a plane view showing an essential part of the embodiment of the electronic musical instrument.

Meanwhile, the display control unit 3 selects indication data (i.e., image data) stored in a display-image memory unit 4 and supplies the same to an LCD unit 5. In the display-image memory unit 4, indication or image data are stored which are capable of displaying indications or images (still images) A, B and C shown in FIG. 3 on the LCD unit 5. The display control unit 3 executes selecting operation to select and display either of indications (images) A, B and C on the LCD unit 5.

In a tone-color parameter memory unit 6, there are stored tone-color parameters which determine tone color when CPU 1 performs automatic playing operation in accordance with performance data stored in the automatic performance data memory unit 2 or when CPU 1 performs musical-tone generating process in accordance with key data from a keyboard unit 7 including keys 61. The musical-tone parameters are composed of parameter data such as DCO, DCW, DCA and envelope parameter data, and these parameter data for determining tone color selected by CPU 1 are stored in a tone-color parameter buffer 10 in a sound source 9.

The sound source 9 is of a poly-multi-assign type and includes 16 units of circuit-combinations comprising DCO (digital controlled oscillator) 11 of PCM type, DCW (digital controlled wave) 12, DCA (digital controlled amplifier) 13, an envelope generator 14, an envelope generator 15 and an envelope generator 16. DCO 11 generates a fundamental waveform of a musical tone to be generated. The envelope generator 14 determines change in the fundamental waveform of the musical tone which alters with time. DCW (digital controlled wave) 12 controls tone color of the output waveform of DCO 11. The envelope generator 15 decides change in a tone-color characteristic which alters with time. DCA 13 controls tone volume of an output waveform of DCW 12, and the envelope generator 16 decides change in a tone-volume characteristic which alters with time.

The sound source 9 comprising 16 units of circuit-combinations, i.e., 16 tone-generating lines is capable of simultaneously generating musical tones of designated tone colors, i.e., is capable of simultaneously generating 16 musical tones of 16 tone colors at a maximum. The musical-tone waveforms output from the respective tone-generating lines are supplied to D/A converter 17, are converted into analog signals, and are further transferred to a sound system 18, and are audibly output therefrom.

Figure 5:
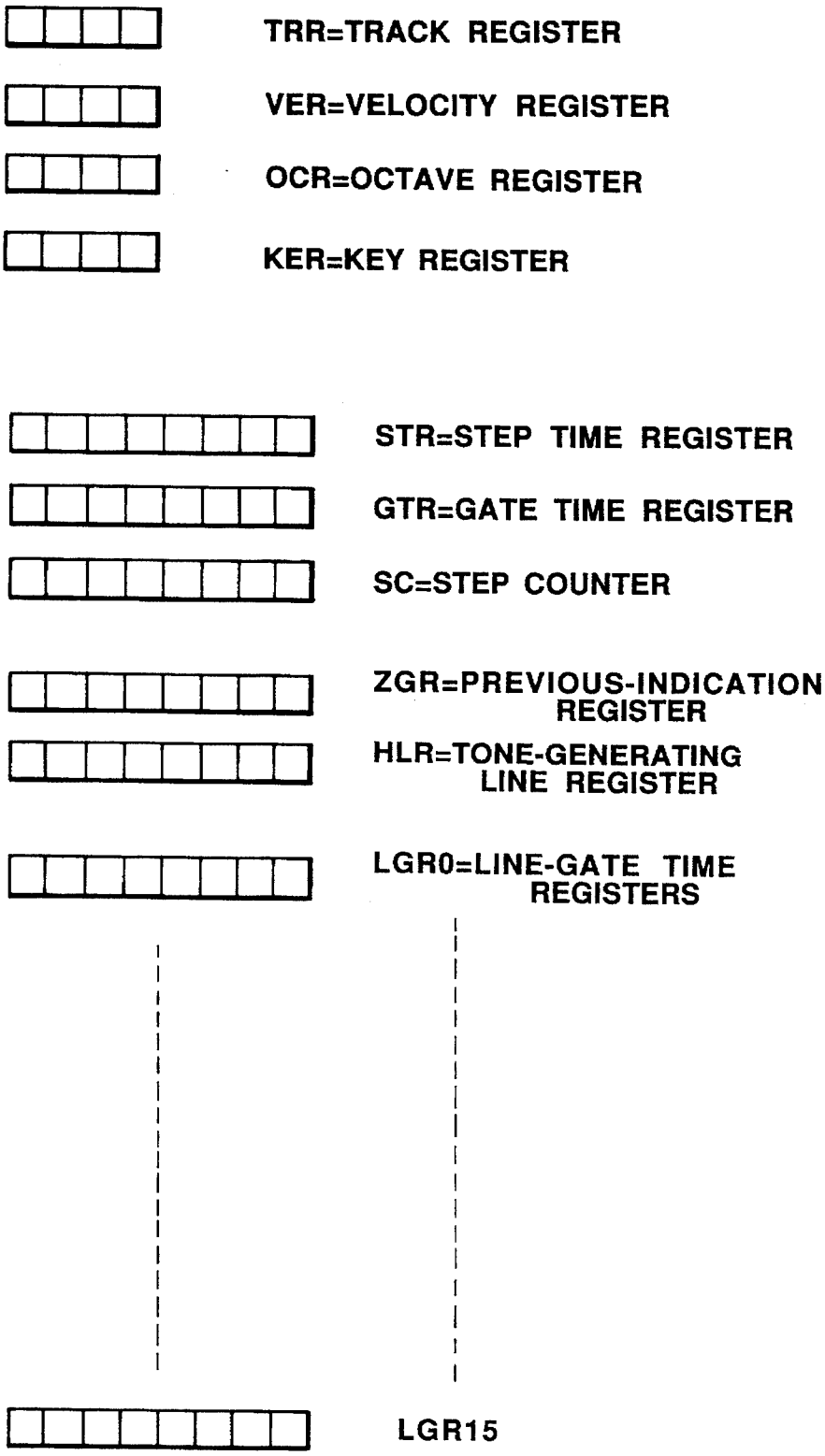
FIG. 5 is a view illustrating registers provided in the CPU of the embodiment.

A switch unit 19 is mounted on an instrument body 20 for inputting operation data to CPU 1. The switch unit 19 includes a start switch 21 which is operated when the automatic playing operation is made start and a stop switch 22 which is operated when the automatic playing operation is stopped. In the vicinity of the switches 21, 22 on the instrument body 20, there is disposed the above LCD unit 5. The following registers and counters shown in FIG. 5 are previously prepared for CPU 1.

TRR=Track Register for storing status data of 4 bits (see FIG. 2(*a*))

VER=Velocity Register for storing velocity data of 4 bits (see FIG. 2(*b*))

OCR=Octave Register for storing octave data of 4 bits (see FIG. 2(*b*))

KER=Key Register for storing KEY-NUMBER data of 4 bits in one octave (see FIG. 2(*b*))

STR=Step Time Register for storing STEP-TIME data of one byte (see FIG. 2(*c*))

GTR=Gate Time Register for temporarily storing Gate-Time data of one byte (see FIG. 2(*c*))

SC=Step Counter of one byte for indicating data of what step in performance data should be processed ZGR=Previous-Indication Register of one byte for storing indication number of an indication which was displayed on the LCD unit 5 before a current indication is displayed HLR=Tone-Generating Line Register of one byte for indicating an idle tone-generating line of the sound source 9 which is not in use for generating a musical tone LGRs 0 to 15=Line-Gate Time Registers of one byte, provided for respective tone-generating lines for storing Gate-Time data (see FIG. 2(*c*))

Figure 6:
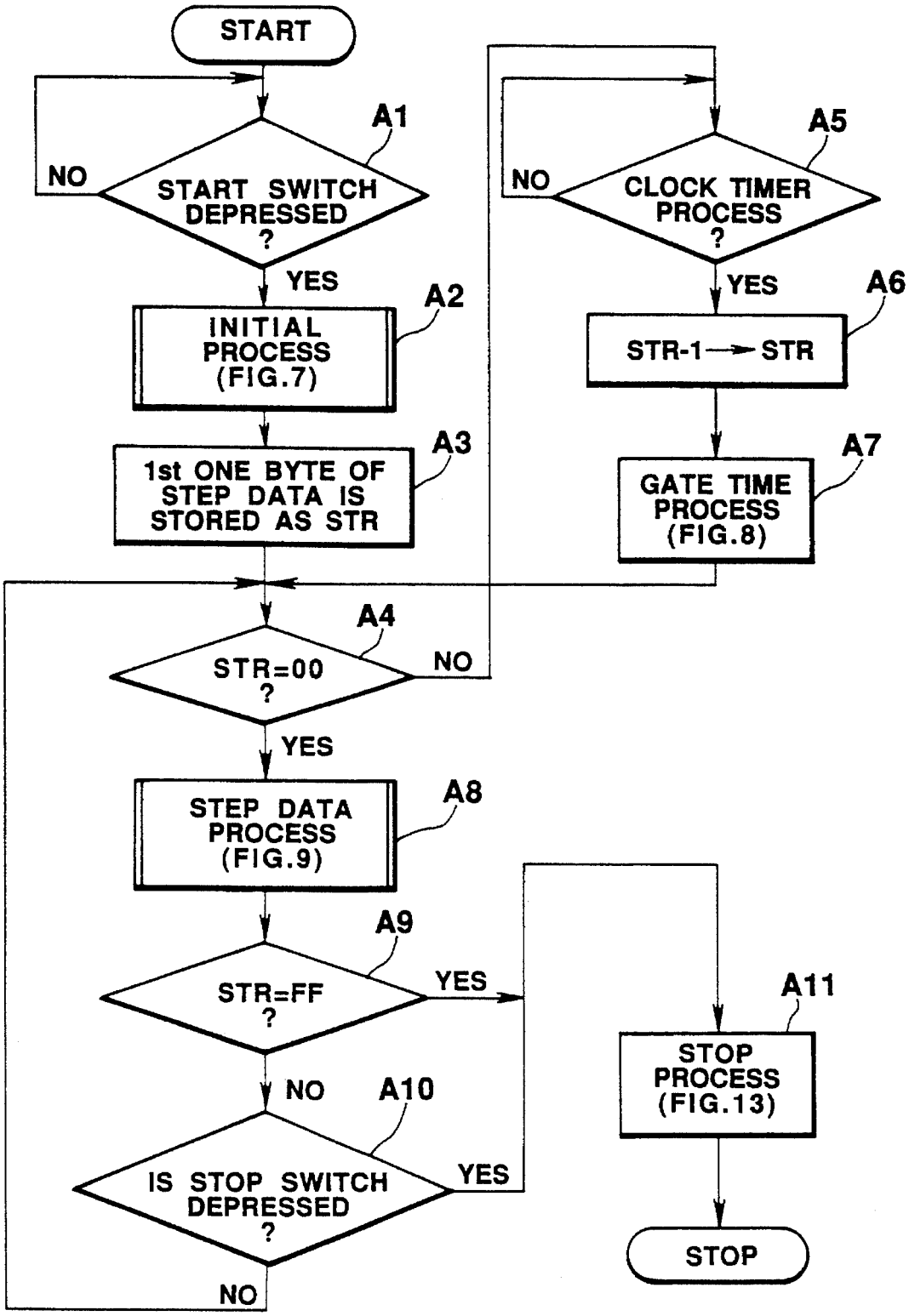
FIG. 6 is a flow chart of a main routine process of the embodiment.

Now, an operation of the embodiment having the above structure will be described with reference to the flow charts of FIGS. 6 to 16. The flow chart of FIG. 6 illustrates the main routine operation. When the power (not shown) on the instrument body 20 is turned on, CPU 1 starts the main routine operation. At step A1, CPU 1 judges if the start switch 21 is depressed. CPU 1 keeps a waiting state until the start switch 21 is depressed and executes an initial process at step A2 when the start switch 21 is depressed.

Figure 7:
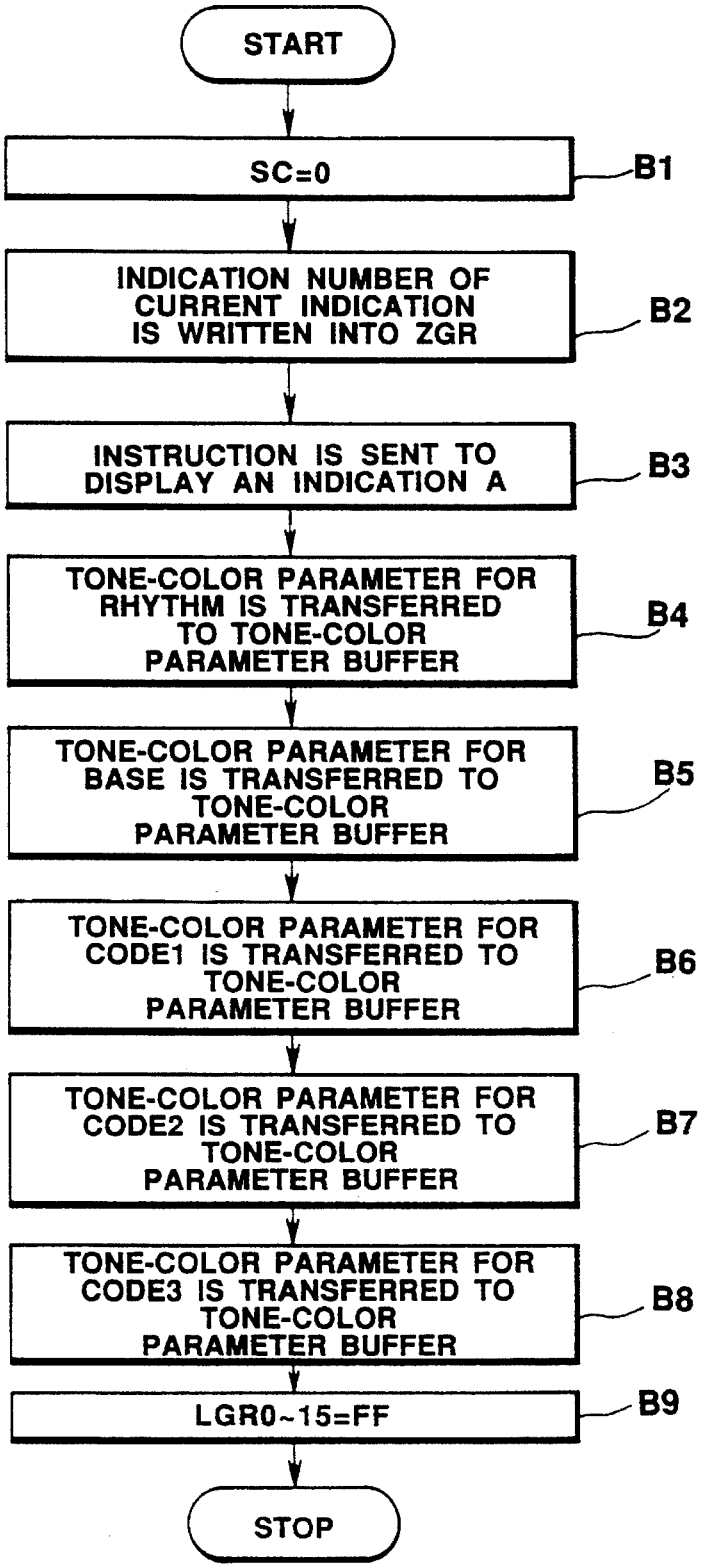
FIG. 7 is a flow chart of an initial process of the embodiment.

The initial process is executed in accordance with the flow chart of FIG. 7. At step B1, the step counter SC is reset to zero. An indication number of a current indication which is on the LCD unit 5 is written into the previous indication register ZGR at step B2. CPU 1 sends an instruction to display an indication A at step B3. Then, CPU 1 transfers a tone color parameter for rhythm of an automatic playing operation to be executed to a tone-color parameter buffer 10 at step B4, a tone color parameter for base to the same at step B5, a tone color parameter for code 1 to the same at step B6, a tone color parameter for code 2 to the same at step B7, and a tone color parameter for code 2 to the same at step B8. CPU 1 sets an initial value FF= "11111111" to line-gate time registers LGR 0 to 15, the initial value which indicates the musical-tone generating lines are idle, and then gets away from the initial process.

Having finished the initial process at step A2, CPU 1 goes to step A3, where CPU 1 stores as STR the first one byte of step data composing performance data in the step-time register. Since, as described above, time data of one byte representative of time required before the automatic playing operation starts after the start switch 21 is depressed is stored at the leading portion of the performance data composed of a series of step data, the time data is stored as STR in the step-time register at step A3. CPU 1 judges at step A4 if a value of STR has become "00" or judges if a time for starting the automatic playing operation has been reached. When the result of the judgement at step A4 is "NO" and STR= 00 is not true, CPU 1 executes a clock-timer process judgement at step A5.

In the clock-timer process at step A5, it is judged based on a clock-pulse signal from the timer clock CK if a period (for example, the length of a sixteenth note) for reading out step data has been reached. When the period for reading out step data is reached, CPU 1 decrements a value of STR at step A6 and then executes a gate time process at step A7.

Figure 8:
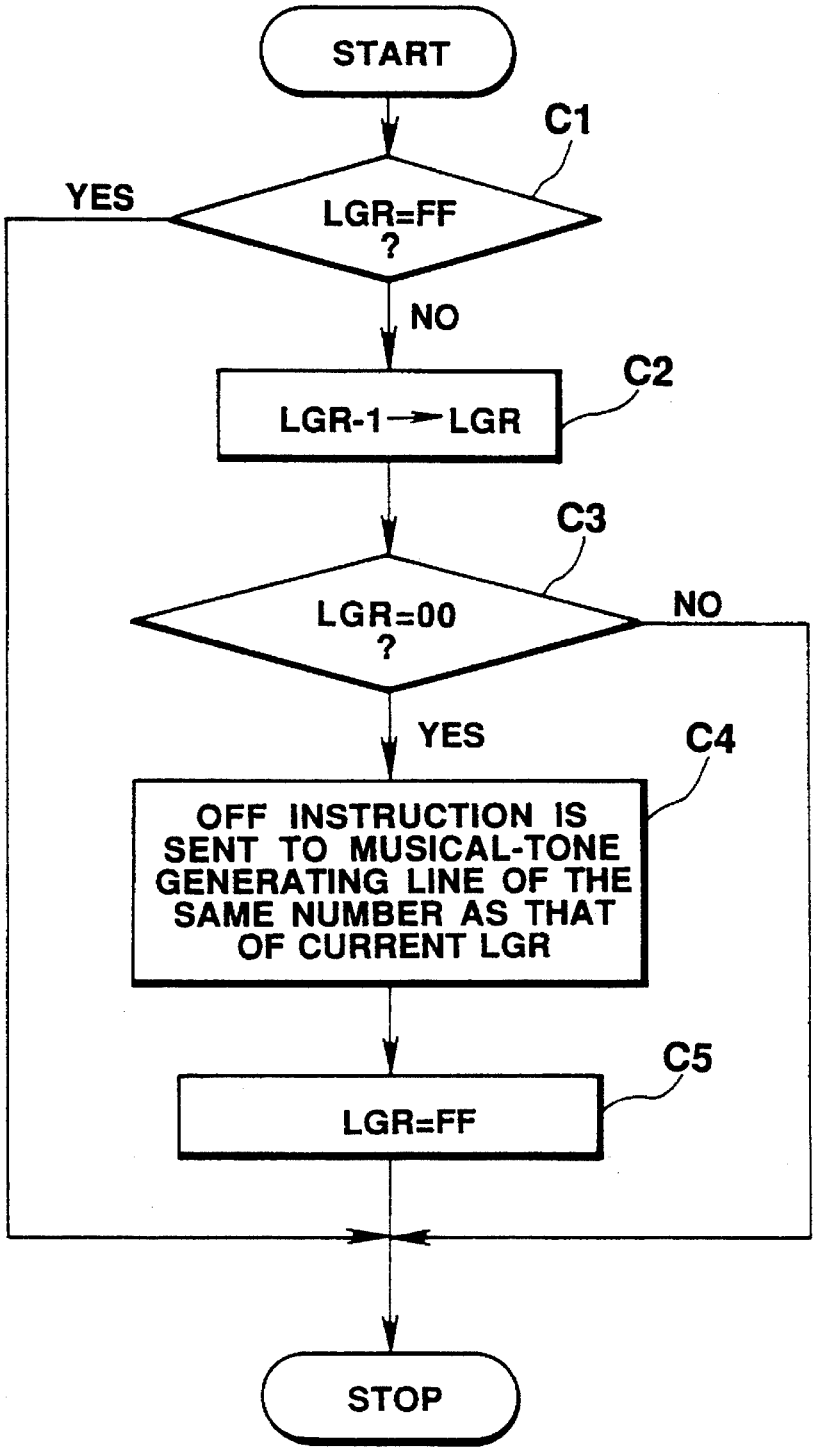
FIG. 8 is a flow chart of a gate time process of the embodiment.

The gate time process is repeatedly executed for LGR 0 to LGR 15 in accordance with the flow chart of FIG. 8. As a result, the gate time process will be repeated for 16 times. It is judged at step C1 if the LGR is FF. When the result of the judgement is YES, a musical-tone generating line of the number designated by the value of LGR is judged an idle line. Then, CPU 1 goes to stop, and starts the gate time process for the next LGR. When the result of the judgement at step C1 is NO, and a given value has been set to LGR, a musical-tone generating line designated by the value of LGR will be in operation to generate a musical tone. CPU 1 decrements a line gate time stored in LGR at step C2, and judges at step C3 if a line gate time, i.e., a value of LGR has become "00". When the result of the judgement is NO, CPU 1 goes to stop process, and starts the gate time process for the following LGR. When the result of the judgement at step C3 is YES, CPU 1 sends, at step C4, an OFF instruction to a musical-tone generating line designated by the value of LGR because a line gate time of the musical-tone generating line is finished. Then, the musical-tone generating process in the musical-tone generating line is stopped, and the musical-tone generating line becomes idle. Finally, a value FF which represents that the musical-tone generating line is idle is set to LGR at step C5.

Through the gate time process, a value FF will be set to LGR 0 to LGR 15 corresponding to idle musical-tone generating lines among 16 musical-tone generating lines. Immediately after the start switch 21 is depressed, the result of judgement at step C1 with respect to all LGR 0 to LGR 15 will be YES, because a process for setting FF to LGR 0 to LGR 15 has been executed at step B9 of FIG. 7. Then, CPU 1 finishes the gate time process.

In the main routine process of FIG. 6, CPU 1 returns to the judging process of step 4 from the gate time process at step A7, judging again if STR=00 is true. If a value of STR has been made 00 by decrement at step A6, the result of the judgement at step A4 will be YES. Accordingly, CPU 1 advances from step A4 to step A8 where a step data process will be executed. The step data process will be executed in accordance with the flow chart of FIG. 9. At step D1, data are read out by 4 bytes from (4SC+2)th byte of step data to (4SC+ 6) of step data. In other words, if the step counter SC is "0" as in the case immediately after the start switch 21 is depressed, a value of 4SC will be "0" and therefore 4SC+2 will be 2. Since time data is stored at the first byte of the performance data as described above, data of the second byte of performance data corresponds to the first byte of the first step data in the performance data. Data of 4 bytes from the second byte to 5th byte of the performance data, i.e., data of 4 bytes from the first byte to fourth byte of the step data compose the first whole-step-data shown in FIGS. 2(*a*), 2(*b*) and 2(*c*).

When SC=1, 4SC will be "4", and therefore 4SC+2 =6 is obtained. Then, data of 4 bytes from 6th byte to 10th byte of the performance data compose the second whole-step-data. Through the step data reading process at step D1, whole-step-data of 4 bytes are sequentially read out.

At the following step D2, a register setting process is performed. The register setting process is performed in accordance with the flow chart of FIG. 10. The first 4 more significant bits (status data) in the first byte of the first whole-step-data are stored in the track register TRR at step E1 of FIG. 10 while 4 less significant bits (velocity data) in the first byte of the first whole-step-data are stored in the velocity register VER at step E2. The first 4 more significant bits (octave data) in the second byte of the first whole-step-data are stored in the octave register OCR at step E3 while 4 less significant bits (KEY NUMBER data) in the second byte of the first whole-step-data are stored in the key register KER at step E4.

Further, data of the third byte (STEP TIME data) of the first whole-step-data are stored in the step-time register STR at step E5 while data of the fourth byte (GATE TIME data) of the first whole-step-data are registered in the gate-time register GTR at step E6. As described above, through the register setting process at steps E1 to E6, data of one whole-step-data for one musical tone are stored in the relevant registers.

Figure 9:
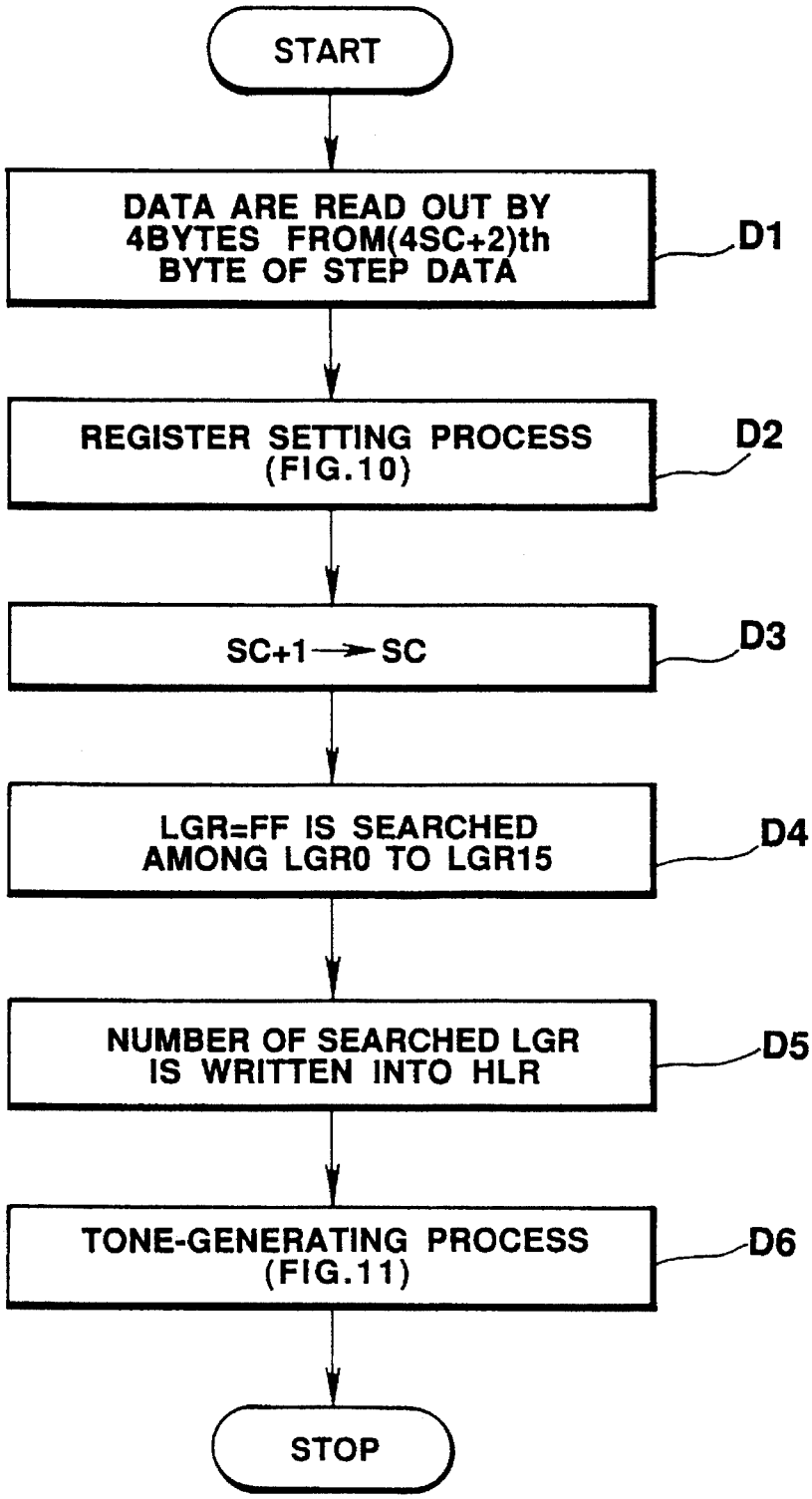
FIG. 9 is a flow chart of a step data process of the embodiment.
Figure 10:
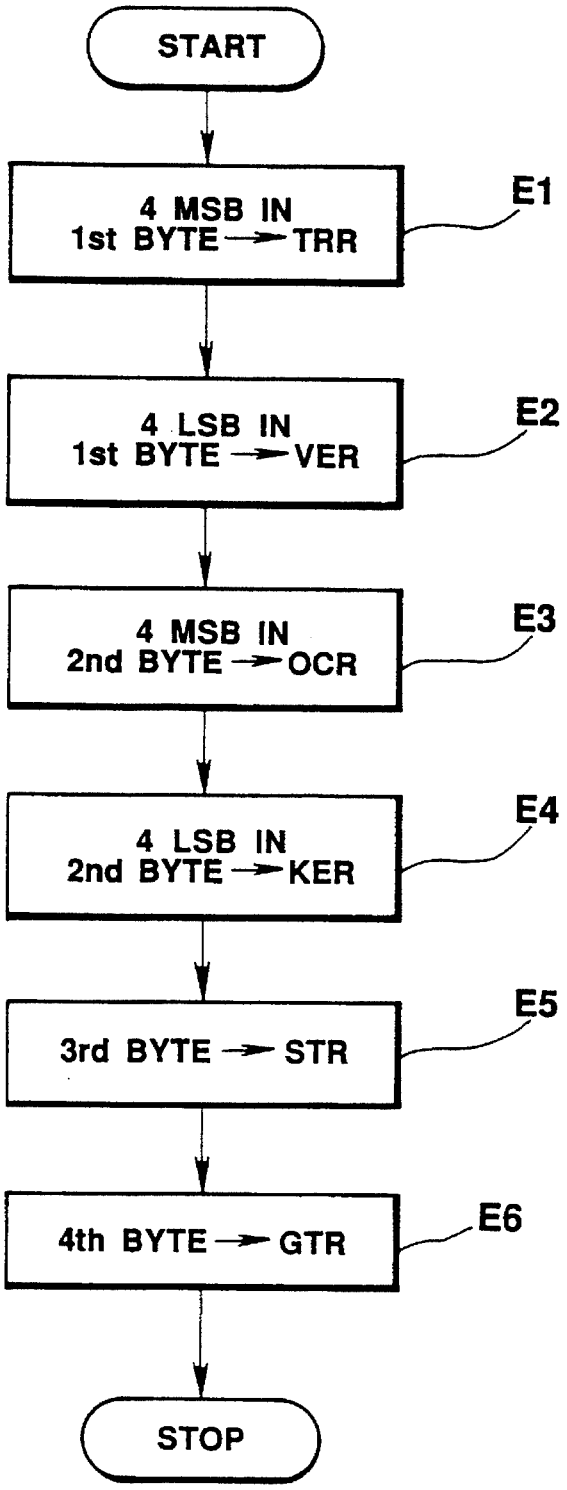
FIG. 10 is a flow chart of a register set process of the embodiment.

At the following step D3 of FIG. 9, the step counter SC is incremented. Then, LGR which is set to FF is searched among LGR 0 to LGR 15, in other words, a musical-tone generating line which is idle is searched among 16 musical-tone generating lines at step D4. Number of LGR searched among LGR 0 to LGR 15 at step D4 is written into the tone-generating line register HLR at step D5, and CPU 1 goes to a tone-generating process at step D6.

Figure 11:
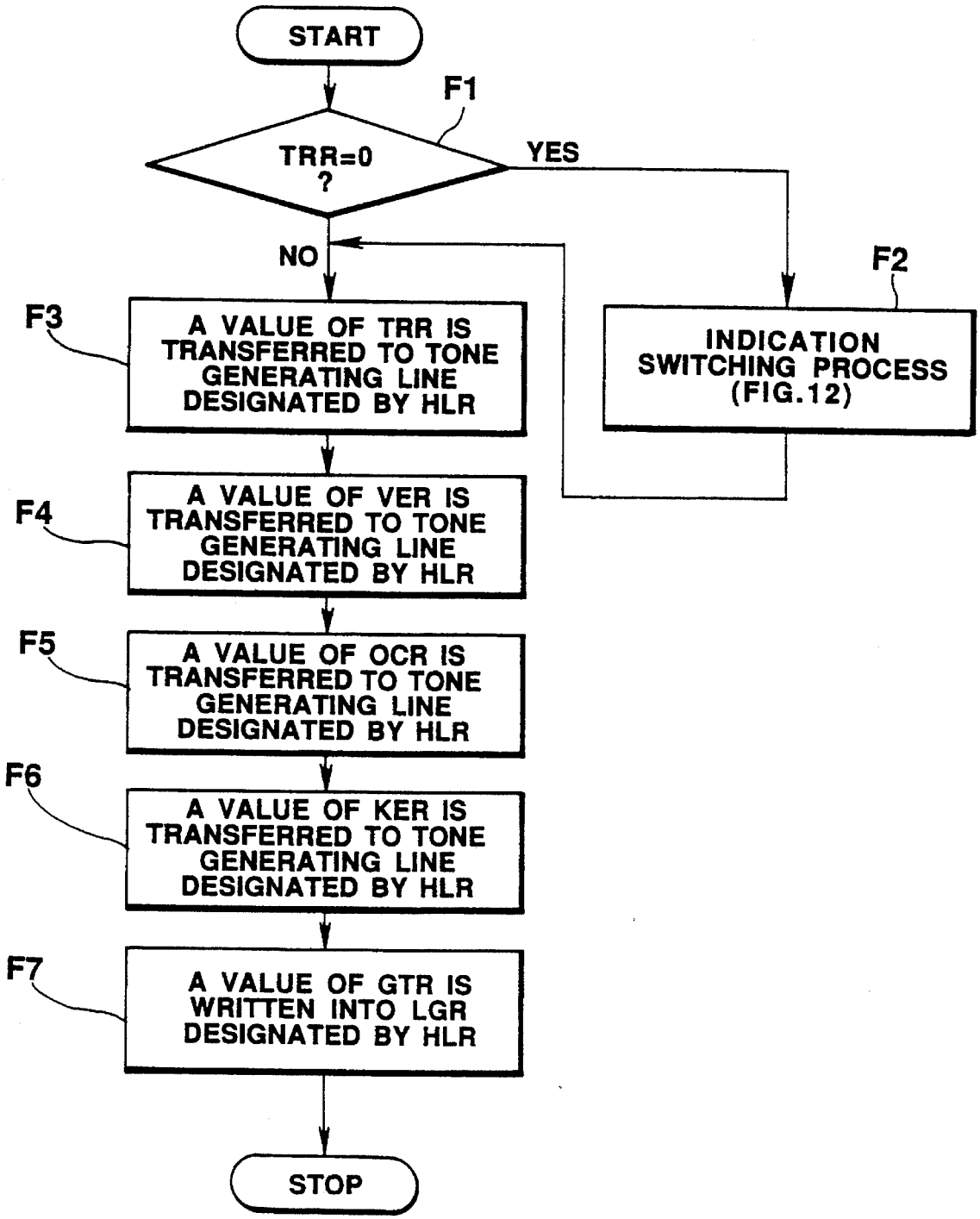
FIG. 11 is a flow chart of a tone generation process of the embodiment.

The tone-generating process will be executed in accordance with the flow chart of FIG. 11. It is judged at step F1 if TRR is "0". As described above, TRR=0 is representative of rhythm note, TRR=1 is representative of base note, TRR=2 is representative of code 1 note, TRR=3 is representative of code 2 note and TRR=4 is representative of code 3 note. If TRR= 0, it is rhythm note. In this case, an indication switching process will be executed at step F2, as will be described later. In the present embodiment, an indication on the LCD unit 5 is switched in response to rhythm data of the automatic performance data. When a result of judgement at step F1 is NO and TRR=0 is not true, a value of TRR is transferred to a tone-generating line designated by HLR, i.e., an idle tone-generating line at step F3 after the indication switching process has been executed at step F2. Further, a value of VER, a value of OCR and a value of KER are sequentially transferred to the idle tone-generating line at steps F4, F5 and F6.

After data have been transferred to the idle tone-generating line as described above, GTR (gate time data) is written, at step F7, into LGR among LGR 0 to LRG 15 corresponding to the idle tone-generating line to which data have been transferred, whereby a sounding operation starts. More specifically, DCO 11, DCW 12 and DCA 13 in the sound source 9 operate in accordance with data transferred at steps F3 to F6, whereby the sound system 18 starts outputting audibly a musical tone of anyone of notes (rhythm note, base note, code 1 note to code 3 note) defined by a value of TRR with tone volume and tone quality defined by velocity data transferred at step F4.

Figure 12:
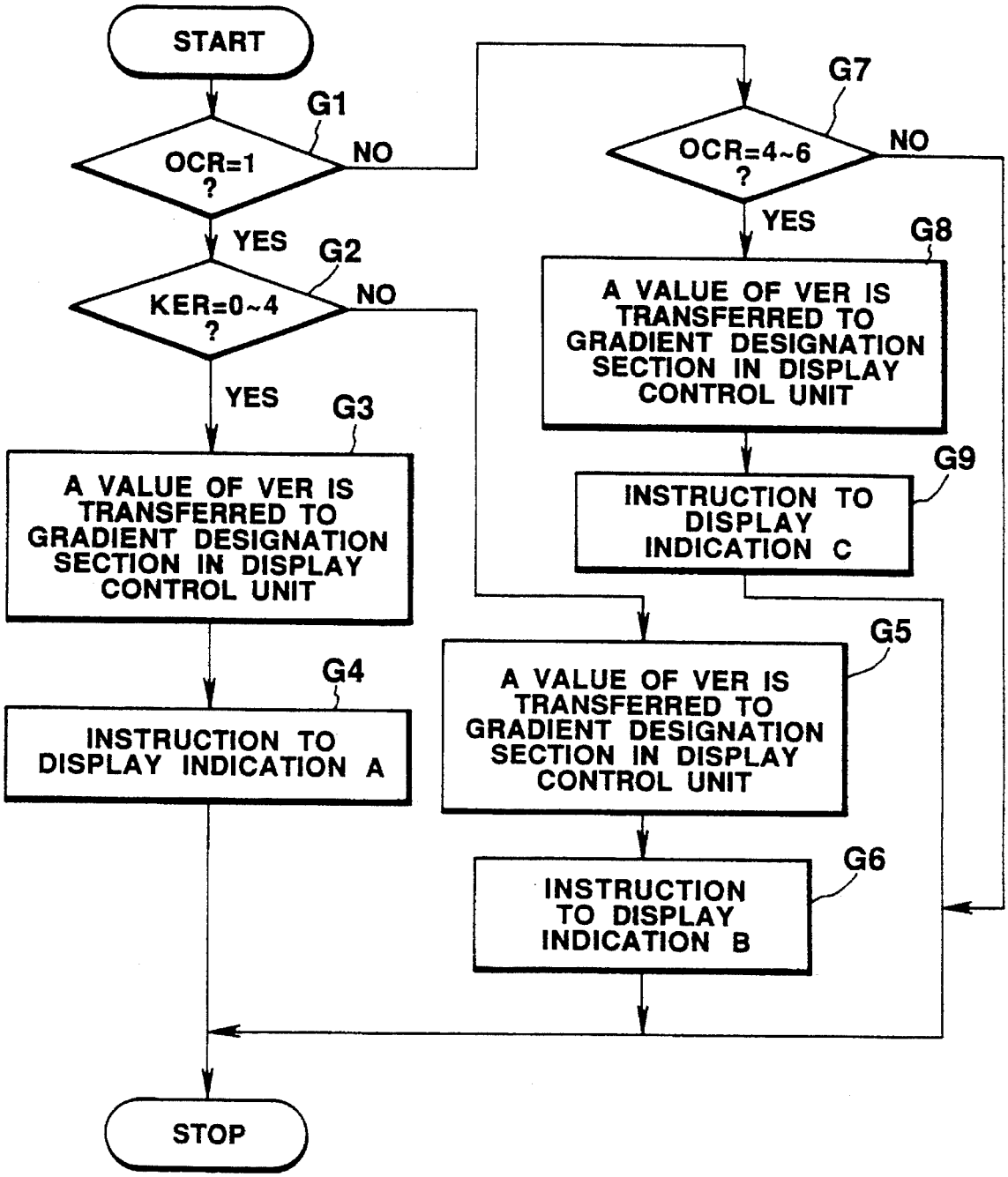
FIG. 12 is a flow chart of an indication switching process of the embodiment.
Figure 13:
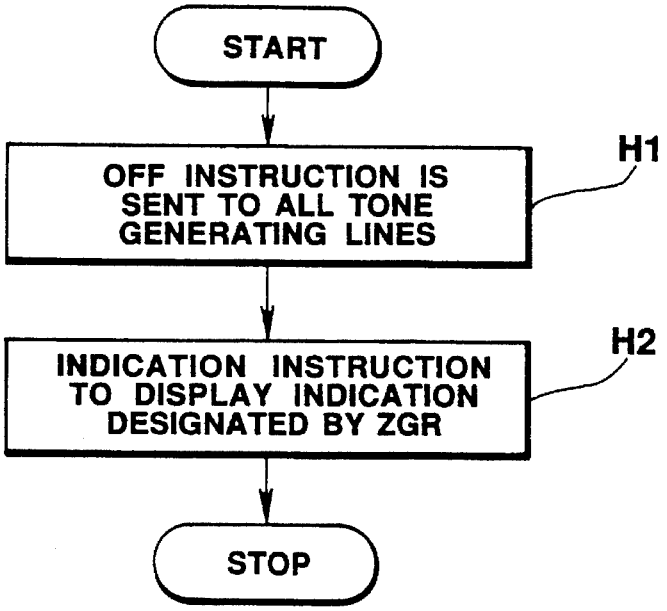
FIG. 13 is a flow chart of a stop process of the embodiment.

The indication switching process will be executed in accordance with the flow chart of FIG. 12. It is judged at step G1 if a value of the octave register OCR is 1. Relationship between values 0 to 6 to be stored in the octave register OCR and octave 1 to octave 7 is illustrated in FIG. 2(*b*). When the result of judgement at step G1 is YES and OCR=1 is true, a tone pitch of the rhythm data falls within 2nd octave. Then, it is judged at step G2 if a key number of the rhythm data in the octave takes either of values of 0 to 4. If the result of judgement at step G2 is YES, the tone pitch of the rhythm data falls within a range from C2 to E2 as shown in FIG. 14 (numerals in parentheses as (10), (14) shown in FIG. 14 represent key numbers of tone pitches respectively when continuous numerals, 0 to 127, are assigned as key numbers to 128 keys of a keyboard respectively).

When the tone pitch of the rhythm data falls within a range of C2 to E2, a value of velocity data stored in the velocity register VER is transferred to a gradient designation section in the display control unit 3 at step G3, and wherein contrast of an indication which is switched by the display control unit 3 to be displayed on the LCD unit 5 is decided. CPU 1 sends at step G4 the display control unit 3 an instruction to display an indication A. Then, the display control unit 3 reads out indication data of the indication A from the display-image memory unit 4, and transfers the data to LCD unit 5. An indication which has been on the LCD unit 5 is switched to the indication A to be displayed with contrast decided based on the value of the velocity data.

Figure 14:
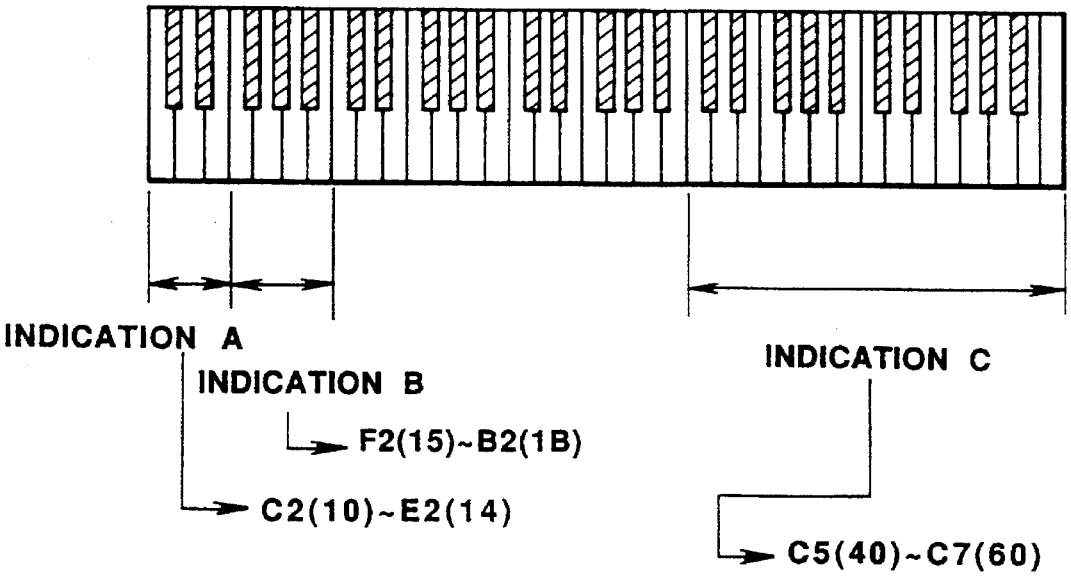
FIG. 14 is a view illustrating relationship between indications A, B and C and tone pitches in the embodiment.

If the result of judgement at step G1 is YES and the result of judgement at step G2 is NO, the tone pitch of the rhythm data falls within a range of F2 to B2 as shown in FIG. 14. Then, a value of velocity data stored in the velocity register VER is transferred to the gradient designation section in the display control unit 3 at step G5, and contrast of an indication which is switched by the display control unit 3 to be displayed on the LCD unit 5 is decided. CPU 1 sends at step G6 the display control unit 3 an instruction to display an indication B. The indication which has been on the LCD unit 5 is switched to the indication B to be displayed with contrast decided based on the value of the velocity data.

Meanwhile, if the result of judgement at step G1 is NO, a tone pitch of the rhythm data is above 2nd octave. Then, CPU 1 goes to step G7, where it judges if the rhythm data falls between 5th octave and 7th octave. If the result of judgement at step G7 is YES, and the tone pitch of the rhythm data falls within a range from C5 to C7 as shown in FIG. 14, a value of velocity data stored in the velocity register VER is transferred to the gradient designation section in the display control unit 3 at step G8, and contrast of an indication which is switched by the display control unit 3 to be displayed on the LCD unit 5 is decided. CPU 1 sends at step G9 the display control unit 3 an instruction to display an indication C. The indication which has been on the LCD unit 5 is switched to the indication C to be displayed with contrast decided based on the value of the velocity data. If the result of judgement at step G7 is NO, OCR takes either of 2 and 3 and the tone pitch of the rhythm data falls between 3rd octave and 4th octave. In this case, an indication on the LCD unit 5 is not switched and the indication process is finished.

The indication switching process of FIG. 12 is executed every read out whole-step-data of the automatic performance data, and the indication on the LCD unit 5 is switched to the indication A when the tone pitch of a musical tone falls within a range of C2 to E2, the indication is switched to the indication B when the tone pitch of a musical tone falls within a range of F2 to B2, the indication remains unchanged when the tone pitch of a musical tone falls within a range of C3 to B4, and the indication is switched to the indication C when the tone pitch of a musical tone falls within a range of C5 to C7, as shown in FIG. 14. As described above, without use of switching data for switching an indication, the present embodiment is capable of displaying a false moving image on the LCD unit 5 by switching the indication from the indication A through indication B to the indication C as the automatic playing operation is performed.

Meanwhile, at step A9 of the main routine flow of FIG. 6, CPU 1 judges if the step time register STR has been set to FF, i.e., if the automatic performance data has reached STEP TIME="11111111" of the final step. If the automatic performance data has not reached the final step, CPU 1 judges at step A10 if the stop switch 22 has been depressed. When both results of judgements performed at steps A9, A10 are NO, CPU 1 repeats the judging process at steps A4 to A10. The judging process is repeatedly executed until STR is set to FF or the stop switch 22 is depressed, whereby the automatic playing operation is continuously performed and the indications A, B and C are selectively displayed in accordance with the tone pitch of the rhythm data. The present embodiment therefore is capable of displaying a false moving image on the LCD unit 5 without need of any switching data which is used to switch indications other than a series of performance data which are necessary for performing the automatic playing operation.

When STEP TIME=FF is read out which indicates that all the automatic performance data have been read out, or when the stop switch 22 is depressed, the result of judgement at steps A9 or A10 will be YES. Then a stop process at step A11 will be executed in accordance with the flow chart of FIG. 13. At step H1 of FIG. 13, CPU 1 sends OFF instruction to all the 16 musical-tone generating lines, whereby all the musical-tone generating lines stop operation for generating a musical tone and the sound system 18 outputs no sound. At step H2, CPU 1 sends a display instruction to display an indication designated by the previous indication register ZGR, whereby an indication, the indication number of which is stored in ZGR at step B2 of FIG. 7, and which is on the LCD unit 5 before the automatic playing operation starts is displayed as a still indication on the LCD unit 5.

Figure 15:
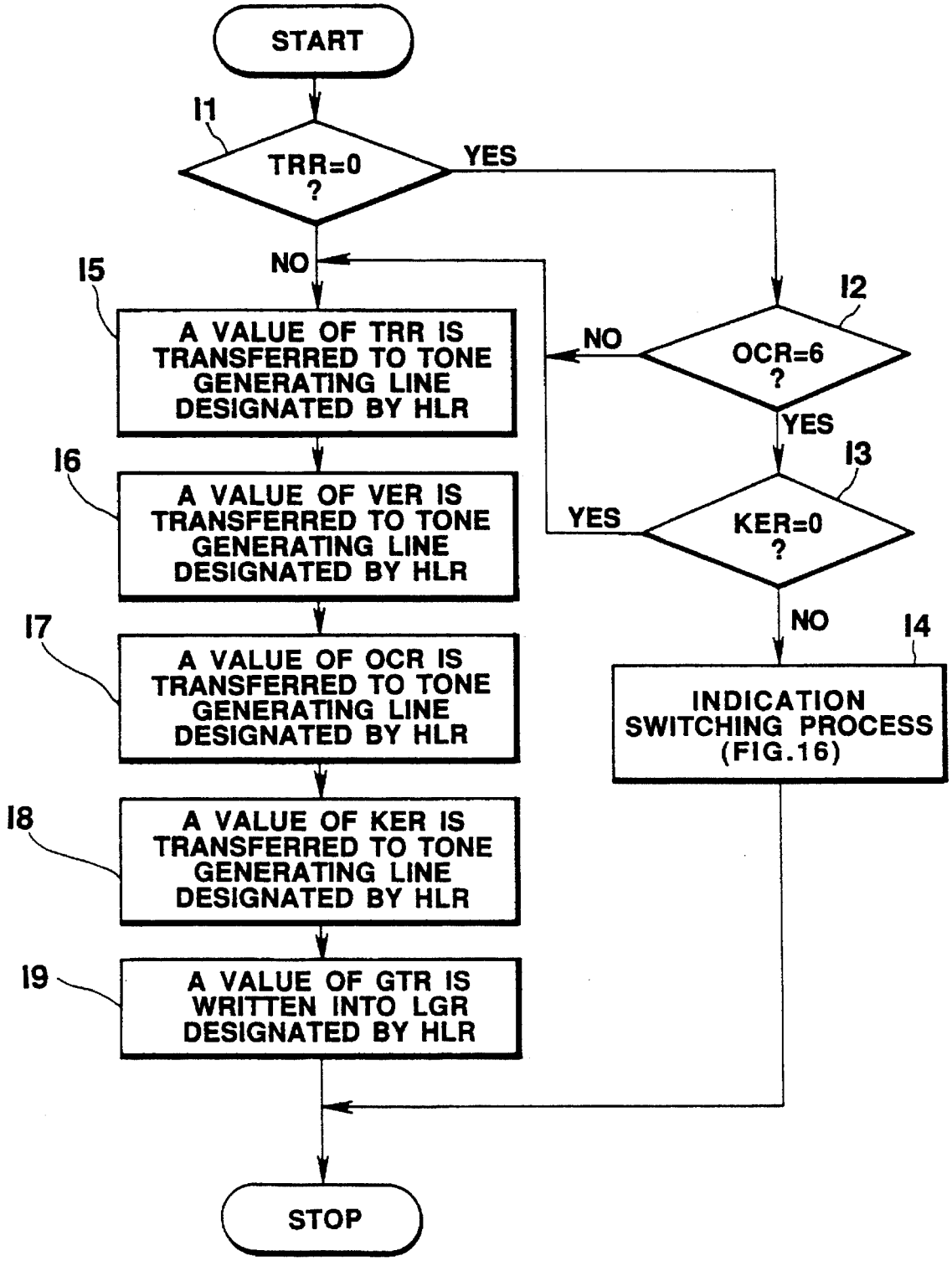
FIG. 15 is a flow chart of a tone generation process of a second embodiment of an electronic musical instrument according to the present invention.
Figure 16:
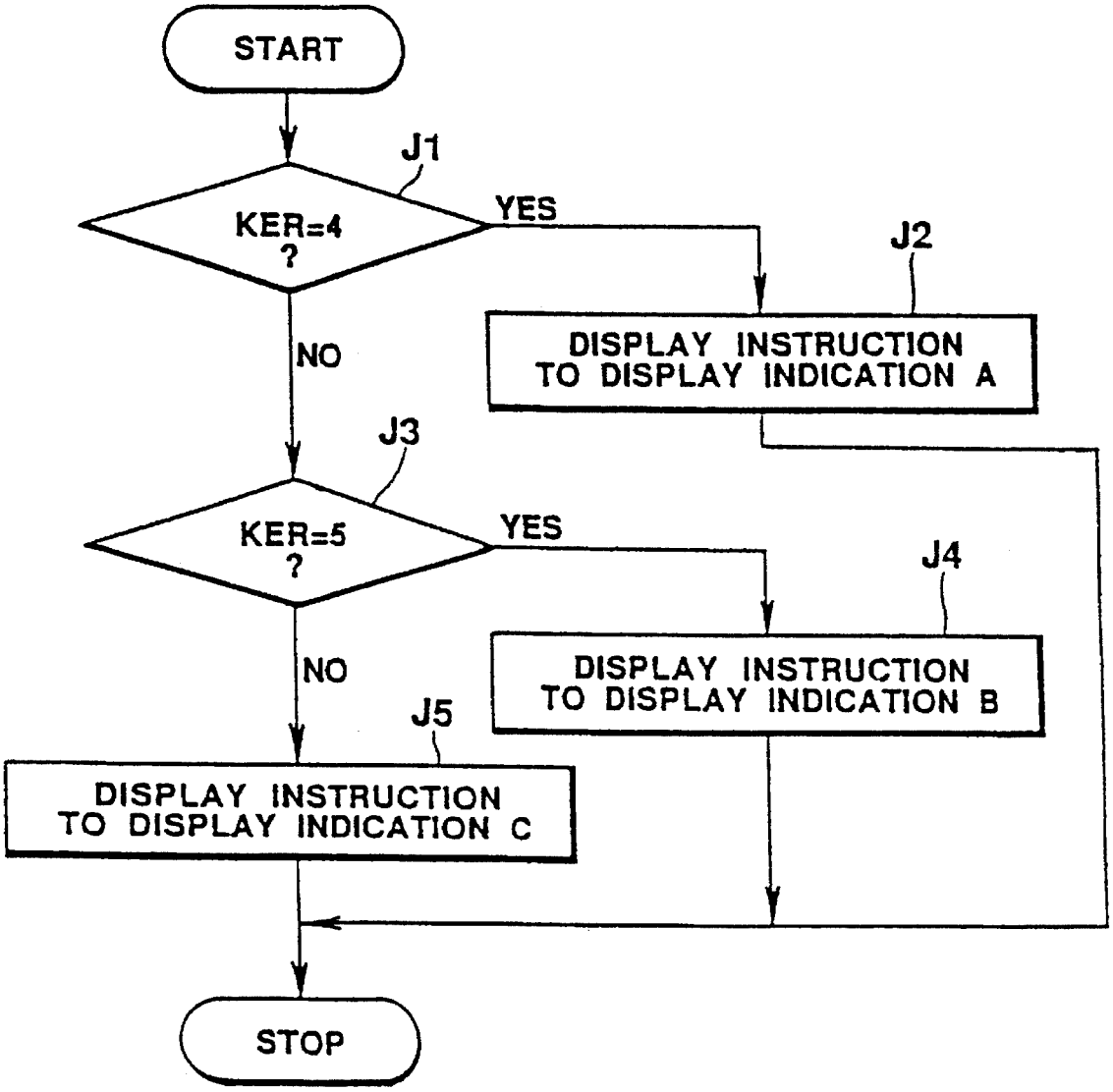
FIG. 16 is a flow chart of an indication switching process of the second embodiment.
Figure 17:
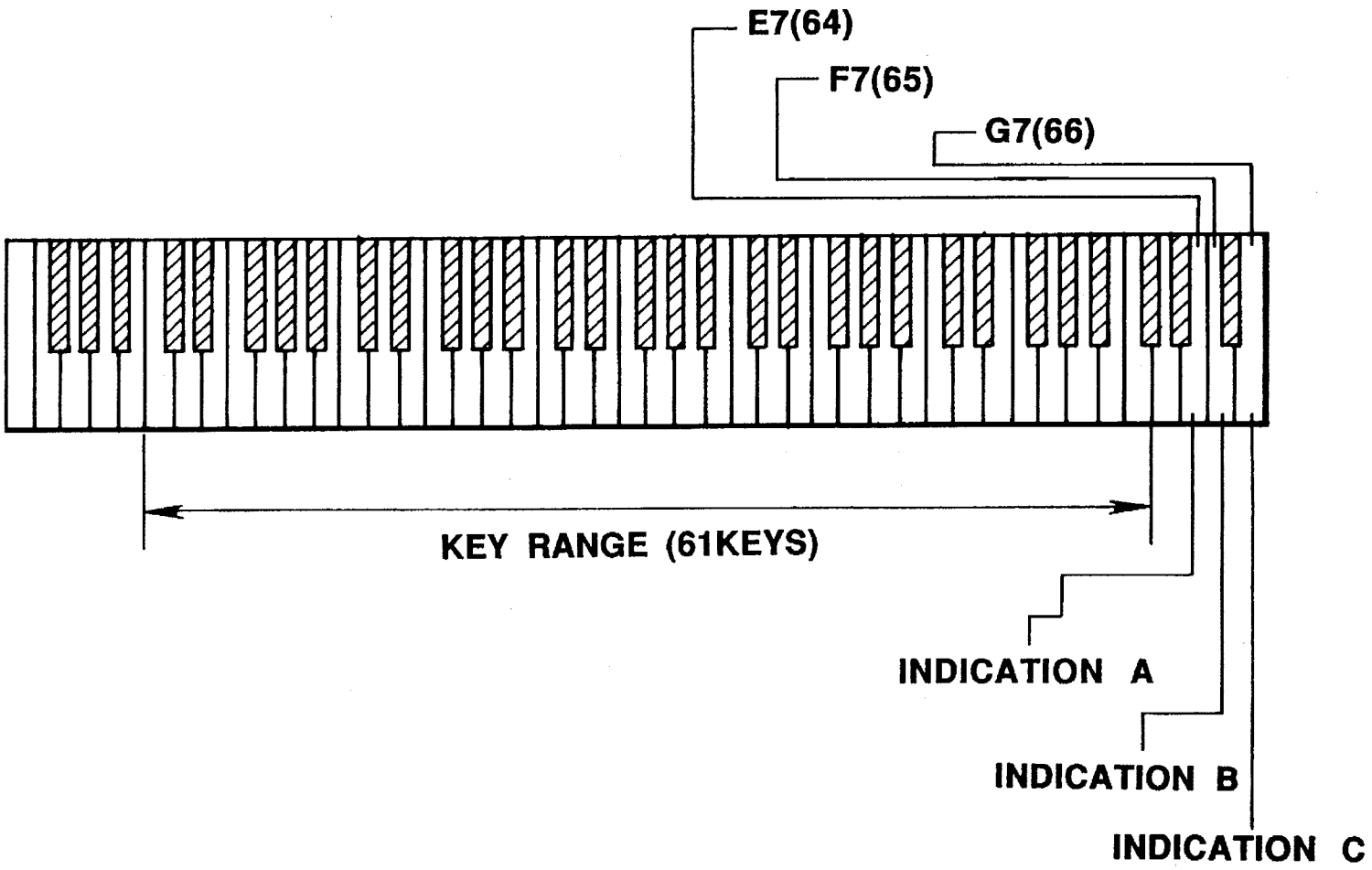
FIG. 17 is a view illustrating relationship between indications A, B and C and tone pitches in the second embodiment.

FIGS. 15 to 17 are views showing the second embodiment of the present invention. A musical-tone generating process and an indication switching process in the second embodiment are different from those of the first embodiment described with reference to FIGS. 11 and 12. FIG. 15 is a flow chart of the tone generating process in the second embodiment. At step I1 of FIG. 15, it is judged if TRR has been set to "0". IF TRR=0 is true, a tone to be generated is a rhythm note. At the following step I2, it is judged if the octave register OCR has been set to "6",i.e., if a tone pitch of the rhythm note falls within 7th octave. When the result of the judgement at step I2 is NO, processes necessary for generating a musical tone will be executed at step I5 and at the following steps while the result of the judgement at step I2 is YES, it is judged at step I3 if KER=0 is true, i.e., if the tone pitch of the rhythm note is C7, i.e.,"C" in 7th octave. If the result of judgement at step I3 is YES, processes necessary for generating a musical tone will be executed at step I5 and at the following steps while the result of the judgement at step I3 is NO, the indication switching process is executed at step I4, as will be described later.

The indication switching process is executed only in a tone-pitch range above D7, and when the indication switching process is executed at step I4, processes at steps I5 to I9 for generating a musical tone will not be executed. In the second embodiment, either of the processes at steps I5 to I9 for generating a musical tone and the indication switching process at step I4 will be executed in accordance with the tone pitch of the read out rhythm data.

When TRR=0 is not true and data other than the rhythm data is to be generated (when the result of the judgement at step I2 is NO) or when rhythm data, tone pitch of which is not higher than C7 is to be generated (when the result of the judgement at step I2 is NO or when the result of the judgement at step I3 is YES), a value of TRR, a value of VER, a value of OCR and a value of KER are transferred to a musical-tone generating line designated by HLR, i.e., to an idle musical-tone generating line at steps I5, I6, I7, I8 and I9.

After data have been transferred to the idle musical-tone generating line as described above, GTR (gate time data) is written, at step I9, into LGR among LGR 0 to LRG 15 corresponding to the idle musical-tone generating line to which data have been transferred, whereby a sounding operation starts. More specifically, DCO 11, DCW 12 and DCA 13 in the sound source 9 operate in accordance with data transferred at steps I5 to I8, whereby the sound system 18 starts outputting audibly a musical tone of anyone of notes (rhythm note, base note, code 1 note to code 3 note) defined by a value of TRR with tone volume and tone quality defined by velocity data transferred at step I5.

The indication switching process at step I4 will be executed in accordance with the flow chart of FIG. 16. At step J1, it is judged if a value stored in the key register KER is 4. If YES, a tone pitch of the rhythm data falls within 7th octave and its key number is 4 or E7 (see FIG. 17). At step J2, CPU 1 sends a display instruction to display the indication A. If NO at step J1, it is judged at step J3 if KER=5 is true. If YES, the tone pitch of the rhythm data falls within 7th octave and its key number is 5 or F7 (see FIG. 17). At step J4, CPU 1 sends a display instruction to display the indication B. If both results of judgements at steps J1 and J2 are NO, the tone pitch of the rhythm data falls within a range of 7th octave and is one other than C7, F7 and G7. Then, CPU 1 sends a display instruction to display the indication C at step J5.

In the second embodiment, a rhythm tone fallen within a tone range (a key range) are allowed to be output, which tone range is defined by 61 keys of not higher positions than C7 as shown in FIG. 17 while rhythm data such as E7, F7 and G7, tone pitches of which are positioned outside the key range, are not audibly output but the indications A, B and C which correspond to these rhythm data respectively are selectively displayed. In other words, in the second embodiment, the rhythm data are not audibly output but tone pitches of the rhythm data are used to decide timings at which the indications A, B and C are switched. Without using additional data for deciding switching timings of indications, the second embodiment can display a false moving indication.

In the above embodiments, the indications A, B and C are switched in association with tone pitches of rhythm data but the indications may be switched in association with values of velocity data which are stored in 16 steps of 0 to 15 as shown in FIG. 2(*a*). In this case, the indication switching process is executed in accordance with a flow chart similar to that of FIG. 12, and it is judged in which range among ranges of 0 to 5, 6 to 10 and 11 to 15 a value of velocity register VER falls. The indications A, B and C may be switched in accordance with the result of the above judgement.

Figure 18:
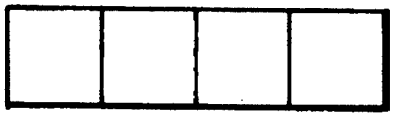
FIG. 18 is a view showing a format of a tone register formed in CPU of FIG. 1 in a third embodiment of an automatic playing apparatus with a display unit according to the invention.
Figure 19:
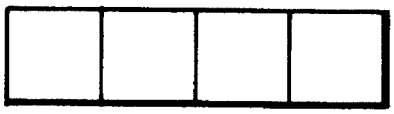
FIG. 19 is a view showing a format of a velocity register formed in CPU of FIG.1 in the third embodiment.
Figure 20:
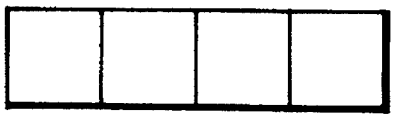
FIG. 20 is a view showing a format of an octave register formed in CPU of FIG. 1 in the third embodiment.
Figure 21:
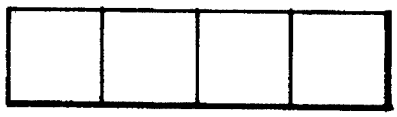
FIG. 21 is a view showing a format of a key register formed in CPU of FIG. 1 in the third embodiment.
Figure 22:
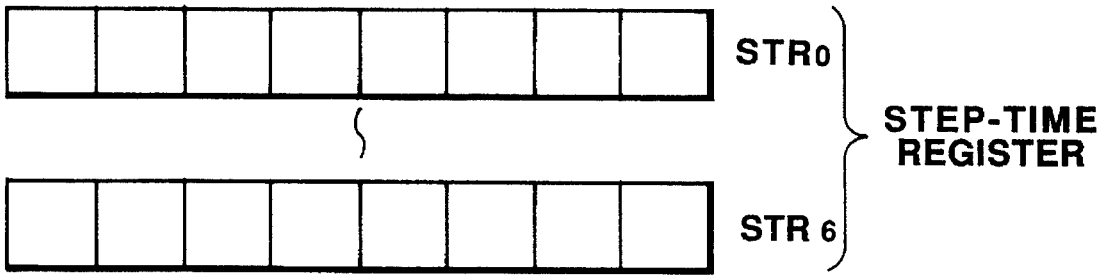
FIG. 22 is a view showing a format of a step time register formed in CPU of FIG. 1 in the third embodiment.
Figure 23:
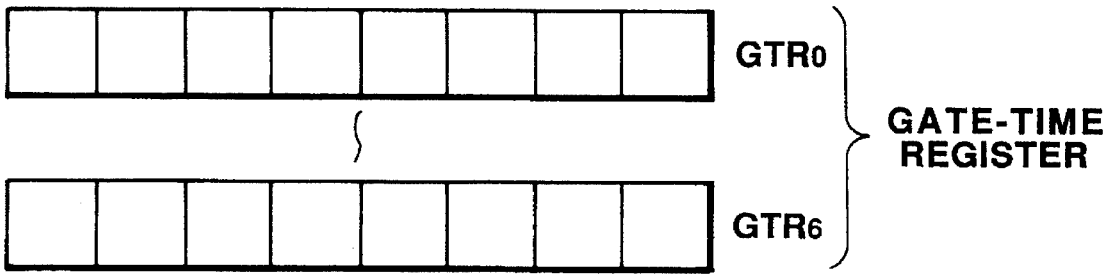
FIG. 23 is a view showing a format of a gate time register formed in CPU of FIG. 1 in the third embodiment.
Figure 24:
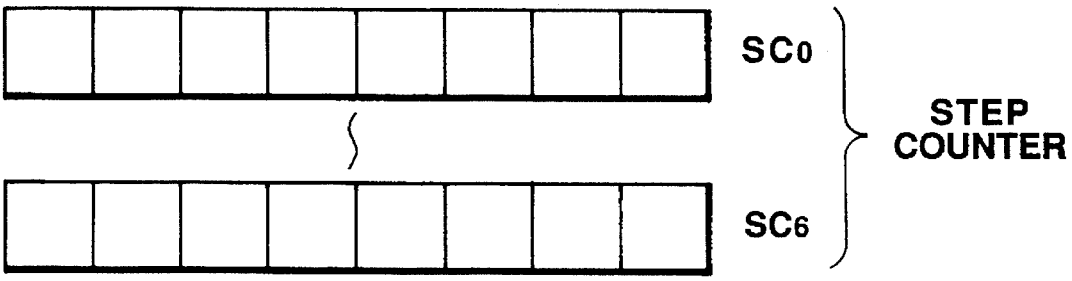
FIG. 24 is a view showing a format of a step counter formed in CPU of FIG. 1 in the third embodiment.
Figure 25:
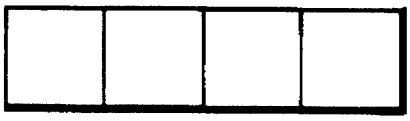
FIG. 25 is a view showing a format of a previous indication register formed in CPU of FIG. 1 in the third embodiment.
Figure 26:
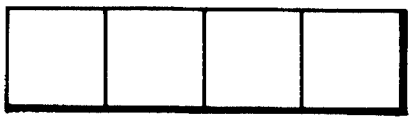
FIG. 26 is a view showing a format of a tone generation line register formed in CPU of FIG. 1 in the third embodiment.
Figure 27:
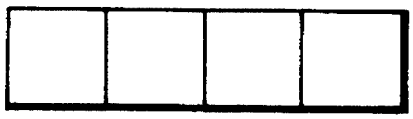
FIG. 27 is a view showing a format of an indication number register formed in CPU of FIG. 1 in the third embodiment.
Figure 28:
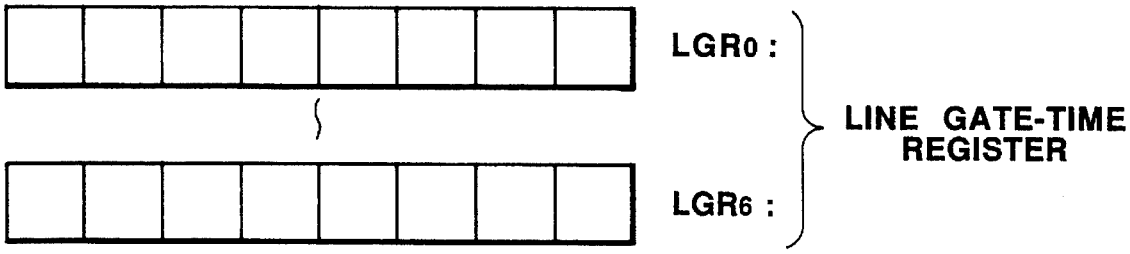
FIG. 28 is a view showing a format of a line gate time register formed in CPU of FIG. 1 in the third embodiment.
Figure 29:
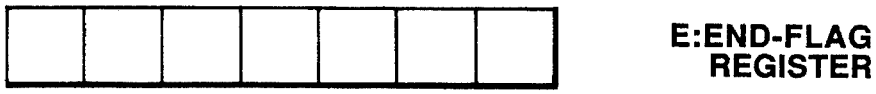
FIG. 29 is a view showing a format of an end flag register formed in CPU of FIG. 1 in the third embodiment.
Figure 30:
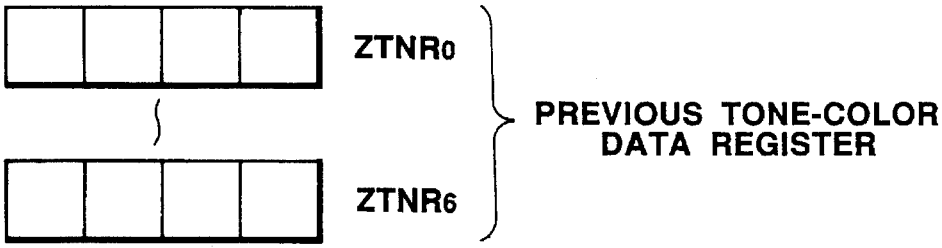
FIG. 30 is a view showing a format of a previous tone-color data register formed in CPU of FIG. 1 in the third embodiment.

FIGS. 18 to 56 are views showing the third embodiment of an automatic playing apparatus with a display unit according to the invention, which apparatus is applied to a musical instrument. As shown in FIGS. 18 to 30, CPU 1 in the third embodiment is provided with a tone-color register TNR (FIG. 18), a velocity register R (FIG. 19), an octave register OCR (FIG. 20), a key register KEY (FIG. 21), step-time registers STR 0 to 6 (FIG. 22), gate-time registers GTR 0 to 6 (FIG. 23), step counters SC 0 to 6 (FIG. 24), a previous-indication register ZGR (FIG. 25), a tone-generating line register n (FIG. 26), an indication-number register G (FIG. 27), line gate-time registers LGR 0 to 6 (FIG. 28), an end-flag register E (FIG. 29) and previous tone-color data registers ZTNR 0 to 6 (FIG. 30), which are used in an indication output process in association with an automatic playing process and performance data as will be described later.

Figure 31:
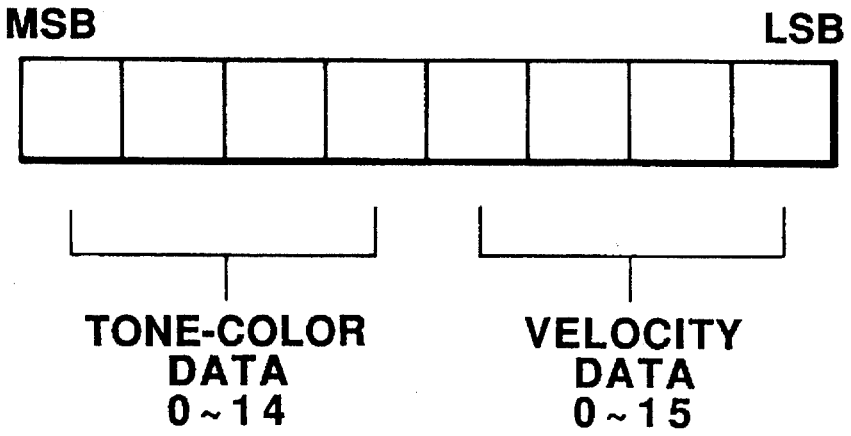
FIG. 31 is a view showing a structure of tone-color data and velocity data as performance data.
Figure 32:
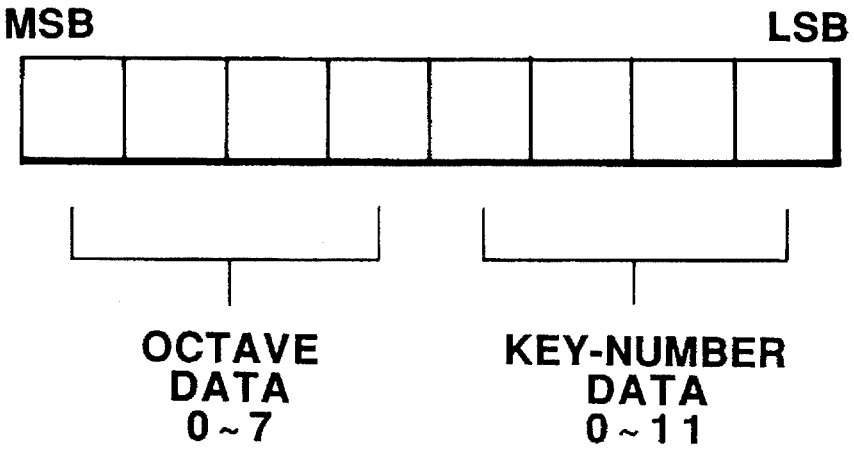
FIG. 32 is a view showing a structure of octave data and key number data as performance data.
Figure 33:
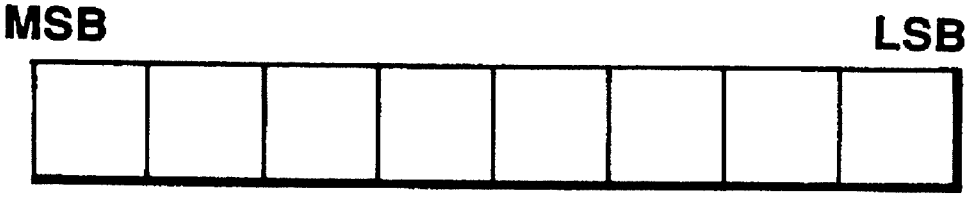
FIG. 33 is a view showing a structure of step-time data as performance data.
Figure 34:
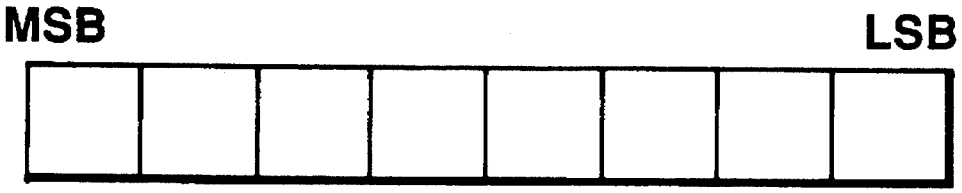
FIG. 34 is a view showing a structure of gate-time data as performance data.

The automatic performance-data memory unit 2 is divided into a plurality of memory areas in the third embodiment. For example, the memory unit 2 is divided into tracks, in each of which tracks performance data of a musical piece to be played are stored. The performance data stored in respective tracks of the memory unit 2 include tone-color data, velocity data, octave data, key-number data, step-time data and gate-time data, as shown in FIGS. 31 to 34. The tone-color data and the velocity data are combined into data of one byte as shown in FIG. 31. Tone-color data of 0 to 14 are stored at 4 more significant bits of the data while velocity data of 0 to 14 are stored at 4 less of significant bits of the data. As shown in FIG. 32, the octave data and the key-number data are combined into data of one byte. Octave data of 0 to 7 are stored at 4 more significant bits while key-number data of 0 to 11 are stored at 4 less significant bits. As shown in FIGS. 33 and 34, the step-time data and gate-time data are one byte data, which can take values of 00 to FE. The automatic performance-data memory unit 2 is not always necessary to be divided into a plurality of memory areas.

In the display-image memory unit 4, there are stored a plurality of indication data. Though there is no limitation in a method for storing the indication data, the display-image memory unit 4 is divided into a plurality of memory areas in the third embodiment. The number of the divided memory areas corresponds to that of tracks into which the automatic performance-data memory unit 2 is divided. Several indication data are stored in respective divided memory areas and a final indication data is stored in a separate memory area.

Now, operation of the third embodiment will be described with reference to the flow charts of FIGS. 35 to 42.

Figure 35:
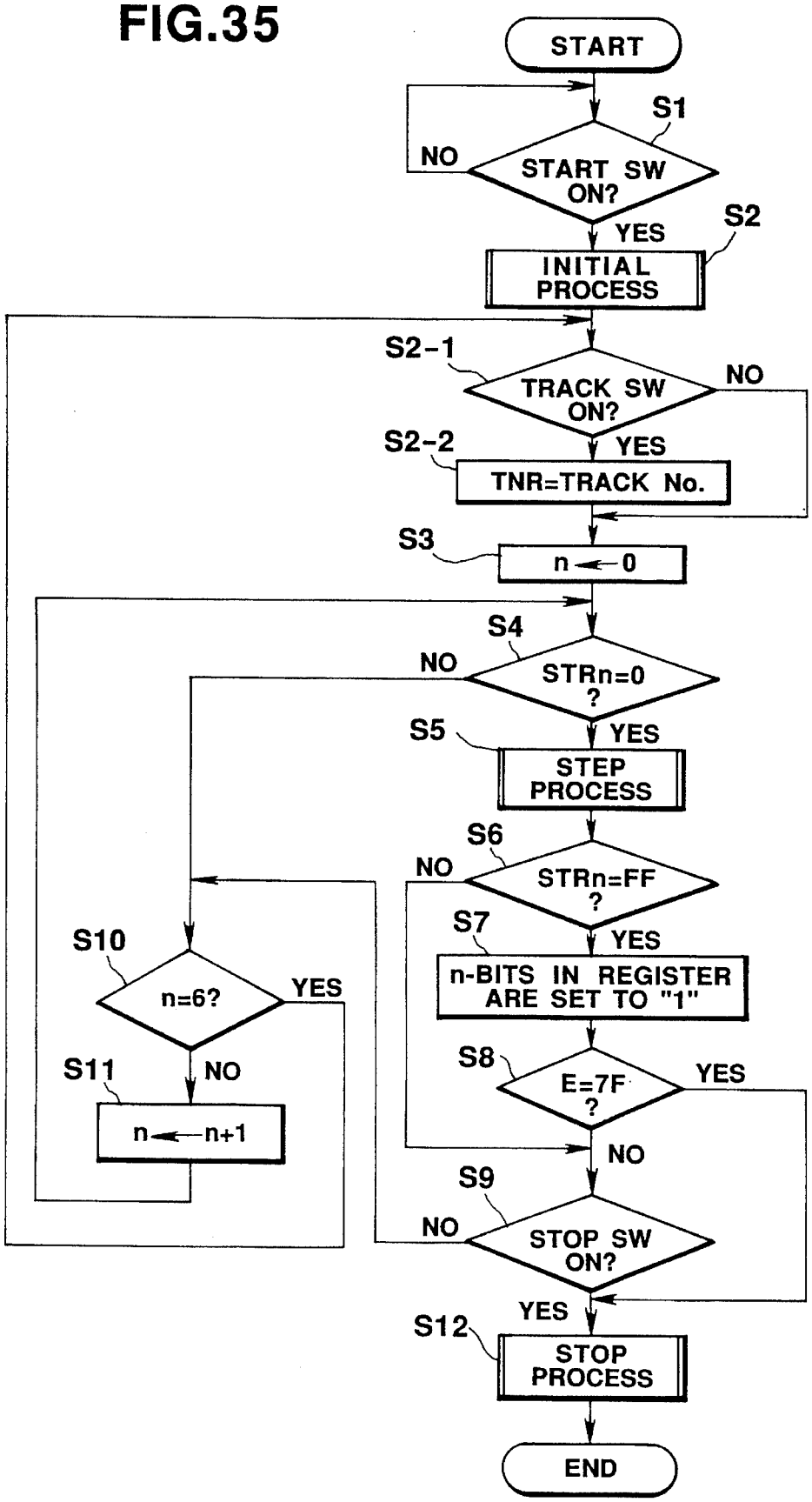
FIG. 35 is a flow chart of a main process of CPU of FIG. 1.

FIG. 35 is a flow chart of the main routine process of CPU 1. When the power of the third embodiment is turned on and the start switch 21 is depressed at step S1, CPU 1 effects an initial process at step S2.

In the initial process, CPU 1 sets an initial value to the step counters SC 0 to SC 6 which designate addresses of respective tracks in the automatic performance-data memory unit 2 to designate the initial performance data.

Figure 36:
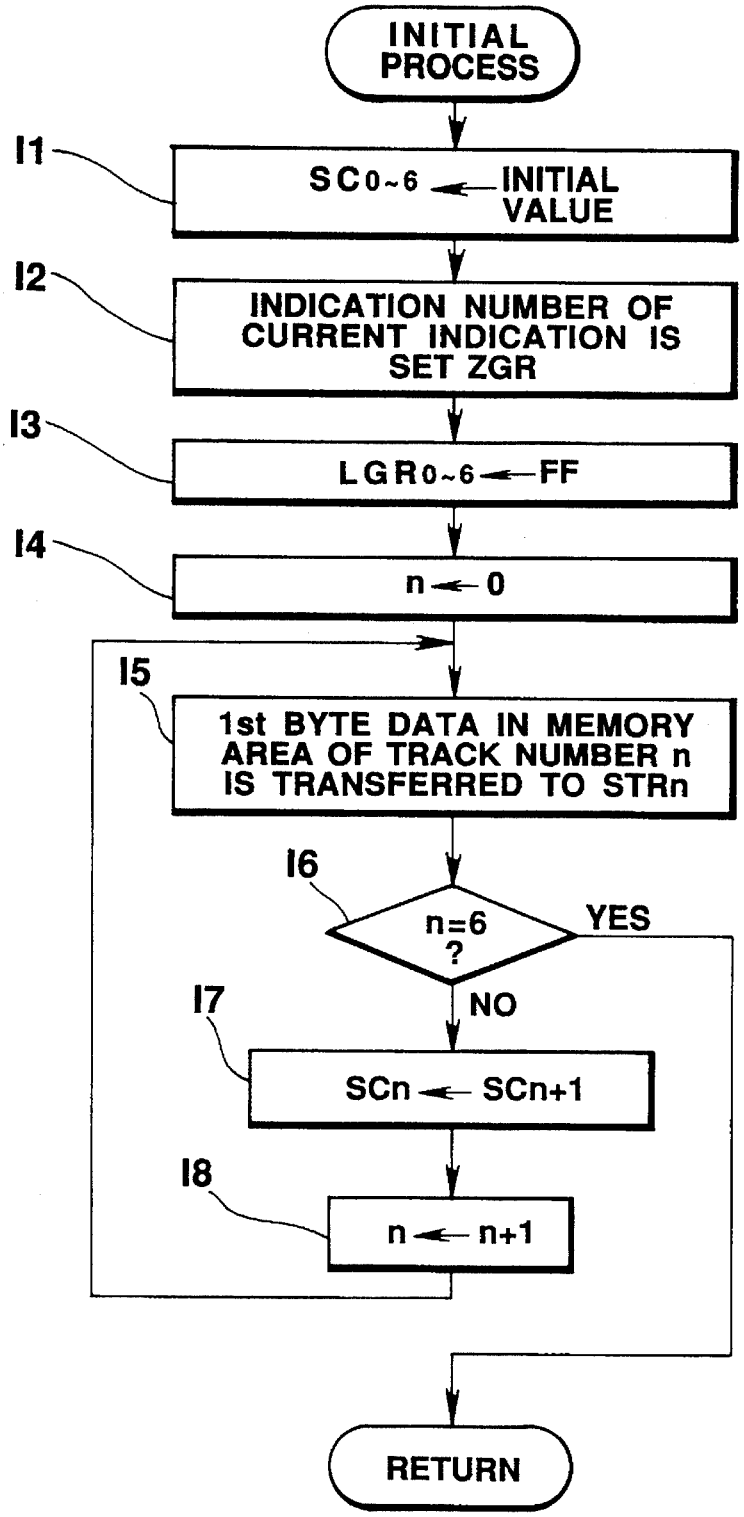
FIG. 36 is a flow chart of a detailed initial process of FIG. 35.

More specifically, in the initial process of FIG. 36, the initial value is set to the step counters SC 0 to SC 6 and performance data for respective channels are initialized to execute a preparing process for performance at step I1. An indication number of a current indication is transferred and set to the previous-indication register ZGR, i.e., an indication number of an indication which is displayed on the LCD unit 5 when the start switch is turned on is transferred and set to the previous-indication register ZGR at step I2. At step I3, a value FF, which is a maximum value that can be set to the line-gate time registers LGR 0 to LGR 6, is set to these registers, making them idle not to generate sounds. At step I4, a value of "0" is set to the tone-generating line n to which data representing one out of 7 tone-generating channels is set. The first byte data stored in a memory area of track number n in the automatic performance-data memory area 2, i.e., data of step time on the first channel, is transferred to the step-time register STR n at step I5. It is judged at step I6 if the track number n has reached "6", i.e., if processes have been finished for tracks of all the channels. When the track number n has not reached "6", CPU 1 judges that processes for all channels have not been finished. Then, CPU 1 increments the step counter SC n and tone-generating line register n by "1" at steps I7 and I8, and then returns to step I5. CPU 1 executes process at steps I5, I6, I7 and I8 until the track number n reaches "6". When the track number n has reached "6", the initial process is finished.

When the initial process is finished, CPU 1 returns to the main routine process of FIG. 35, and judges at step S2-1 if a track switch has been turned on. When the track switch has been turned on, the track number is written into the register TRN at step S2-2. Then, the tone-generating line register n is set to "0" at step S3 and it is judged at step S4 if the step-time register STR n is set to "0", i.e., it is judged if a channel switching process should be executed. When the step-time register STR n is "0", a step process is executed at step S5.

Figure 37:
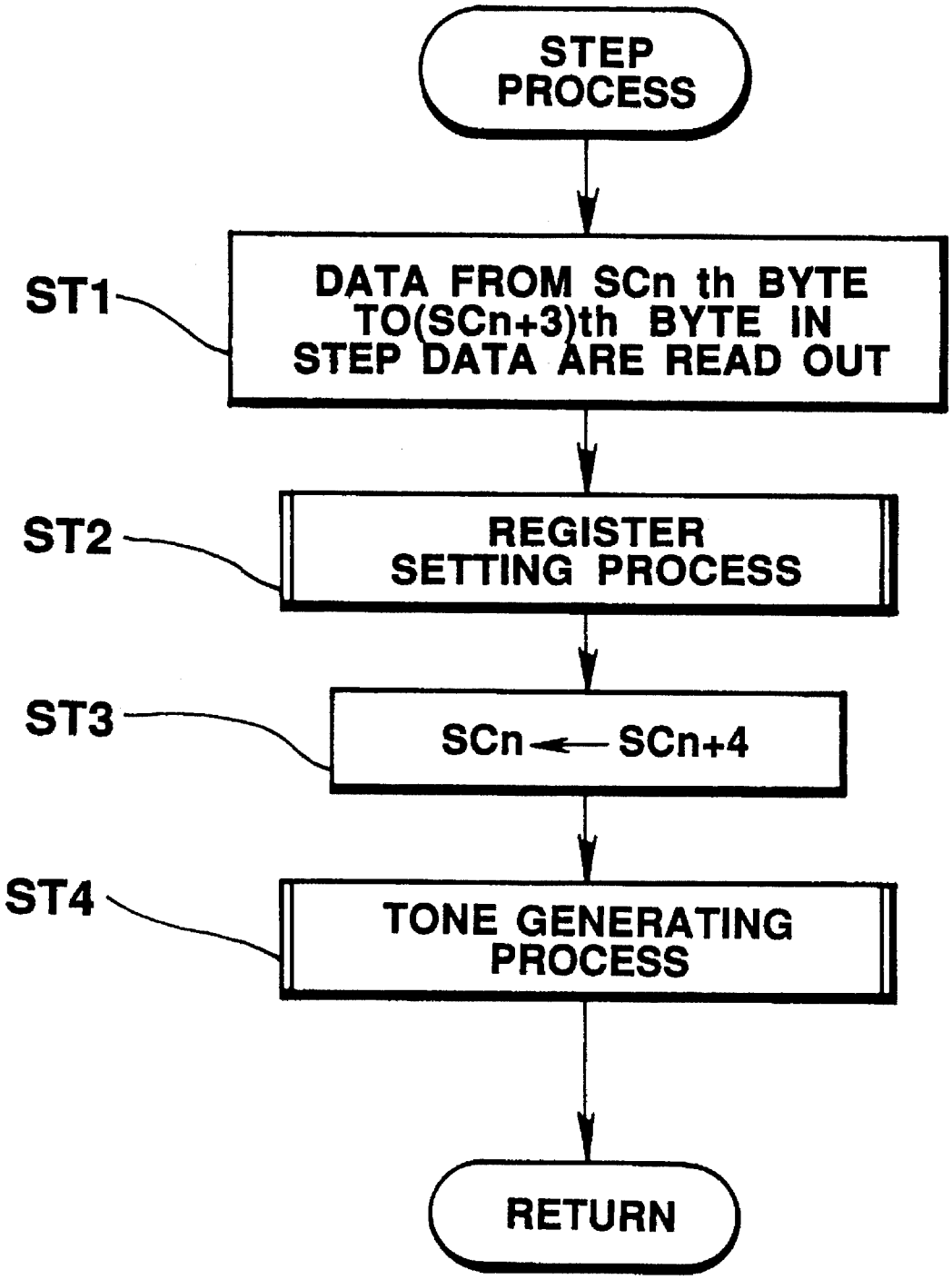
FIG. 37 is a flow chart of a detailed step process of FIG. 35.

In the step process shown in FIG. 37, data from (SCn)th byte to (SC+3)th byte of the step data are read out at step ST1, i.e., performance data shown in FIGS. 16 to 19 are read out at step ST1 and these read out performance data are set to relevant registers at step ST2.

When the register setting process has been finished at step ST2, CPU 1 adds "4" to the step-counter SCn and advances a pointer of the step data by "4", preparing for the following step process at step ST3. When the process for the step counter SCn has been finished, CPU 1 executes a tone generating process at step ST4, finishing the step process.

Figure 38:
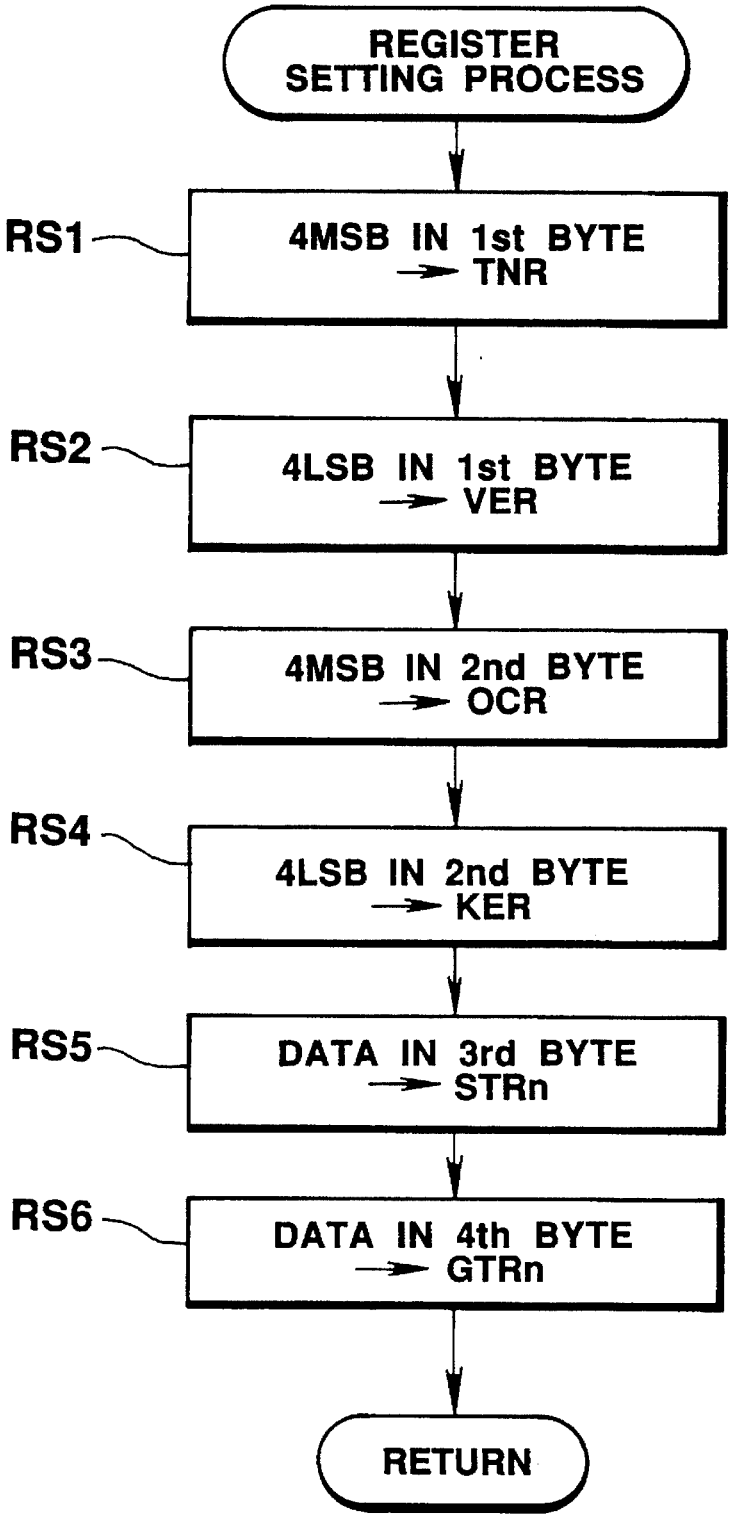
FIG. 38 is a flow chart of a detailed register set process of FIG. 37.

The register setting process in the step process will be executed in accordance with the flow chart of FIG. 38. Data of 4 more significant bits in the first byte, i.e., tone-color data (see FIG. 31) are transferred to the tone-color register TNR at step RS1 while data of 4 less significant bits in the first byte, i.e., velocity data (see FIG. 31) are transferred to the velocity register VER at step RS2. Data of 4 more significant bits in the second byte, i.e., octave data (see FIG. 32) are transferred to the octave register OCR at step RS3 while data of 4 less significant bits in the second byte, i.e., key-number data (see FIG. 32) are transferred to the key register KER at step RS4. Data in the third byte, i.e., step-time data (see FIG. 33) are transferred to the step-time register STR n of the relevant channel at step RS5 while data in the fourth byte, i.e., gate-time data (see FIG. 34) are transferred to the gate-time register GTR n of the relevant channel at step RS6. Now, the register setting process is finished and performance data necessary for tone-generating process to be executed at step ST4 are set the respective registers.

Figure 39:
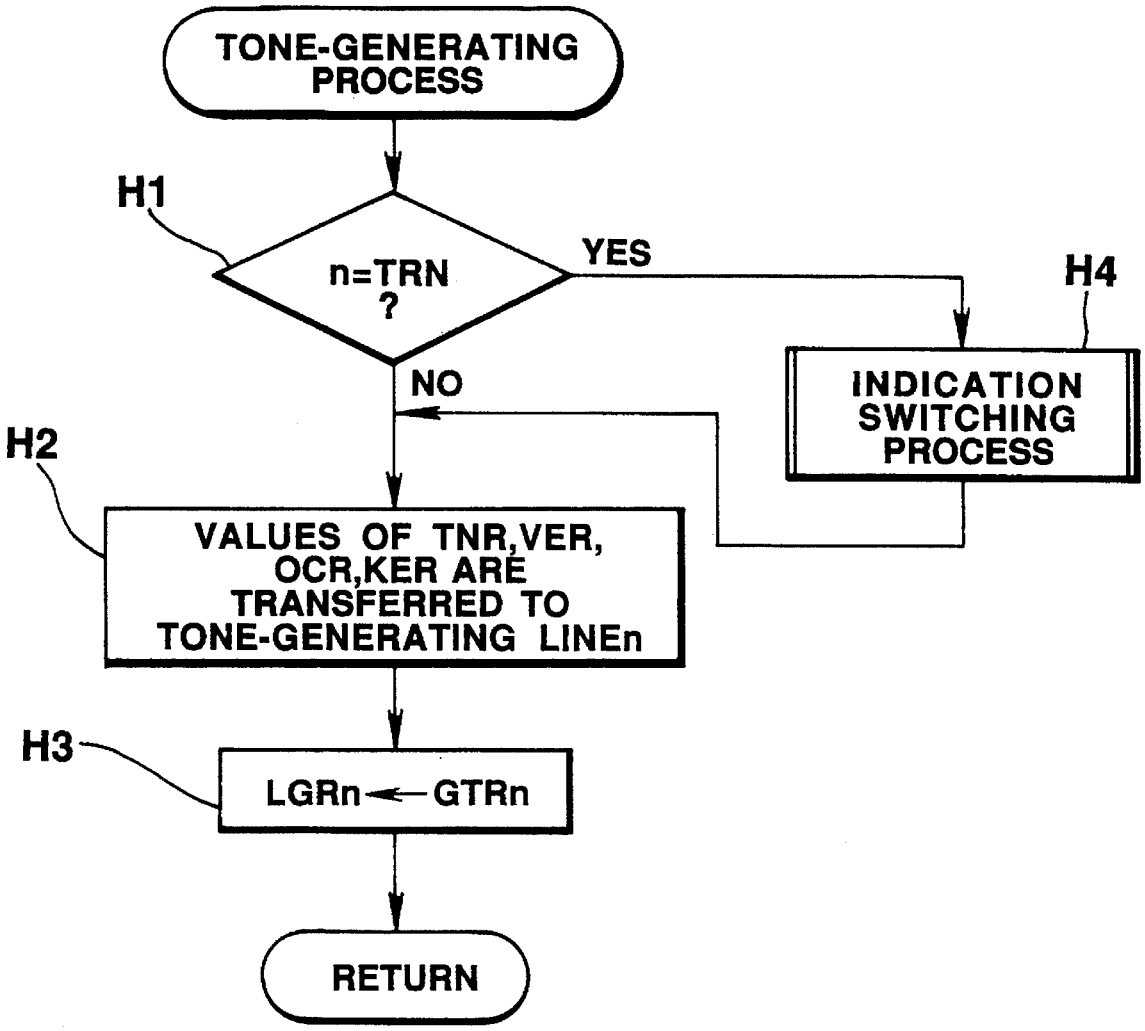
FIG. 39 is a flow chart of a detailed tone-generation process of FIG. 37.

The tone-generating process in the above step process will be executed in accordance with the flow chart of FIG. 39. It is judges at step H1 if a value of the tone-generating line register n coincides with a track number set in the register TRN, i.e., if a tone generating line is an indication switching line. When the value of the tone-generating line register n does not coincide with the track number set in the register TRN, CPU 1 judges that the tone generating line is not an indication switching line, and transfers at step H2 a value of the tone-color register TNR, a value of the velocity register VER, a value of the octave register OCR and a value of the key register to the relevant tone-generating line register n. The performance data transferred to the tone-generating line register n are further transferred to the sound source 9, and a musical tone waveform is produced by the sound source 9 and output through the sound system 18. In this case, the tone-color data is not sent directly to the sound source 9. CPU 1 reads out tone-color parameter from the tone-color parameter memory unit 6 on the basis of the tone-color data, and transfers the read out tone-color parameter to the sound source 9. CPU 1 transfers and sets a value of the gate-time register GTR n to the line-gate time register LGR n at step H3.

Meanwhile, when it is judged at step H1 that the value of the tone-generating line register n coincides with the value of the register TRN, CPU 1 judges that the tone-generating line is the indication switching line, and executes an indication switching process at step H4.

Figure 40:
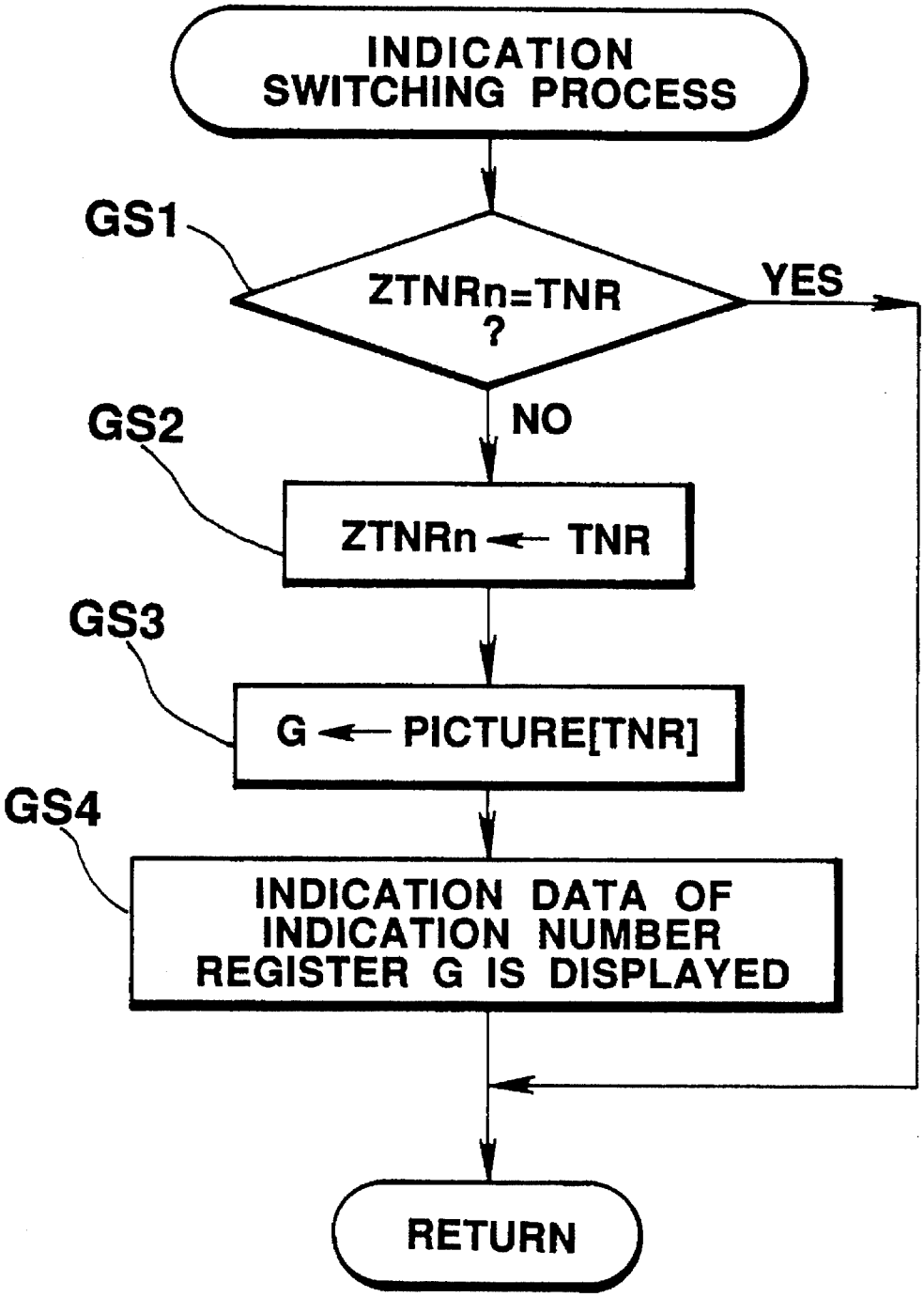
FIG. 40 is a flow chart of a detailed indication switching process of FIG. 39.

The indication switching process will be executed in accordance with the flow chart of FIG. 40. It is judged at step GS1 if a value of a current tone-color register TNR coincides with a value of the previous tone-color data register ZTNRn of the tone-generating line (channel), i.e., if tone-color data of the current tone-generating line is the same as the previous tone-color data. If the result of judgment at step GS1 is YES, CPU 1 judges that the tone-color data of the current tone-generating line is the same as the previous tone-color data, and does not execute any process, finishing the indication switching process. If the result of judgment at step GS1 is NO, CPU 1 judges that the tone-color data of the current tone-generating line has been changed from the previous tone-color data, and sets the value of the current tone-color register TNR to the previous tone-color data register ZTNR 0 of the current tone-generating line at step GS2. Then, CPU 1 converts data of the tone-color register TNR into indication-reading out data, and sets the same to the indication number register G at step GS3. CPU 1 reads out indication data corresponding to the value of the indication number register G from the display-image memory unit 4, and supplies the indication data to the LCD unit 5 for display at step GS4, finishing the indication switching process.

When the indication switching process has been finished, CPU 1 returns to the tone-generating process of FIG. 39. CPU 1 transfers and sets a value of the tone-color register TNR, a value of the velocity register VER, a value of the octave register OCR and a value of the key register KER to the tone-generating line register n at step H2, and further transfers and sets a value of the gate-time register GTRn to the line-gate time register LGRn at step H3.

When the tone-generating process has been finished, CPU 1 returns to the step process of FIG. 37, again, finishing the step process.

When the step process has been finished, CPU 1 returns to the main routine process of FIG. 35, again. CPU 1 judges at step S6 if the line gate-time register LGRn has been set to "FF". The value of the line gate-time register LGRn is subtracted during the main routine process every Jump to timer interrupt services which are caused at certain intervals in accordance with a predetermined clock signal output from the timer clock again generator CK of FIG. 1.

Figure 41:
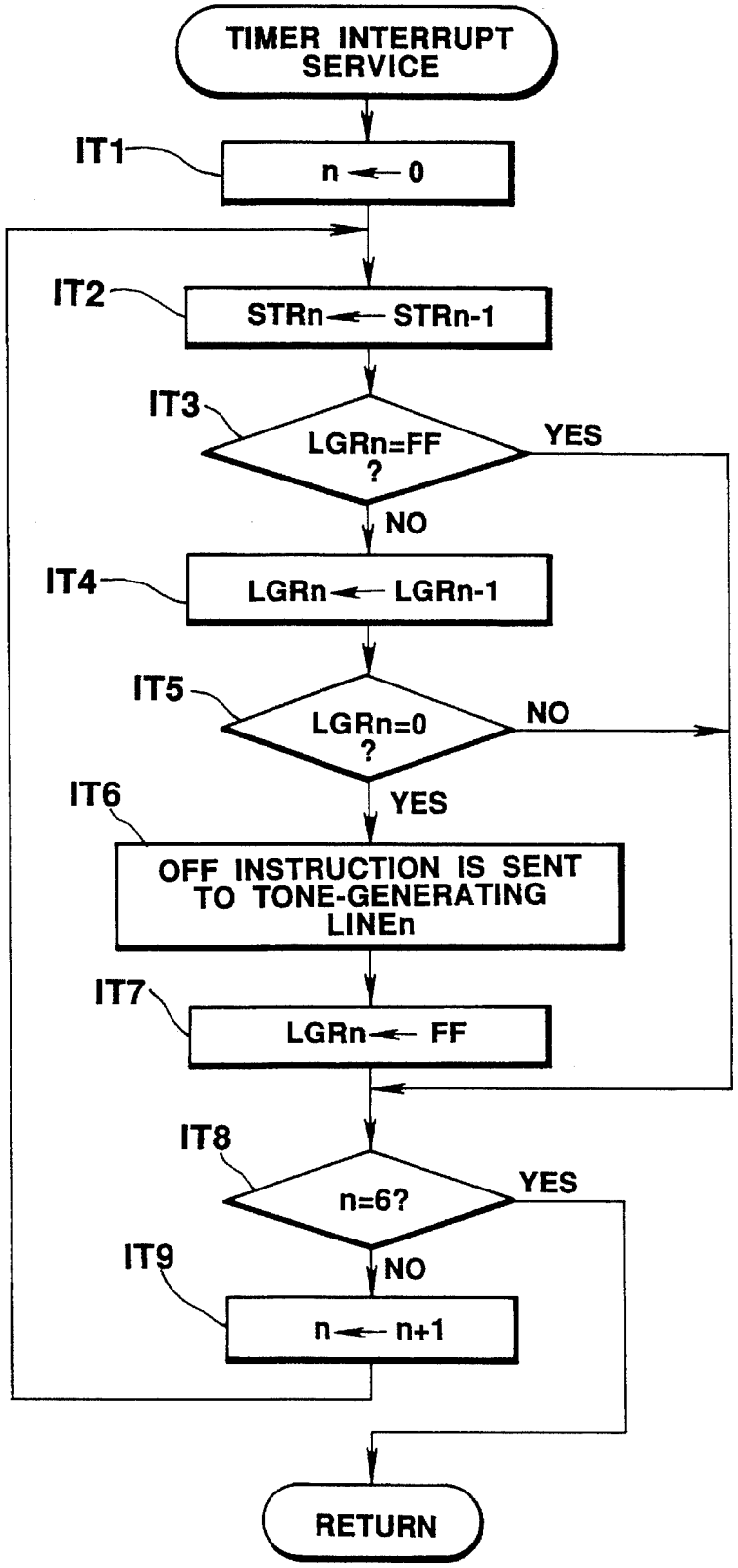
FIG. 41 is a flow chart of a timer interrupt process executed during the main process of FIG. 35.

When the timer interrupt is called, CPU 1 effects the timer interrupt service in accordance with the flow chart of FIG. 41. At step IT1, a value "0" is set to the tone-generating line register n, and a value of the step-time register STRn is decremented by "1" at step IT2. It is judged at step IT3 if a value of the line gate-time register LGRn is "FF", i.e., if tone-generation stop data has been set to the line gate-time register LGRn. When the value of the line gate-time register LGRn is not "FF", i.e., when the current line is generating a tone, the line gate-time register LGRn is decremented by "1" at step IT4, and it is judged at step IT5 if the line gate-time register LGRn has reached "0", i.e., if a gate time has passed. When the line gate-time register LGRn has reached "0", i.e., a tone generating time has passed, CPU 1 sends an OFF instruction to the current tone-generation line n at step IT6 to make the current line stop generating a tone. At step IT7, CPU 1 set data "FF" to the line gate-time register LGRn, which data "FF" represents that a tone generating operation has been finished.

It is judged at step IT8 if a value "6" has been set to the tone-generating line register n, i.e., if processes for all the tone-generating line have been finished. When a value "6" has been set to the tone-generating line register n, the value of the tone-generating line register n is incremented by "1", and CPU 1 returns to step IT2. Thereafter, CPU 1 executes the same process. When it is judged at step IT3 that the line gate-time register LGRn has reached "FF", i.e., when it is judged the line gate-time register LGRn is not generating a tone and the tone generating process has been finished, CPU 1 jumps to process at step IT8. When it is judged at step IT4 that a value of the line gate-time register LGRn is not "0", CPU 1 judges that the tone-generating time has not passed, and goes to step IT8. When the tone-generating line register n has reached to a value "6" at step IT8, CPU 1 judges that the timer interrupt service for all the tone generating-line has been finished.

As described above, when a timer interrupt service is executed at a given intervals, a value of the step-time register STRn is subtracted. It is judged at step S6 of the main routine process of FIG. 35 if the value of the step-time register STRn has reached "FF". When it is judged at step S6 that the value of the step-time register STRn has not reached "FF", i.e., it is judged that performance data of a tune as being played has not reached the final data, CPU 1 goes to step S9, and judges that the stop switch 22 has been turned on. When the stop switch 22 has not been turned on, CPU 1 goes to step S10, and judges if the tone-generating line register n has reached a value "6", i.e., if the main routine process has been finished for all the tone-generating lines (channels). When the tone-generating line register n has not reached a value "6", CPU 1 increments the value of the tone-generating line register n by "1", and returns to step S4.

When it is judged that the step-time register STRn has not reached a value "0", CPU 1 does not execute the step process, and goes to step S10 to judge if the tone-generating line register n has reached a value "6". When the tone-generating line register n has reached a value "6", CPU 1 increments the value of the tone-generating line register n by "1", and returns to step S4.

When the tone-generating line register n has reached a value "6" at step S10, CPU 1 returns to step S3, and resets the tone-generating line register n at step S3 to execute performance operation of the current track from the very first.

When the step-time register STRn has reached a value "FF" at step S6, CPU 1 judges that automatic performance finishing data has been output, CPU 1 sets a value "1" to n-th bit corresponding to the tone-generating line in the end flag register E at step S8. It is judged at step S8 if the end flag register E has reached 7F, i.e., if all the bits corresponding to all the channels has been set to a value "1". When the end flag register E has not reached 7F, CPU 1 judges that any of the tone-generating lines is generating a tone, i.e., that a playing operation of a turn to be played is not finished, and judges at step S9 if the stop switch 22 has been turned on. When the stop switch 22 has not been turned on, CPU 1 goes to steps 10 and repeatedly executes similar processes.

When the value of the end-flag register E reaches "7F", the finishing data is sent to all the tone-generating lines. Then, CPU 1 judges that the automatic playing operation of the tune has finished, and executes a stop process at step S12. The stop process is also executed when the stop switch 22 is switched on at step S9. When the stop process is executed, the automatic playing operation and the indication switching process for switching the indication associated with the performance data are finished.

Figure 42:
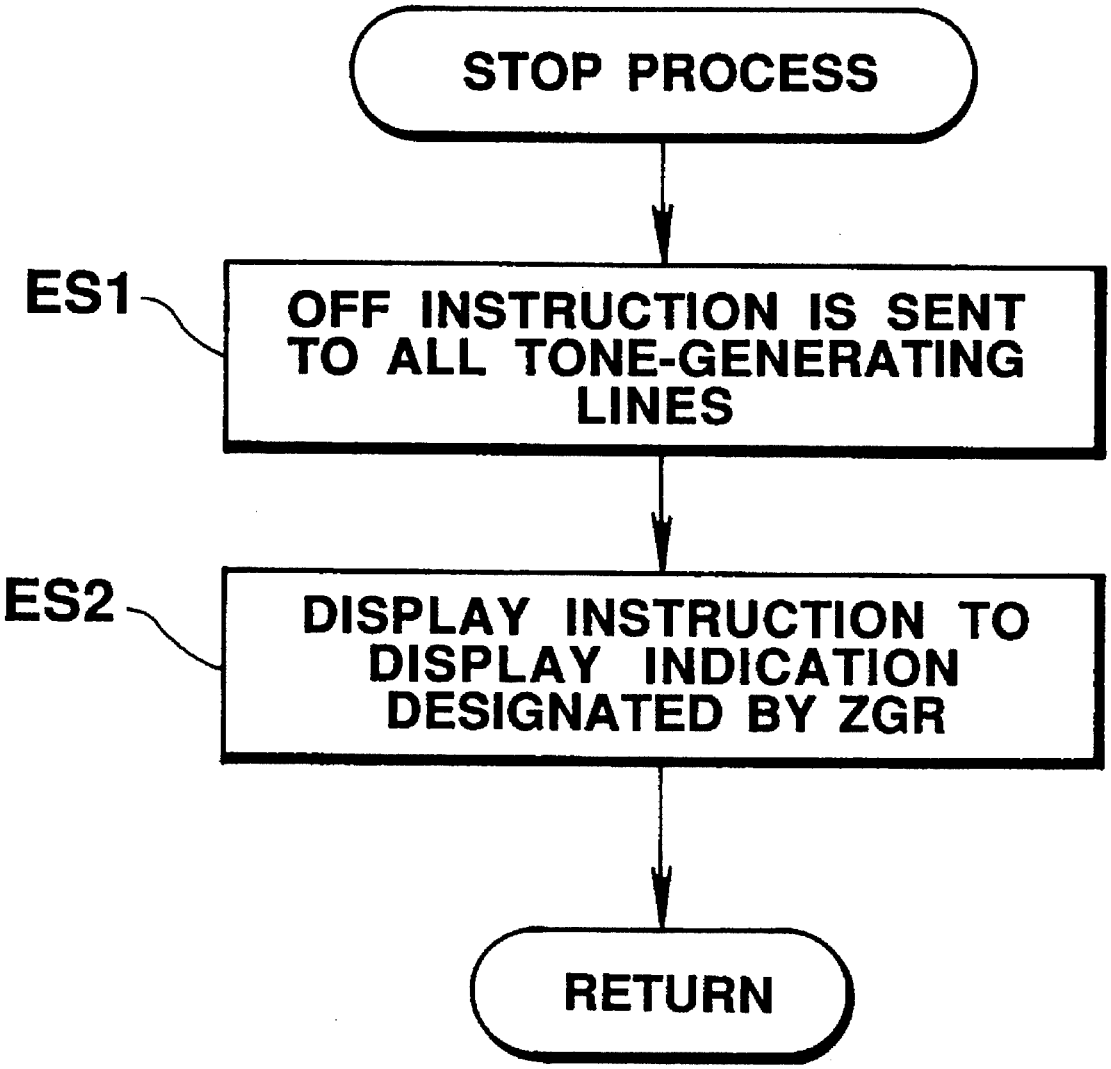
FIG. 42 is a flow chart of a detailed stop process of FIG. 35.

The stop process will be executed in accordance with the flow chart of FIG. 42. At step ES1, CPU 1 sends an OFF instruction to all the tone-generating lines to stop the sound source 9 from generating musical tones. In other words, CPU 1 sets "FF" to the end-flag register E to stop all the tone-generating lines from generating musical tones. At the following step ES2, CPU 1 reads out a value of the previous indication register ZGR and sends a display instruction. In other words, when the start switch 21 is switched on, CPU 1 allows an indication designated by ZGR to be displayed on the LCD unit 5.

In the third embodiment, indication data are sequentially switched as shown in FIGS. 43 to 56 every time CPU 1 judges that tone color data as performance data is switched, and an indication of a keyboard of a pian is completed finally. Indication data to be displayed on the LCD unit 5 are switched based on the performance data, and the user of the automatic playing apparatus can clearly learn from the indications on the LCD unit 5 that a tune as being be played has been changed to other and parts of the tune have been changed. As a result, indications on the LCD unit 5 can be more conveniently used, and can be good fun.

The fourth embodiment of an automatic playing apparatus with a display unit according to the invention is shown in FIGS. 57 to 61. In the third embodiment, indication data is switched based only on the tone color data while, in the fourth embodiment, nature of indication data which is switched based on switching data included in the performance data is switched.

The fourth embodiment is applied to an electronic musical instrument. In figures, like components as those of the third embodiment are designated by like reference symbols, and their description is omitted.

Figure 57:
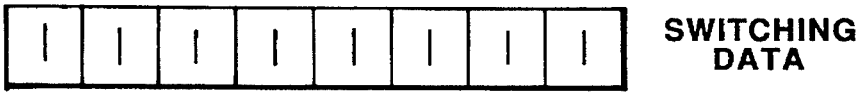
FIG. 57 is a view showing a structure of switching data in a fourth embodiment of the automatic playing apparatus with display unit according to the invention.

Similarly, octave data, key number data, step-time data, gate-time data and tone-color data are stored as performance data in the automatic performance-data memory unit 2 in the fourth embodiment. Further, switching data of one byte, all bits in which are set to "1" as shown in FIG. 57 is stored. Similarly, CPU 1 of the fourth embodiment is provided with various registers and counters shown in FIGS. 18 to 29. CPU 1 however needs no previous tone-color registers ZTNR 0 to ZTNR 6. Further, as will be described later, a plurality of indication data are stored in the display-image memory unit 4 for displaying indications A and B respectively in the fourth embodiment.

Figure 58:
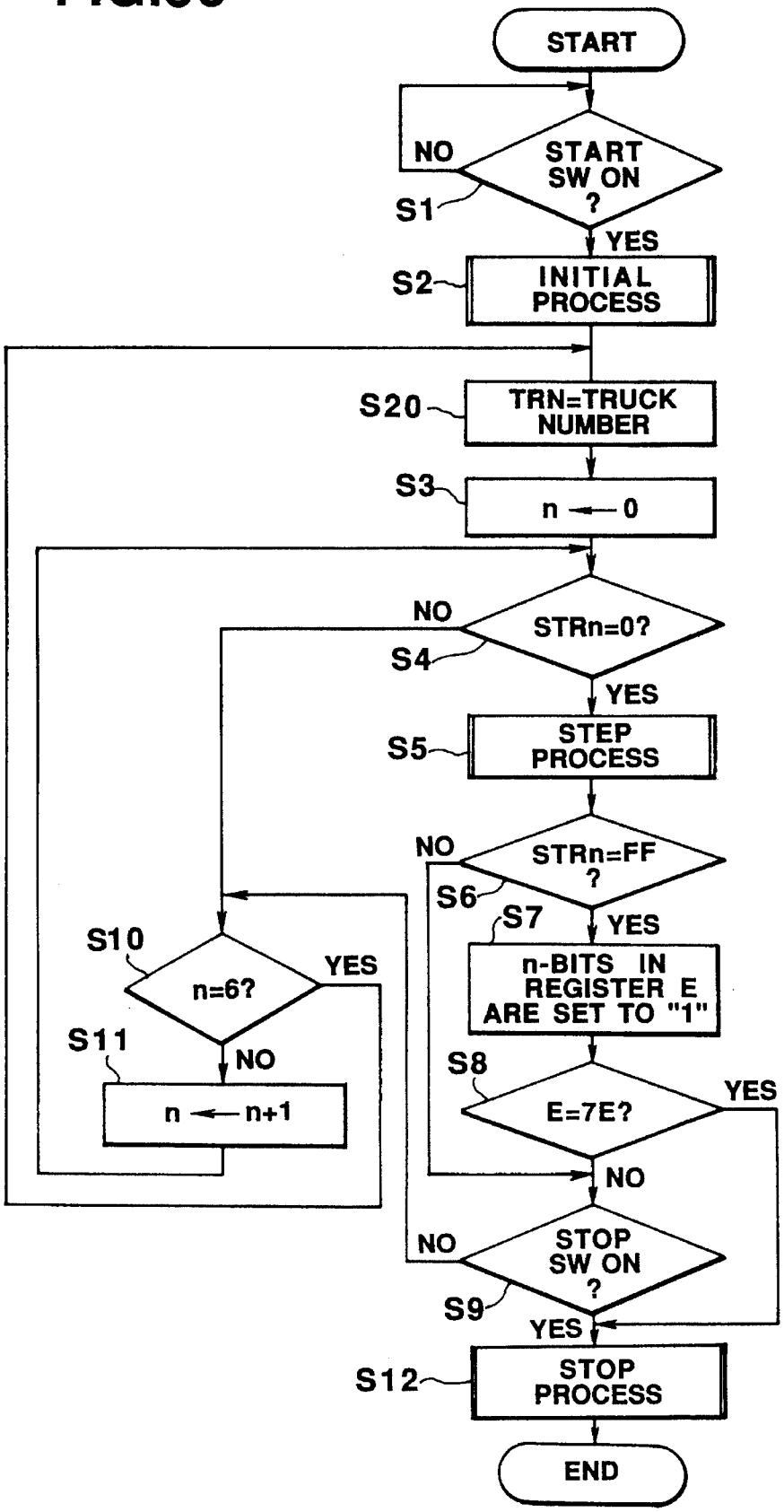
FIG. 58 is a flow chart of a main process of the fourth embodiment of the automatic playing apparatus of the invention.

The main routine process of CPU 1 in the fourth embodiment will be executed, in a similar manner as shown in FIG. 35, in accordance with the flow chart of FIG. 58. The main routine process of FIG. 58 includes a process of step S20 and other processes are executed similarly. But some processes in the main routine process are executed in different manners.

At step S20 of the main routine process, a track number of a track to be processed is set in the register TRN. As will be described in the present embodiment, indications are switched only in particularly limited lines (channels), and when the track to be processed is the particularly limited line, indication data is switched.

Figure 59:
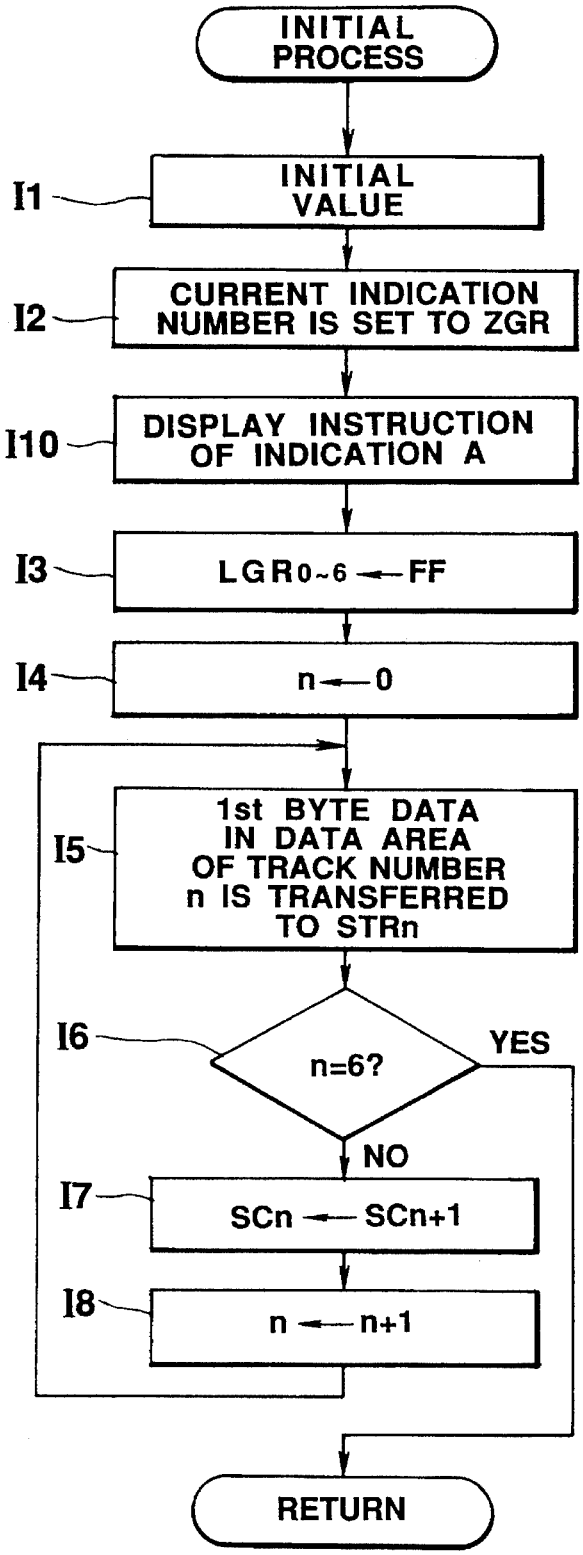
FIG. 59 is a flow chart of a detailed initial process of FIG. 58.

An initial process at step S2 in the main routine process of FIG. 58 will be executed in accordance with the flow chart of FIG. 59.

The initial process will be executed in a similar manner as in that shown in FIG. 36. In the initial process of FIG. 59, like processes as those in the initial process of FIG. 36 are designated by like reference symbols and their description is omitted. In the initial process, display instructions to display indications A are issued at step I10. As described above, two groups of indications as indications A and indications B are displayed in the present embodiment, and the display instruction instructs at step I10 to display the initial indication of indications A among two groups of indications.

When the initial process is finished, CPU 1 returns to the main routine process of FIG. 35, and executes a step process as in the above embodiment.

Figure 60:
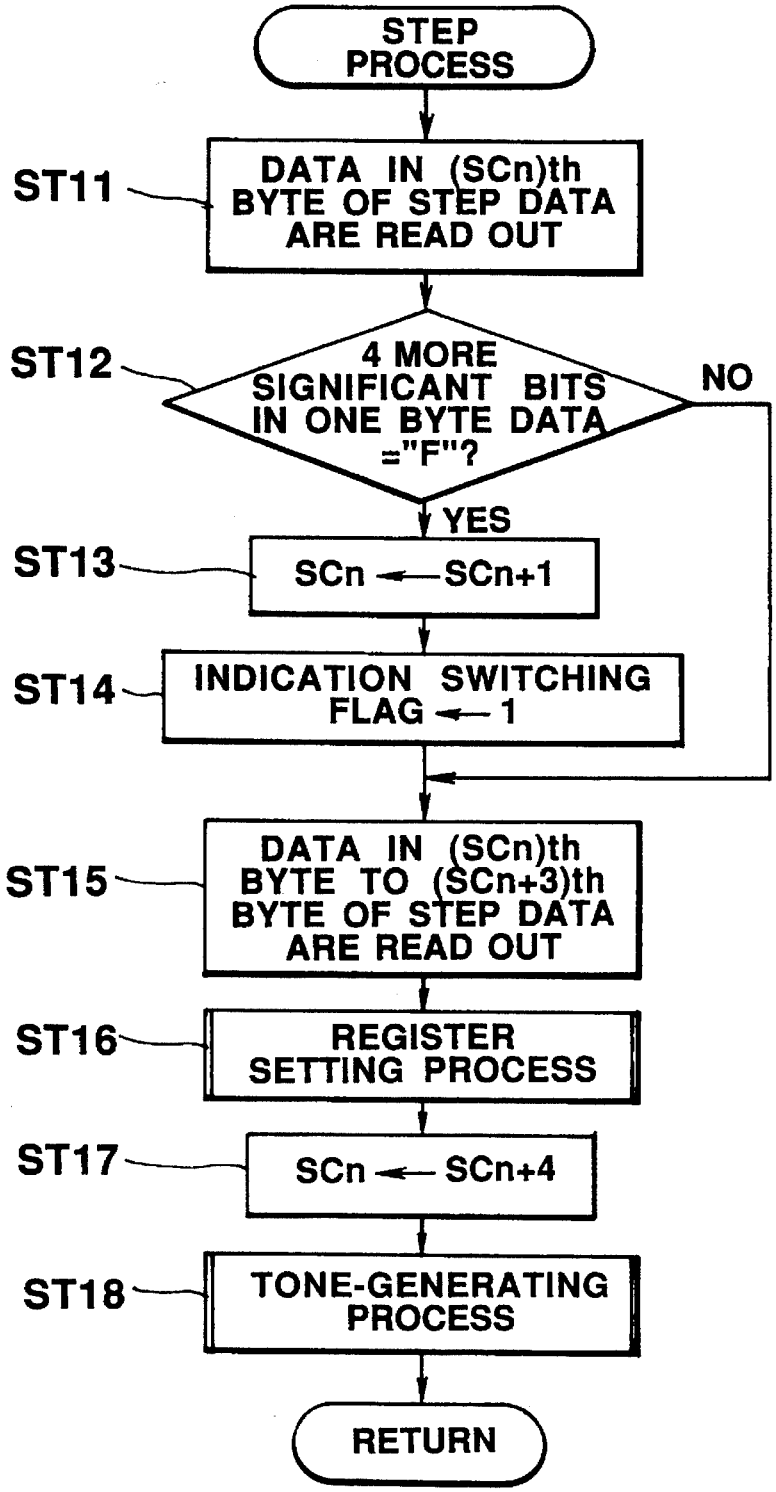
FIG. 60 is a flow chart of a detailed step process of FIG. 58.

The step process will be executed in accordance with the flow chart of FIG. 60.

In the step process, CPU 1 reads out at step ST11 data in (SCn)th byte of step data in the step-time register STRn of the line (channel) to be processed. It is judged at step ST12 if 4 more significant bits="111 =(F)" is true, i.e., if the read out data are data for switching the indication shown in FIG. 57. When the read out data are data for switching the indication, a switching flag is inverted at step ST14, and the relevant step counter SCn is incremented at step ST13. Then, CPU 1 reads out data of (SCn)th byte to (SCn+3)th byte from the step data, i.e., performance data shown in FIGS. 31 to 34 at step ST15, and executes a register setting process at step ST 16 to set respective read out performance data to registers.

The register setting will be executed in accordance with the flow chart of FIG. 38. When the register setting process is finished, CPU 1 returns to the step process of FIG. 60, again. At step ST17, CPU 1 adds "4" to the step counter SCn to advance a pointer of step data by "4". When a process for the step counter SCn is finished, a tone-generating process will be executed at step ST18.

The tone-generating process will be executed in a similar manner as in the flow chart of FIG. 39. But an indication switching process is executed in a different way.

Figure 61:
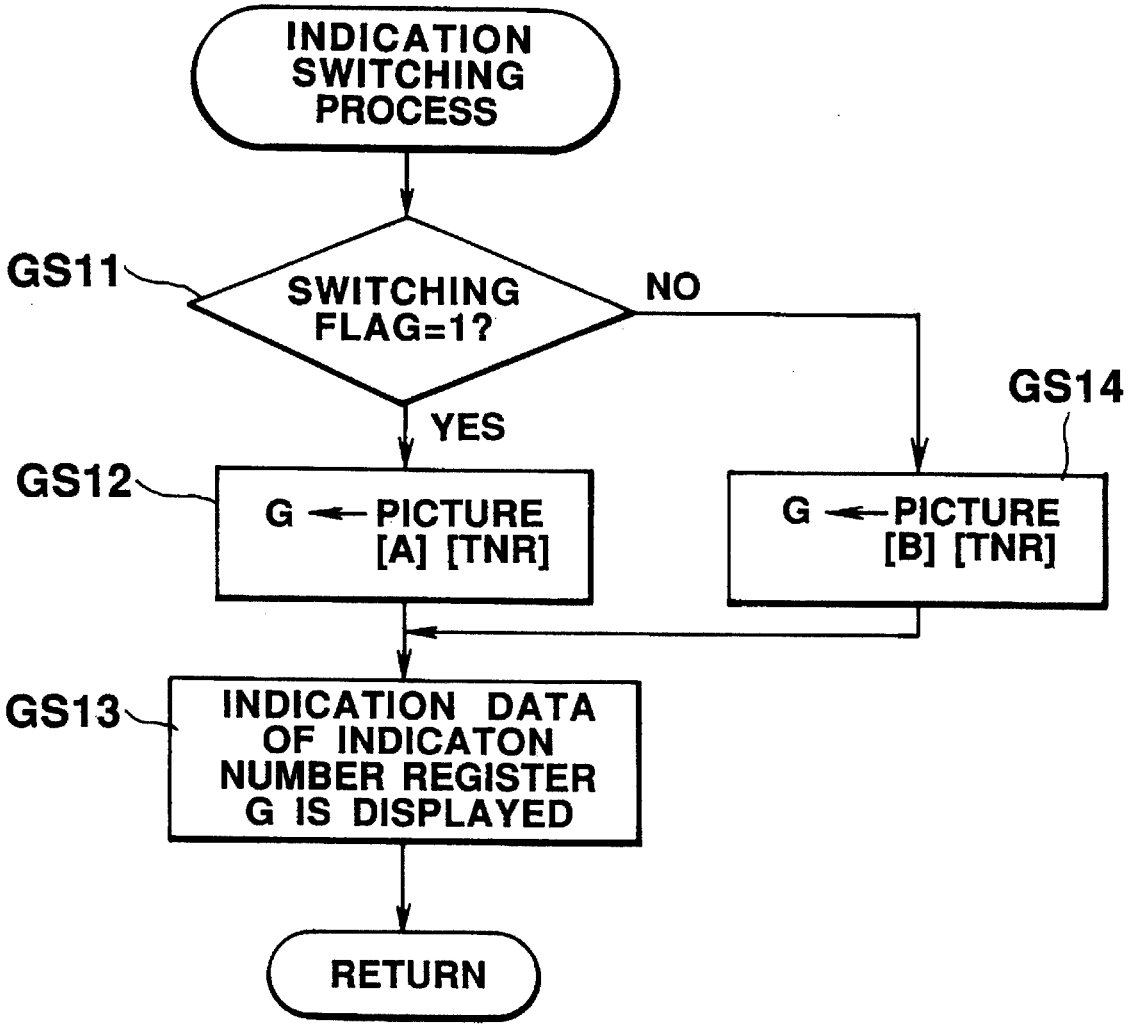
FIG. 61 is a flow chart of a detailed indication switching process.

The indication switching process will be executed in accordance with the flow chart of FIG. 61. It is judged at step GS11 if a switching flag is "1". When the switching flag is "1", data of indication A in the tone-color register TNR is converted into indication reading out data, and is set to an indication-number register G at step GS12. Indication data corresponding to the indication-number register G is read out from the display image memory unit 5 and is displayed on the LCD unit 5 at step GS13. When the switching flag is not "1" at step GS11, data of indication B in the tone-color register TNR is converted into indication reading out data, and is set to the indication-number register G at step GS14. Indication data corresponding to the indication-number register G is read out from the display image memory unit 5 and is displayed on the LCD unit 5 at step GS13. Thus, the indication switching process is finished.

When the indication switching process is finished, CPU 1 returns to the tone-generating process of FIG. 39. When the tone-generating process is finished, CPU 1 returns to the step process of FIG. 60. When the tone-generating process is finished, the step process will be finished, too.

When the step process is finished, CPU 1 returns to the main routine process of FIG. 58. When a give clock signal generated by the timer clock circuit CK of FIG. 1 is input during the main routine process similarly as in the above embodiment, a timer interrupt service will be executed, effecting a subtracting operation on the line gate-time register LGRn.

Executing the above processes, CPU 1 performs the stop process at step S12, when the register has reached "7F" at step S8 of the main routine process or when the stop switch 21 has been switched on at step S9. The main routine process is finished. The stop process is a similar process to that shown in FIG. 42.

As described above, in the present embodiment switching data inserted into a position where rhythm is changed makes the indication switching flag to be inverted every time rhythm is changed, and either of indication-data groups A and B is selected. Further, a desired indication data is selected out of the selected indication-data group, and is displayed as performance data on the basis of tone-color data.

FIGS. 62 to 65 are views illustrating the fifth embodiment of the automatic playing apparatus with a display unit according to the present invention.

In the fifth embodiment, indication data is switched on the basis of the switching data inserted into performance data. The switching data are not prepared independently of the performance data as in the fourth embodiment, but the switching data are involved in the performance data in the fifth embodiment.

Figure 62:
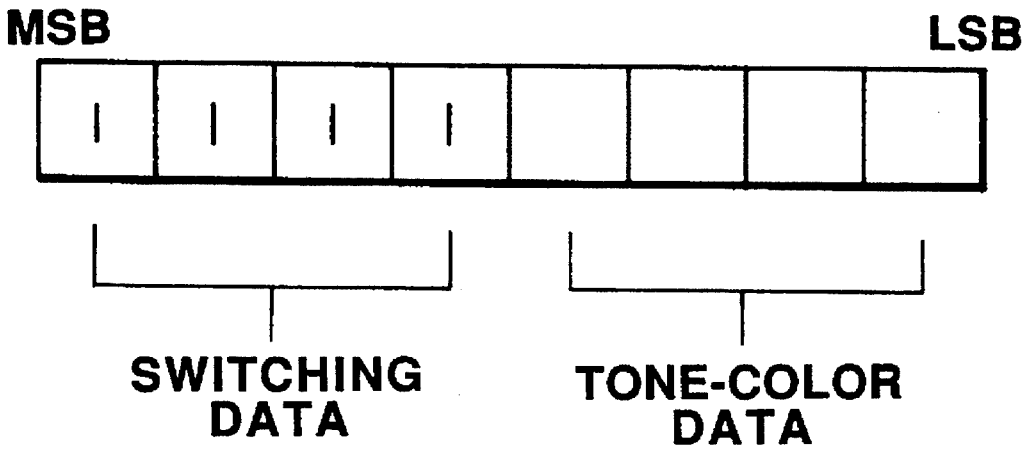
FIG. 62 is a view showing structure of switching data and tone-color data as performance data, in a fifth embodiment.

In the fifth embodiment, performance data are stored in the automatic performance-data memory unit 2. As shown in FIG. 32, octave data 0 to 7 are stored at 4 more significant bits in the first byte of the performance data while key number data 0 to 12 are stored at 4 less significant bits in the same first byte. As shown in FIG. 33, step-time data is stored in the second byte of the performance data. As shown in FIG. 34, gate-time data is stored in the third byte of the performance data. Further, as shown in FIG. 62, switching data of 4 bits all of which take "1" are stored at 4 more significant bits in the fourth byte of the performance data while tone-color data are stored at 4 less significant bits in the same fourth byte.

Similarly, CPU 1 in the present embodiment is provided with various registers and counters shown in FIGS. 18 to 30.

The main routine process of CPU 1 is executed in accordance with the flow chart of FIG. 35.

Figure 63:
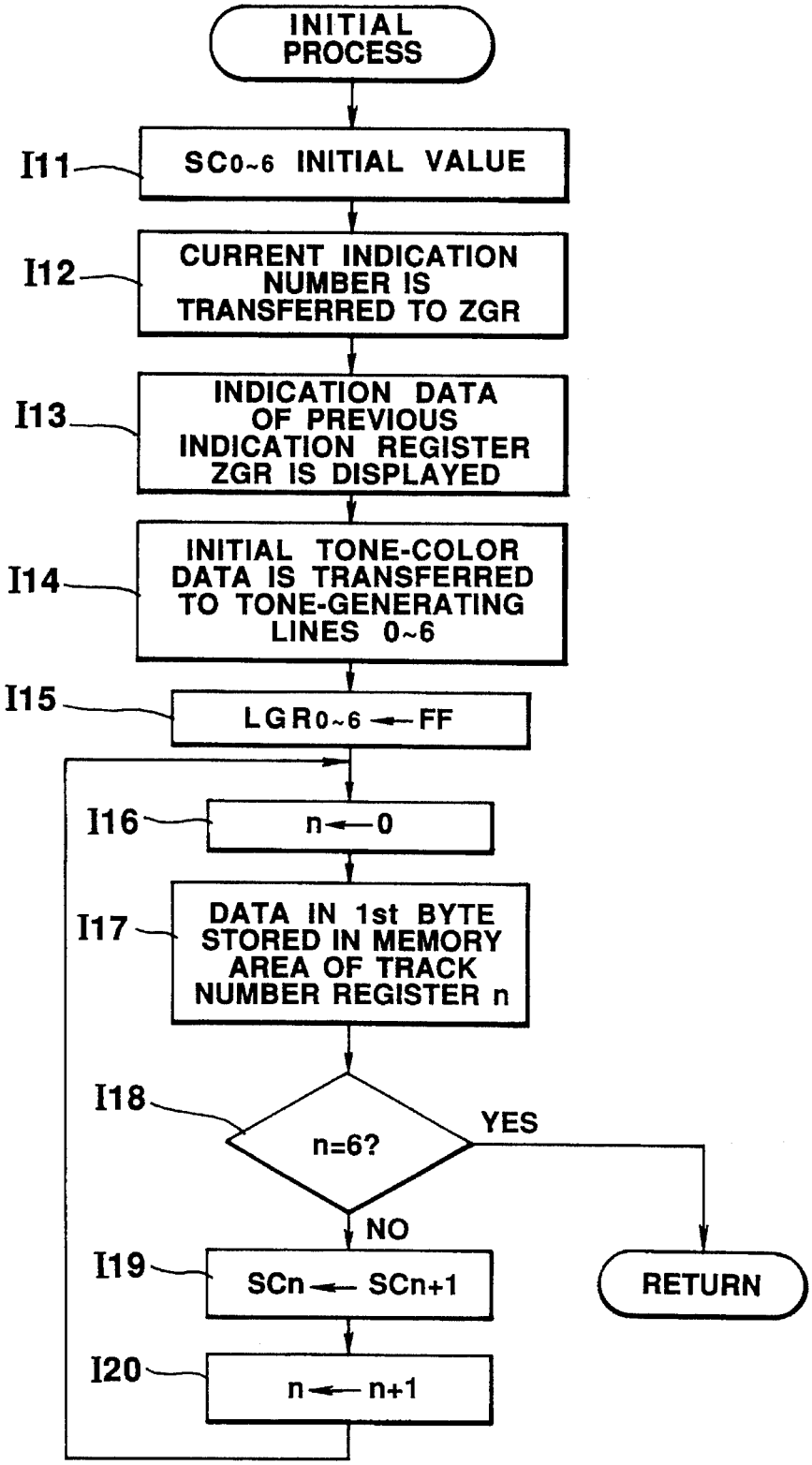
FIG. 63 is a flow chart of a detailed initial process in the fifth embodiment.

An initial process will be executed at step S2 in the main routine process of FIG. 35 in accordance with the flow chart of FIG. 63. The step counters SC 0 to SC 6 are set to initial values at step Ill of the initial process of FIG. 63, and an indication number of a current indication is transferred to the previous-indication register ZGR at step I12. Indication data of the indication number transferred to ZGR is read out from the display-image memory unit 4 and is displayed on the LCD unit 5 at step I13. A preparation process for performance is executed to set performance data for respective channels to initial values at step I14. At step I15, a value FF, which is a maximum value that can be set to the line-gate time registers LGR 0 to LGR 6, is set to these registers, making them idle not to generate sounds. At step I16, a value of "0" is set to the tone-generating line register n, to which data representing one out of 7 tone-generating channels is set. The first byte data stored in a memory area of track number n in the automatic performance-data memory area 2, i.e., data of step time on the first channel, is transferred to the step-time register STR n at step I17. It is judged at step I18 if the track number n has reached "6", i.e., if processes have been finished for tracks of all the channels. When the track number n has not reached "6", CPU 1 judges that processes for all channels have not been finished. Then, CPU 1 increments the step counter SC n and tone-generating line register n by "1" at steps I19 and I20, and then returns to step I16. CPU 1 executes similar process until the track number n reaches "6". When the track number n has reached "6" at step I18, the initial process is finished.

When the initial process is finished, CPU 1 returns to the main routine process of FIG. 35, and executes processes similarly as in the above embodiment, executing a step process at step S5.

Figure 64:
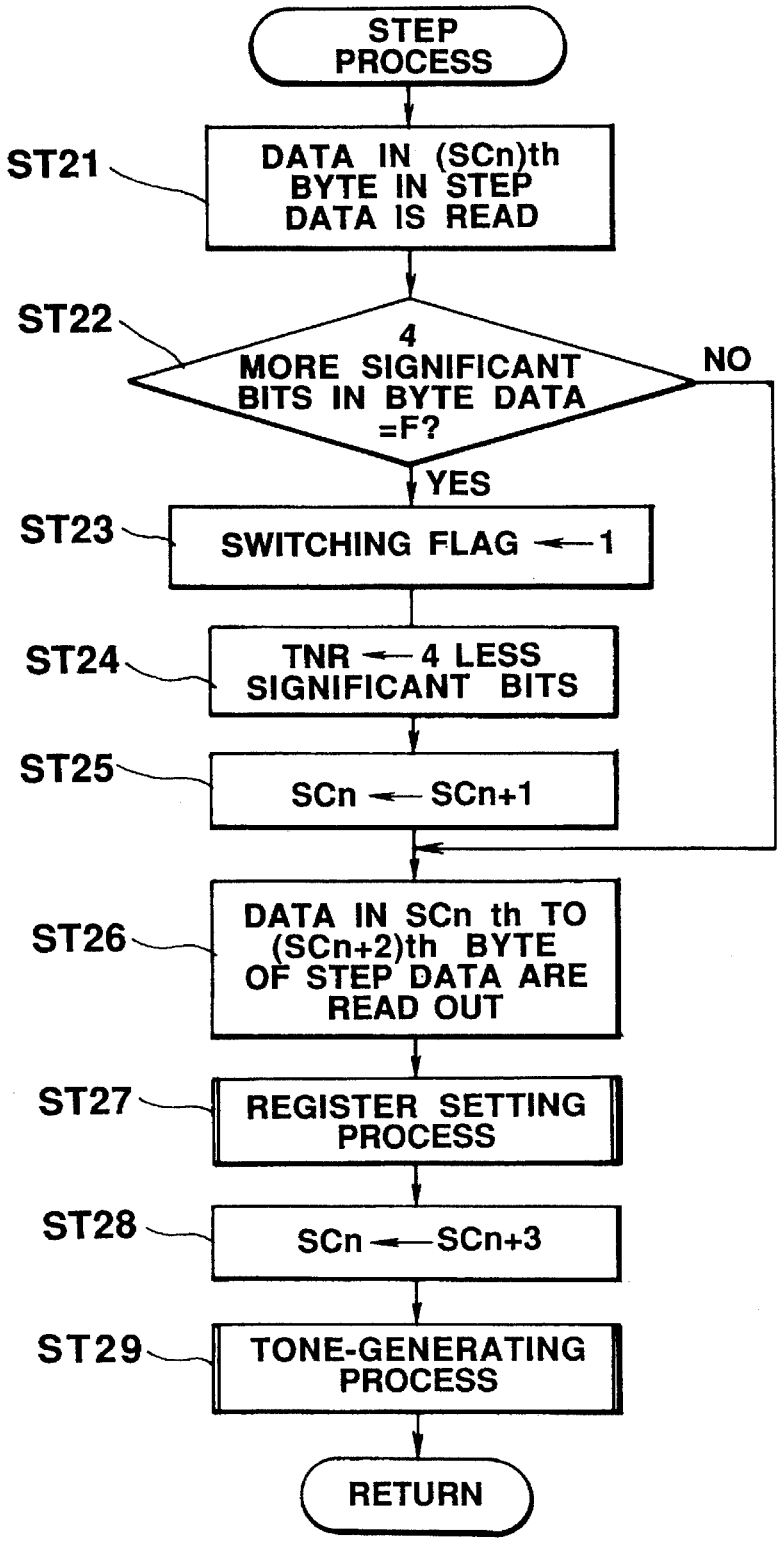
FIG. 64 is a flow chart of a detailed step process in the fifth embodiment.

The step process will be executed in accordance with the flow chart of FIG. 64.

In the step process, CPU 1 reads out, at step ST21, data in (SCn)th byte of step data in the step-time register STRn of the line (channel) to be processed. It is judged at step ST22 if 4 more significant bits= "1111=(F)" is true, i.e., if the read out data are data for switching the indication. When the read out data are data for switching the indication, a indication switching flag is set to "1", and 4 less significant bits in the read out byte data, i.e., tone-color data are set to the tone-color register TNR at step ST24. Then, CPU 1 increments the step counter SCn at step ST25, and reads out data in (SCn)th byte to (SCn+3)th byte of the step data, i.e., performance data shown in FIGS. 32 to 34 at step ST26. Further, CPU 1 executes a register setting process at step ST 27 to set the respective read out performance data to registers.

Figure 65:
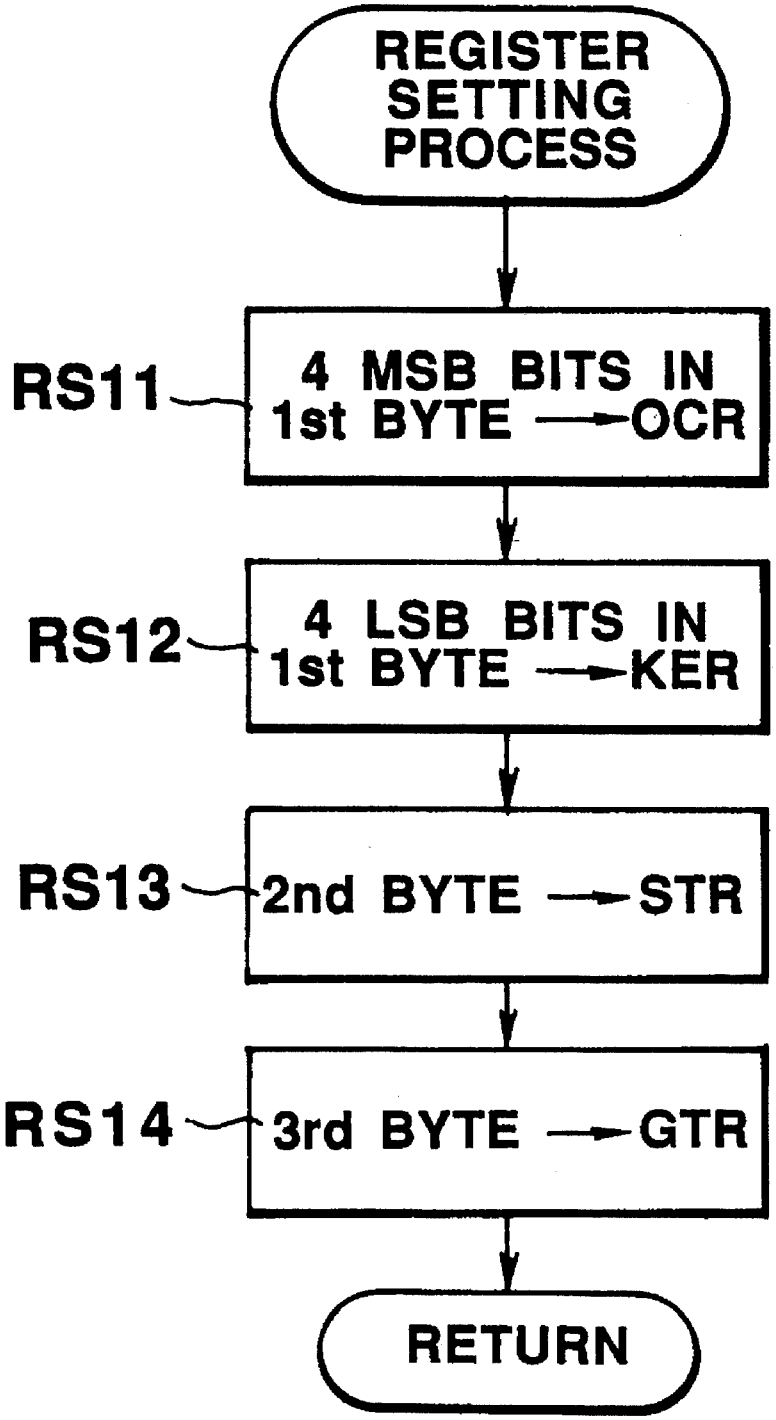
FIG. 65 is a flow chart of a detailed register set process in the fifth embodiment.

The register setting process will be executed in accordance with the flow chart of FIG. 65. Data at 4 more significant bits in the first byte, i.e., octave data shown in FIG. 32 are transferred to the octave register OCR at step RS11. Data at 4 less significant bits in the first byte, i.e., key-number data shown in FIG. 32 are transferred to the key register KER at step RS12. Data in the second byte, i.e., step-time data shown in FIG. 33 are transferred to the step-time register STRn of the relevant channel at step RS13. of the performance data. Data in the third byte, i.e., gate-time data shown in FIG. 34 are transferred to the gate-time register GTRn of the relevant channel at step RS14. Now, the register setting process is finished.

When the register setting process is finished, CPU 1 returns to the step process of FIG. 64, again. At step ST28, CPU 1 advances the step counter SCn by "3" at step ST28, preparing for the following tone-generating process. When the process for the step counter SCn is finished, CPU 1 will perform the tone-generating process at step ST29, in accordance with the flow chart of FIG. 39.

When the tone-generating line register n coincides with a track number in the register TNR at step H1 of FIG. 39, CPU 1 judges that an indication switching timing has been reached and executes an indication switching process at step H4. The indication switching process is the same process as that shown in FIG. 61.

Switching data is inserted into tone-color data at a position where rhythm is changed. CPU 1 sets "1" to the indication switching flag based on the switching data every time the rhythm is changed, executing the indication switching process.

When the indication switching process has been finished, CPU 1 returns to the tone-generating process of FIG. 39. CPU 1 transfers and sets a value of the tone-color register TNR, a value of the velocity register VER, a value of the octave register OCR and a value of the key register KER to the tone-generating line register n at step H2, and further transfers and sets a value of the gate-time register GTRn to the line-gate time register LGRn at step H3.

When the tone-generating process has been finished, CPU 1 returns to the step process of FIG. 64, again, finishing the step process.

When the step process has been finished, CPU 1 returns to the main routine process of FIG. 35, again. When a give clock signal Generated by the timer clock circuit CK of FIG. 1 is input during the main routine process similarly as in the above embodiment, a timer interrupt service will be executed, effecting a subtracting operation on the step-time register STRn and the line gate-time register LGRn.

Executing the above processes, CPU 1 performs the stop process at step S12, when the register has reached "7F" at step S8 of the main routine process of FIG. 35 or when the stop switch 21 has been switched on at step S9, and finishes the main routine process. The stop process is the same process as that shown in FIG. 42.

Since, in the present fifth embodiment, switching data is inserted into performance data at a position where rhythm of a tune changes, a sort of indication data which is switched based on the tone-color data can be switched very time rhythm of the tune changes. The user of the automatic playing apparatus can easily learn from the indications on the LCD unit 5 that the rhythm of the tune changes, and further can learn that a flow of the performance changes.

In the above fourth and fifth embodiments, switching data is inserted into the performance data at positions where rhythm of the tune is changed, but the switching data may be inserted into performance data every measure or every position where parts are switched.

Figure 66:
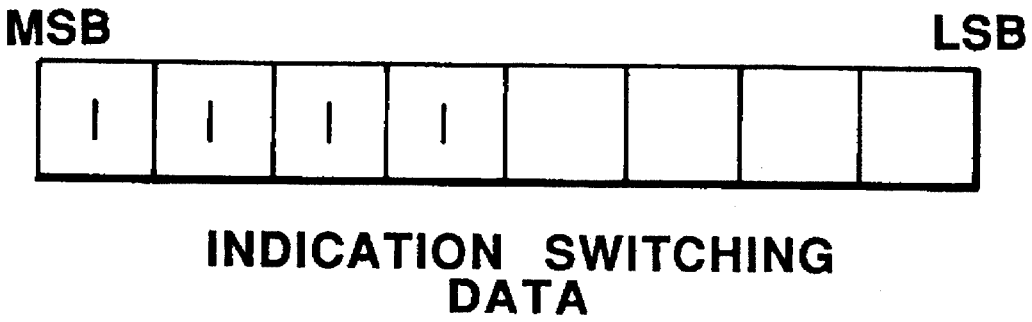
FIG. 66 is a view showing structures of indication switching data in a sixth embodiment.

FIG. 66 is a view showing a format of indication switching data used in the sixth embodiment of the invention. Data at 4 more significant bits take "1", and are added to a leading portion or a tailing portion of performance data. As will be described later, CPU 1 reads indication switching data, switching indication data to be read out from the display-image memory unit 4.

In the sixth embodiment, a main routine to be performed by CPU 1 is the same as shown in FIG. 35. An initial process in the sixth embodiment is also the same as shown in FIG. 36. Further, the step process of FIG. 35 is the same as that of FIG. 60, and the register setting process of FIG. 37 is the same as shown in FIG. 38. The tone-generating process of FIG. 37 are the same as that of FIG. 39. A timer interrupt process and a stop process are the same as those shown in FIGS. 41, 42.

Figure 67:
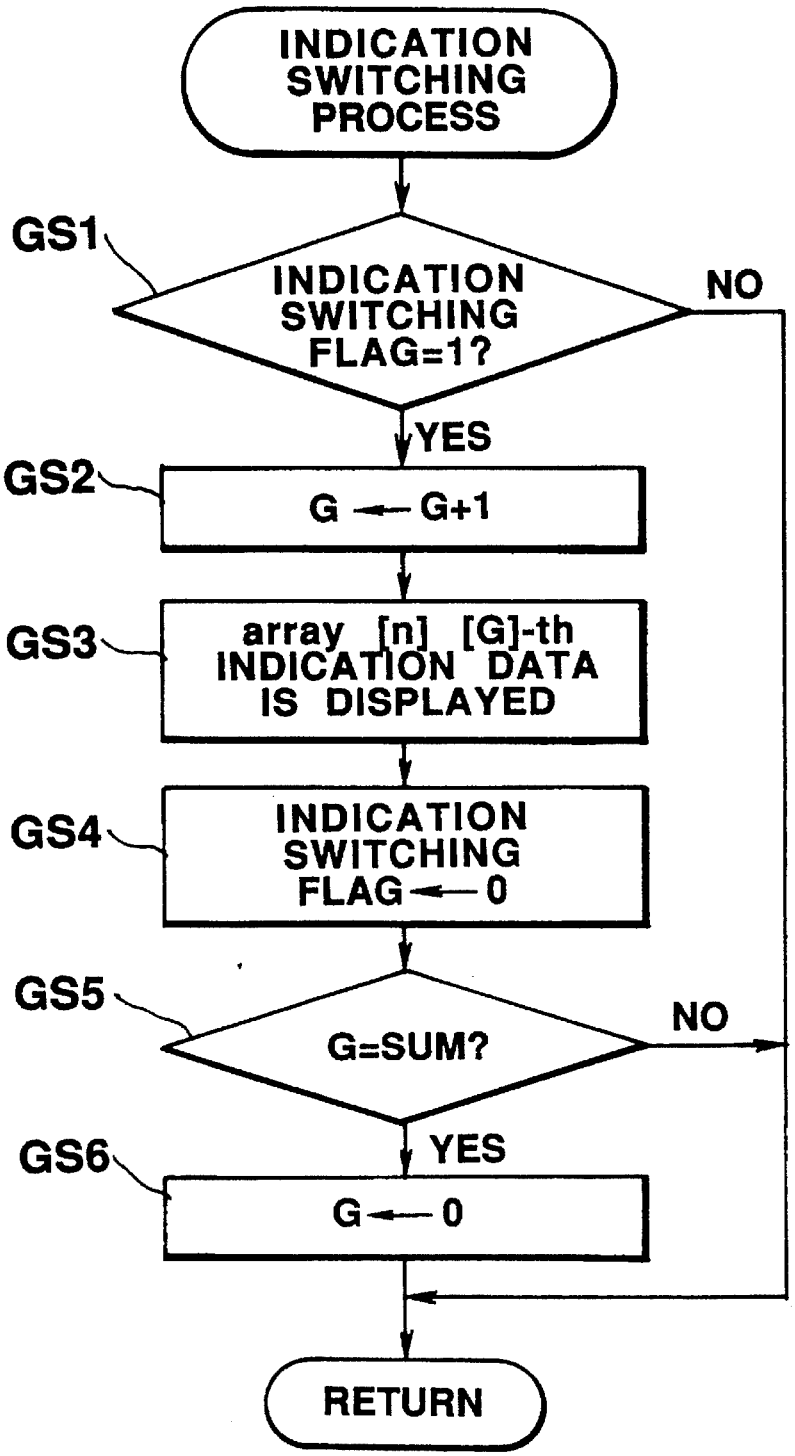
FIG. 67 is a flow chart of a detailed indication switching process in the sixth embodiment.

FIG. 67 is a flow chart of an indication switching process in the tone-generating process of the present embodiment.

CPU 1 judges at step GS1 if the indication switching flag is "1". If not, CPU 1 judges that an indication switching timing has not been reached, finishing the process.

If the indication switching flag is "1", CPU 1 increments only the indication-number register G by "1" at step GS2. CPU 1 reads out indication data in array [n] [G]th memory area of the display-image memory unit 4, and drives the LCD unit 5 at step GS3 to display the indication data thereon under the control of the display control unit 3. More specifically, the display-image memory unit 4 is divided into several memory areas, number of which memory areas is equivalent to that of the tone-generating lines n. Indication data appropriate to performance data of respective tone-generating lines n are stored in these memory areas, respectively. Memory area corresponding to the tone-generating line n is designated by array [n], and sections in the designated memory area is designated by [G] where indication data is stored. The indication switching flag is reset to "0" at step GS4. It is judged at step GS5 if the indication-number register G has reached a maximum number SUM of data which are stored as the indication data for the tone-generating line. If the indication-number register G has not reached the maximum number SUM of the data, CPU 1 finishes the process. If the indication-number register G has reached the maximum number SUM of the data, CPU 1 resets the indication-number register G to "0", and performs a process at step GS6 for allowing the initial indication data to be read out in the following indication switching process.

In the sixth embodiment, CPU 1 sequentially switches indication data as shown in FIGS. 43 to 56 every time it reads out indication-switching data which are inserted into performance data in association therewith, and CPU 1 completes an indication of a keyboard of a piano, finally. The indication data to be displayed on the LCD unit 5 therefore can be switched based on the indication switching data. Since indications representing that tunes are changed and parts are switched can be displayed on the LCD unit 5, the user can learn easily and clearly from these indications that tunes are changed and parts are switched. As a result, the indications on the LCD unit 5 can be used more conveniently, and can be more attractive.

With the above arrangement of the sixth embodiment, indications on the LCD unit 5 are switched based on the indication switching data involved in the performance data. The indication data may be switched based on the performance data, particularly based on tone-color data themselves. The example showing that the indication data are switched based on the performance data such as the tone-color data is illustrated in a seventh embodiment.

Figure 68:
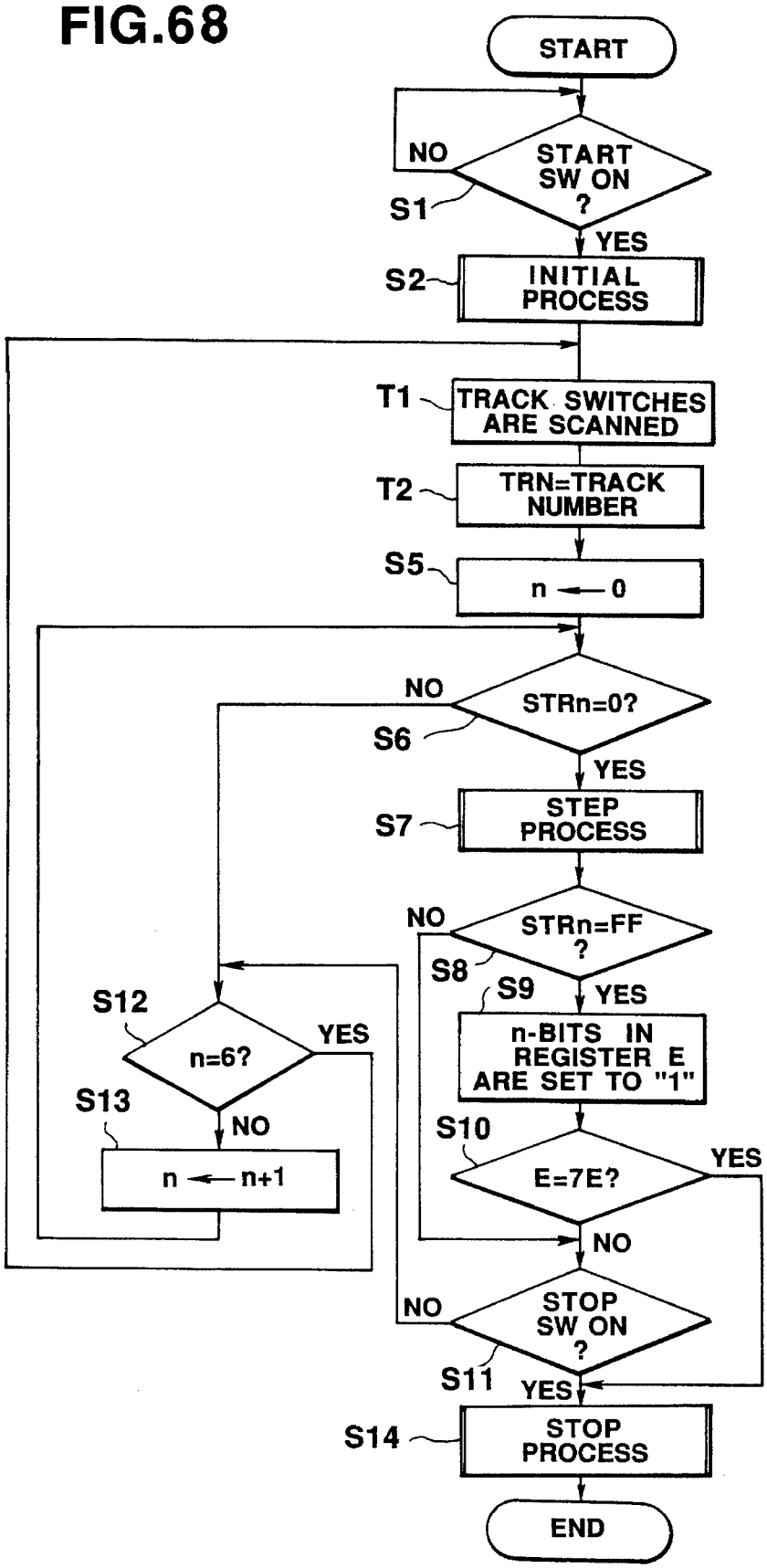
FIG. 68 is a flow chart of a main process of the seventh embodiment of the automatic playing apparatus of the invention.

FIG. 68 is the flow chart of the main routine process performed by CPU 1 in the seventh embodiment. When the start switch 21 is switched on at step S1, the initial process is executed at step S2. Track switches are scanned at step T1, and a track number is set to a register TRN at step T2. In the present embodiment, the indication-number register G is not reset. More specifically, since, in the present embodiment, indication data are switched based on tone-color data in the indication-switching process, the indication-number register G is not reset.

Figure 69:
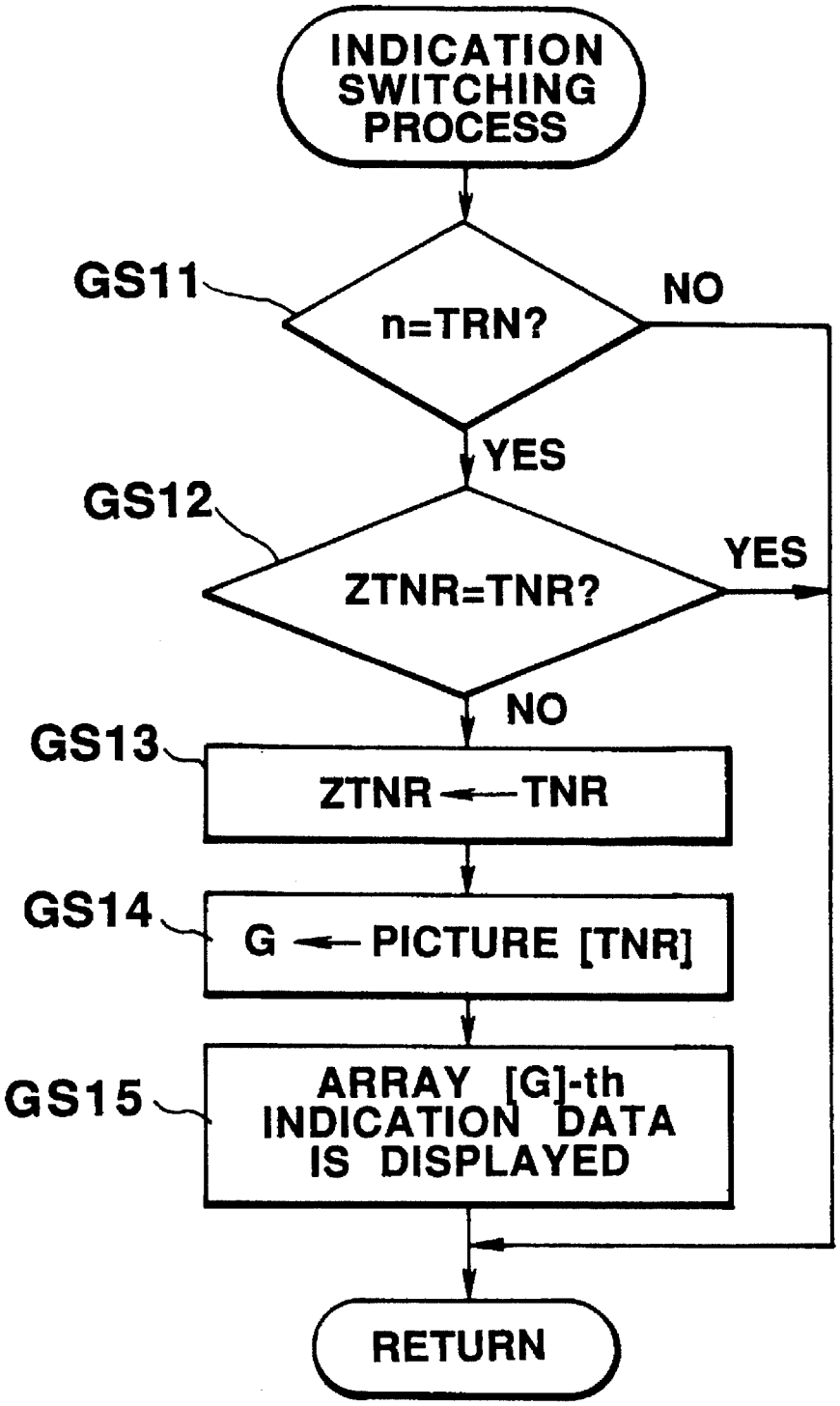
FIG. 69 is a flow chart of a detailed indication switching process in the seventh embodiment.
Figure 70:
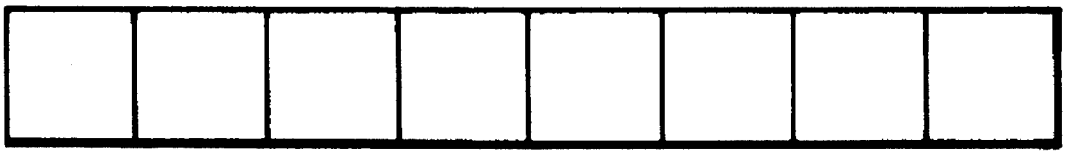
FIG. 70 is a view showing a format of a step time register formed in CPU of FIG. 1 in an eighth embodiment of an automatic playing apparatus with a display unit according to the invention.
Figure 71:
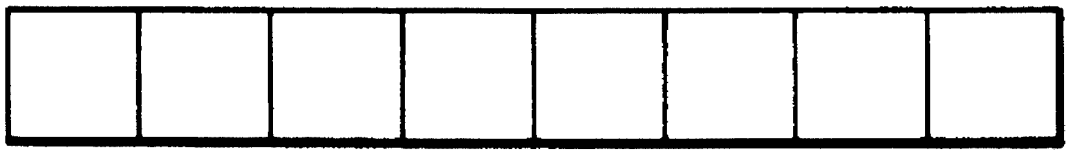
FIG. 71 is a view showing a format of a step counter formed in CPU of FIG. 1.
Figure 72:
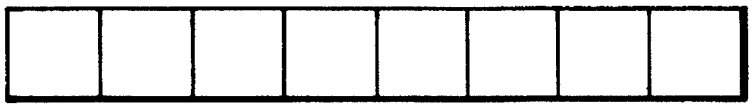
FIG. 72 is a view showing a format of a line gate time register formed in CPU of FIG. 1.
Figure 73:
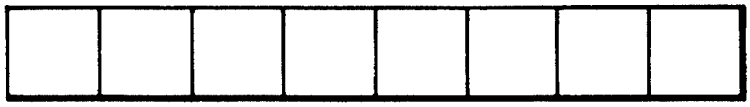
FIG. 73 is a view showing a format of a timing counter formed in CPU of FIG. 1.
Figure 74:
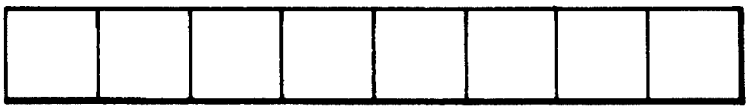
FIG. 74 is a view showing a format of a step counter formed in CPU of FIG. 1.

Similarly, CPU 1 performs processes in accordance with the flow chart of FIG. 35. The initial process, register setting process, tone-generating process are performed in a similar manner as in the sixth embodiment. The step process is the same as that of FIG. 36, and the indication switching process in the tone-generating process will be executed as shown in FIG. 69.

In the indication switching process, it is judged at step GS11 if a value of the tone-generating line register n coincides with a value of the register TRN, i.e., if a current tone-generating line is an indication switching line. When the value of the tone-generating line register n does not coincide with the value of the register TRN, CPU 1 judges that the current tone-generating line is not an indication switching line, and does not switch the indication, finishing the process. When the value of the tone-generating line register n coincides with the value of the register TRN, CPU 1 judges that the current tone-generating line is an indication switching line, and judges at step GS12 if a value of the current tone-color register TNR coincides with a value of the previous tone-color register ZTNR. When the value of the current tone-color register TNR coincides with the value of the previous tone-color register ZTNR, CPU 1 judges that the current tone-color is the same as the previous tone-color, and does not switch indication data, finishing the process. When the value of the current tone-color register TNR does not coincide with the value of the previous tone-color register ZTNR, CPU 1 judges that the tone-color has not been changed, and sets the value of the current tone-color register TNR to the previous tone-color register ZTNR at step GS13. Then, CPU 1 converts data of the tone-color register TNR into an indication reading out data, and sets the same to the indication-number register G at step GS14. Further, CPU 1 reads out indication data corresponding to the indication-number register G from the display-image memory unit 4, and allows the read out indication data to be displayed on the LCD unit 5 at step GS15.

With the arrangement of the seventh embodiment, indication data can be switched based on tone-color data as the performance data, and indications on the LCD unit 5 can be switched every time tone color is changed. The user therefore can learn from the indications on the LCD unit 5 that tone color has been changed.

FIGS. 70 to 85 are views illustrating the eighth embodiment of the automatic playing apparatus with a display unit of the invention.

In the eighth embodiment, beats of a tune as being played are detected, and indications are switched every beat. CPU 1 of the third embodiment is provided with several units of each register, but CPU 1 of the eighth embodiment is provided with each one of step-time registers STR, gate-time registers GTR, step counters SC and line-gate time registers LGR, as shown in FIGS. 70 to 73. Further, CPU 1 is provided with a timing counter TC shown in FIG. 74 in place of a tone-color register TNR and e velocity register VER.

Automatic performance data stored in the automatic performance-data memory unit 2 are octave data, key-code data, step-time data and gate-time data, shown in FIGS. 32 to 34, but tone-color data and velocity data are not stored.

Figure 75:
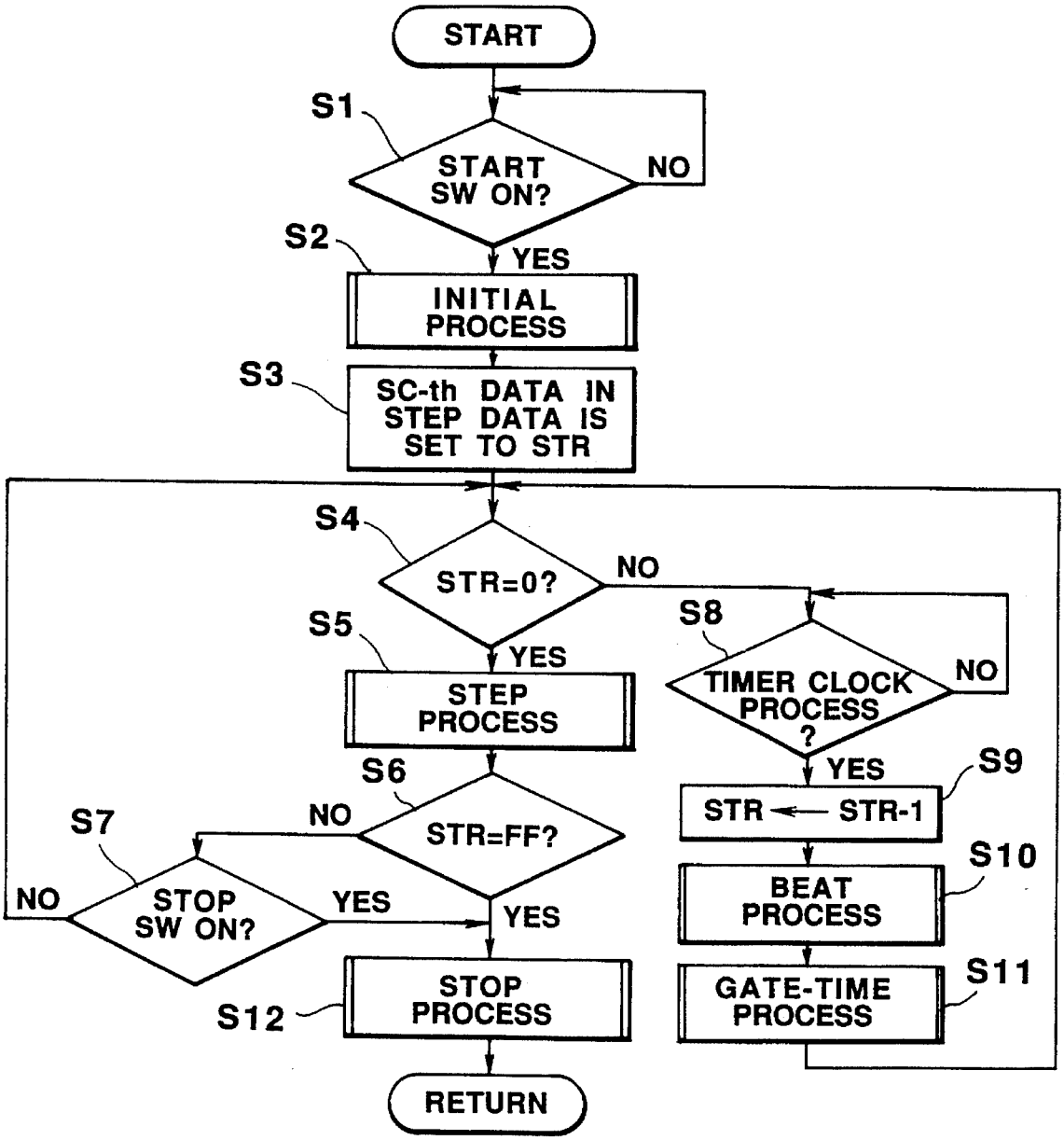
FIG. 75 is a flow chart of main process of CPU of FIG. 1 in an eighth embodiment of an automatic playing apparatus with a display unit according to the invention.

Now, operation of CPU 1 will be described with reference to the flow charts of FIGS. 75 to 82. FIG. 75 is the flow chart of the main routine process of CPU 1. When the power of the eighth embodiment is turned on and the start switch 21 is switched on at step S1, CPU 1 executes an initial process at step S2.

In the initial process, CPU 1 sets an initial value to the step counter SC which designates addresses in the automatic performance-data memory unit 2, to designate the initial performance data.

Figure 76:
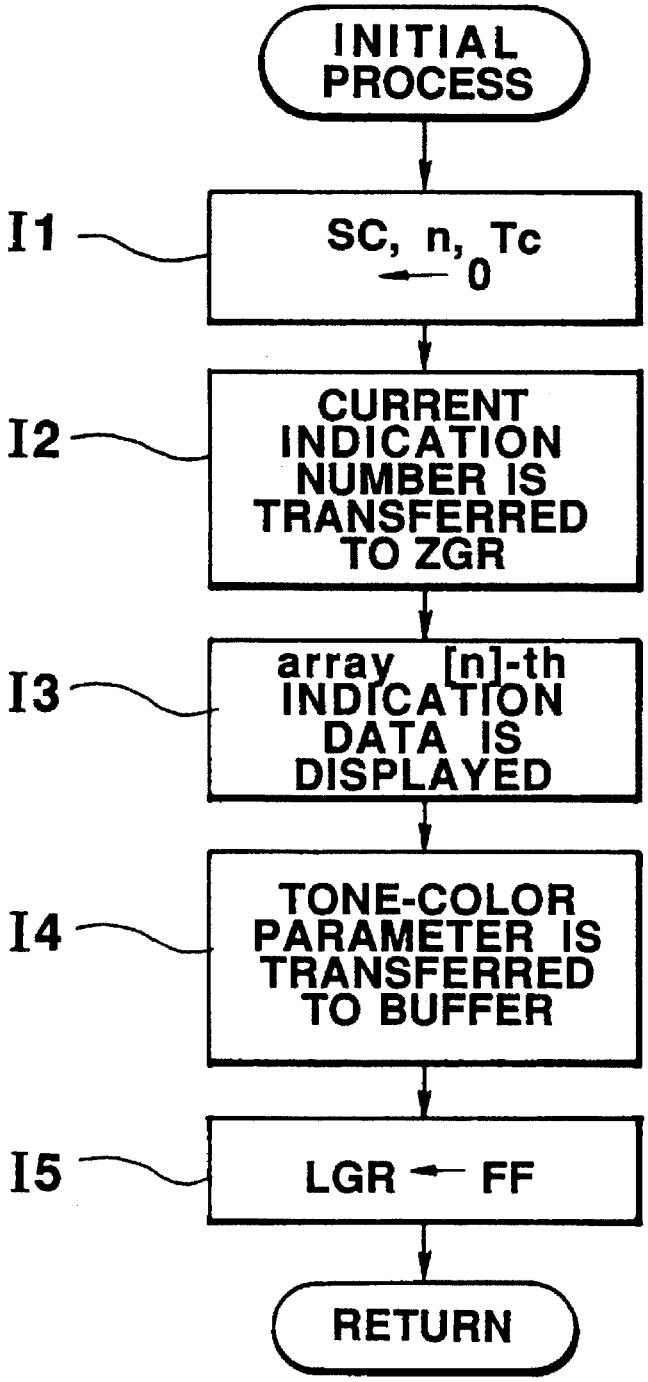
FIG. 76 is a flow chart of a detailed initial process of FIG. 75.

More specifically, in the initial process of FIG. 76, the initial value "0" is set to the step counter SC, a variable n and the timing counter TC, and performance data for respective channels are initialized to execute a preparing process for performance at step I1. An indication number of a current indication is transferred and set to the previous-indication register ZGR in CPU 1, i.e., an indication number of an indication which is displayed on the LCD unit 5 when the start switch 21 is turned on is transferred and set to the previous-indication register ZGR at step I2. At step I3, n-th indication data is displayed, i.e., data at array [n] of the display-image memory unit 4, where n=0, is read out and displayed on the LCD unit 5. Then, tone-color parameter is read out form the tone-color parameter memory unit 6 and is transferred to the tone-color parameter buffer 10 of the sound source 9 at step I4. CPU 1 sets "FF" to the line-gate time register LGR at step I5, finishing the initial process.

When the initial process is finished, CPU 1 returns to the main routine process of FIG. 75, and sets SCth data (an initial value:pause time before a performance starts) in step data to the step-time register STR at step S3. CPU 1 judges at step S4 if the step-time register STR is set at "0", i.e., if a step time has passed. When the step-time register STR is set at "0", CPU 1 executes the step process at step S5.

Figure 77:
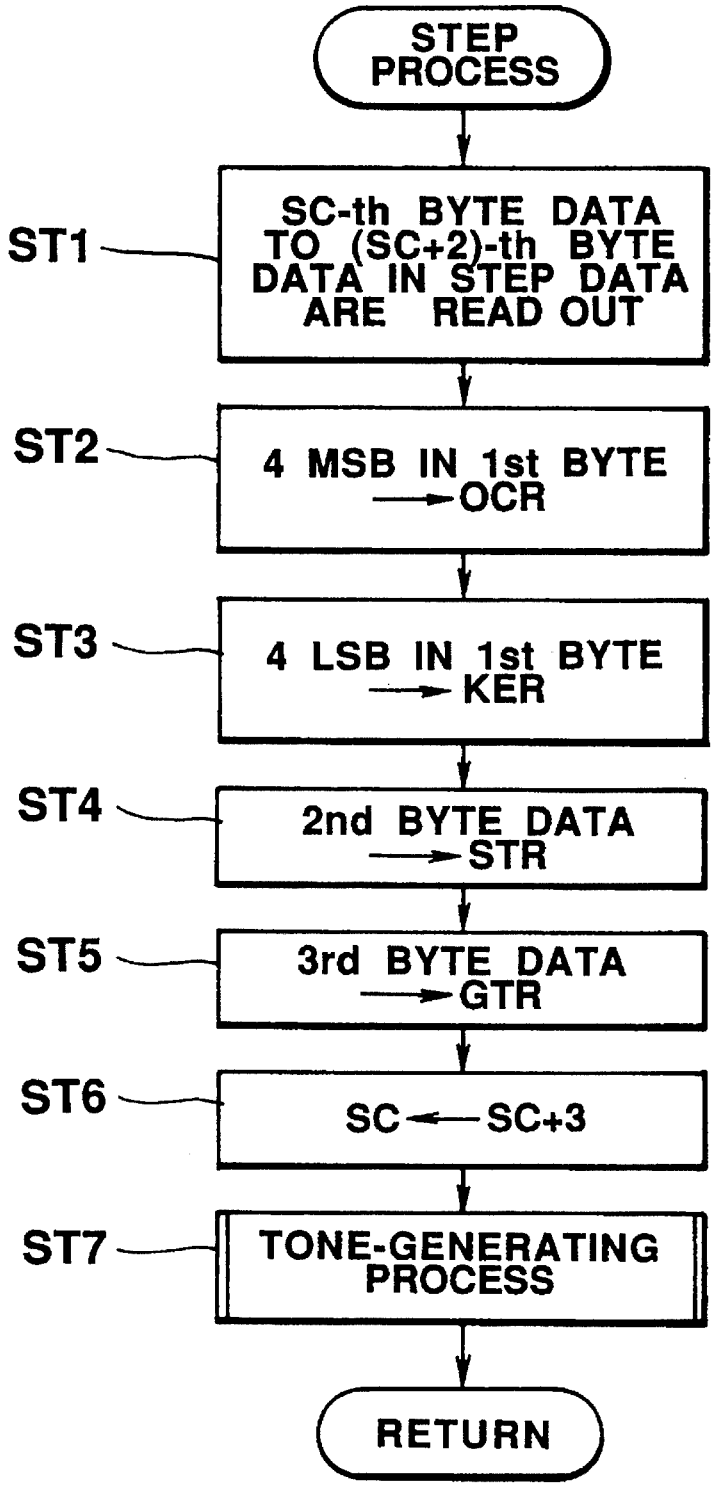
FIG. 77 is a flow chart of a detailed step process of FIG. 75.

The step process will be executed in accordance with the flow chart of FIG. 77. SCth byte data to (SC+ 2)th byte data in step data, i.e., performance data shown in FIGS. 32 to 34 are read out at step ST1, and the read out performance data are set to relevant registers at steps ST2 to ST5. Data of 4 more significant bits in the first byte, i.e., octave data (see FIG. 32) are transferred to the octave register OCR at step ST2 while data of 4 less significant bits in the first byte, i.e., key-number data (see FIG. 32) are transferred to the key register KER at step ST32. The second byte data, i.e., step-time data (see FIG. 33) are transferred to the step-time register STR at step ST4. Finally, the third byte data, i.e., gate-time data (see FIG. 34) are transferred to the gate-time register GTR at step ST5. When a register setting process is finished, the step-counter SC advances a pointer of data step by "3". When a process for the step counter SC is finished, CPU 1 performs the tone-generating process at step ST7, and finishes the step process.

Figure 78:
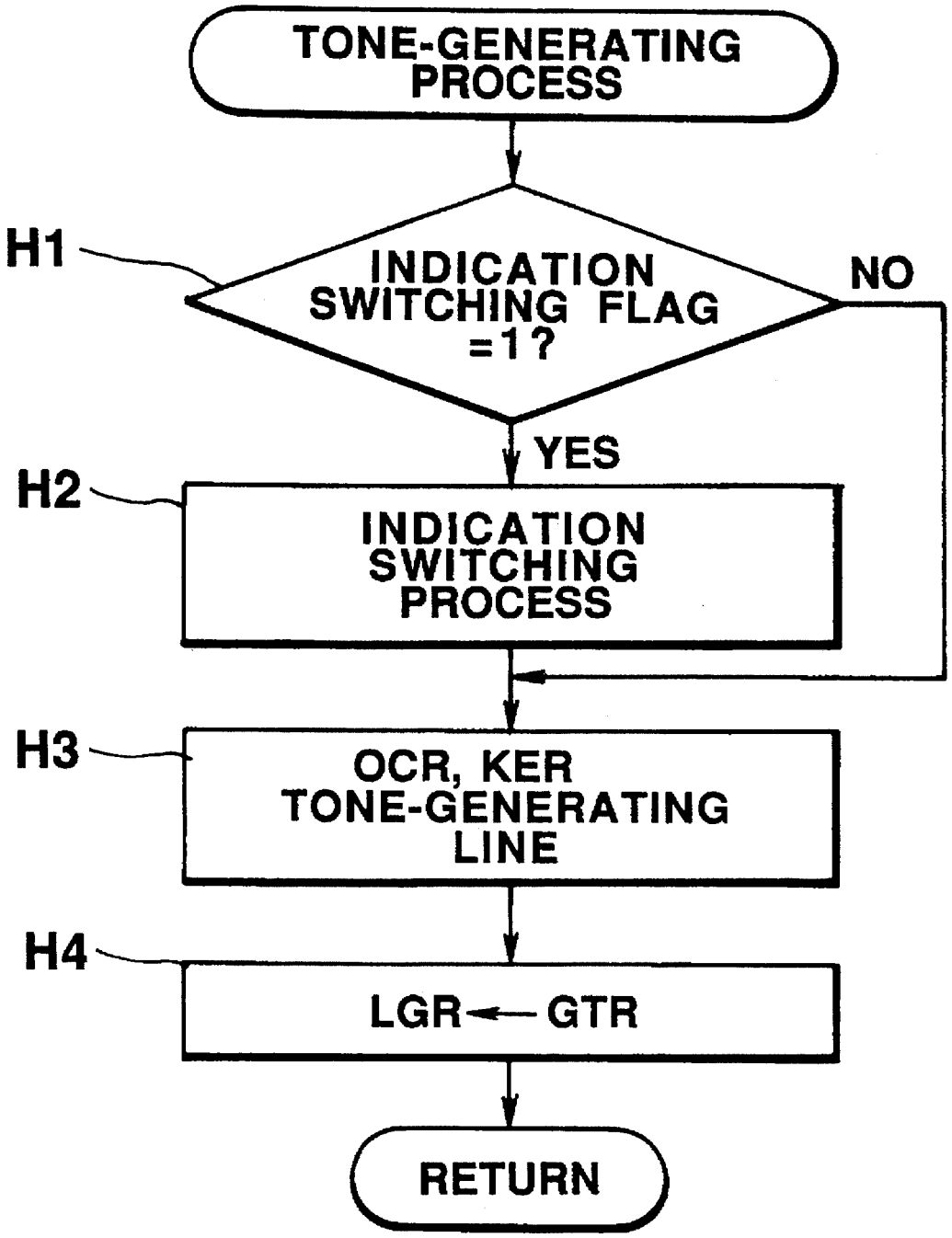
FIG. 78 is a flow chart of a tone-generation process of FIG. 77.

The tone-generating process will be executed in accordance with the flow chart of FIG. 78. At step H1 of FIG. 78, CPU 1 judges that an indication switching flag is set at "1". When the indication switching flag is set at "1", CPU 1 judges that a switching timing has been reached, and executes an indication switching process at step H2.

Figure 79:
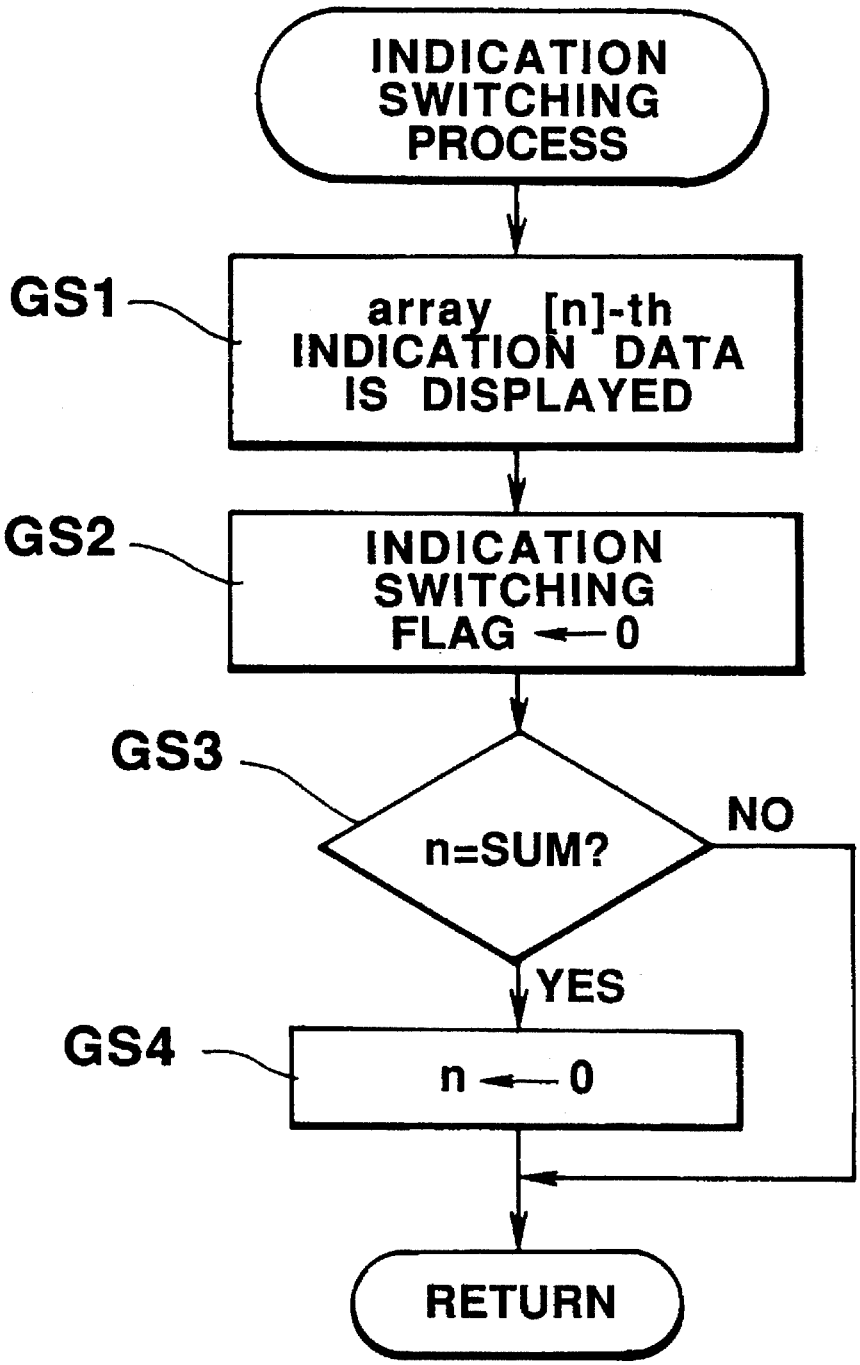
FIG. 79 is a flow chart of a detailed indication switching process.

The indication switching process will be executed in accordance with the flow chart of FIG. 79. At step GS1, indication data of the indication-number n is converted into indication reading out data, and is sent to the LCD unit 5. At the following step GS2, the indication switching flag is reset to "0". CPU 1 judges at step GS3 if the variable n is the maximum SUM. When the variable n is not the maximum SUM, CPU 1 finishes the process. When the variable n is the maximum SUM, CPU 1 resets the variable n to "0", finishing the indication-switching process at step GS4.

When the indication switching process is finished, CPU 1 returns to the tone-generating process of FIG. 78. CPU 1 transfers a value of the octave register OCR and a value of the key register KER to the tone-generating line at step H3. The performance data transferred to the tone-generating line are further transferred to the sound source 9. The sound source 9 produces a musical-tone waveform, and outputs the same through the sound system 18. Then, CPU 1 transfers and sets a value of the gate-time register GTR to the line-gate time register LGR at step H4, and prepares for controlling gate-time, finishing the tone-generating process.

When the tone-generating process is finished, CPU 1 returns to the step process of FIG. 77, again, finishing the step process.

When the step process is finished, CPU 1 returns to the main routine process of FIG. 75, again. CPU 1 judges at step S6 if a value of the step-time register STR is "FF", i.e., if the final data has been reached. When the value of the step-time register STR is not "FF", CPU 1 judges that a step time has not passed, and judges at step S7 if the stop switch 22 has been switched on. When the stop switch 22 has not been switched on, CPU 1 returns to step S4, where CPU 1 judges again if the step-time register STR has been set at "0". When the step-time register STR has been set at "0", CPU 1 executes the step process at step S5. When the step-time register STR has not been set at "0", CPU 1 judges at step S8 if a timing has been reached for generating a clock signal in the timer-clock process. When the timing has been reached for generating the clock signal, CPU 1 waits the timing for generating the clock signal, and decrements the step-time register STR at step S9 and further executes a beat process at step S10.

Figure 80:
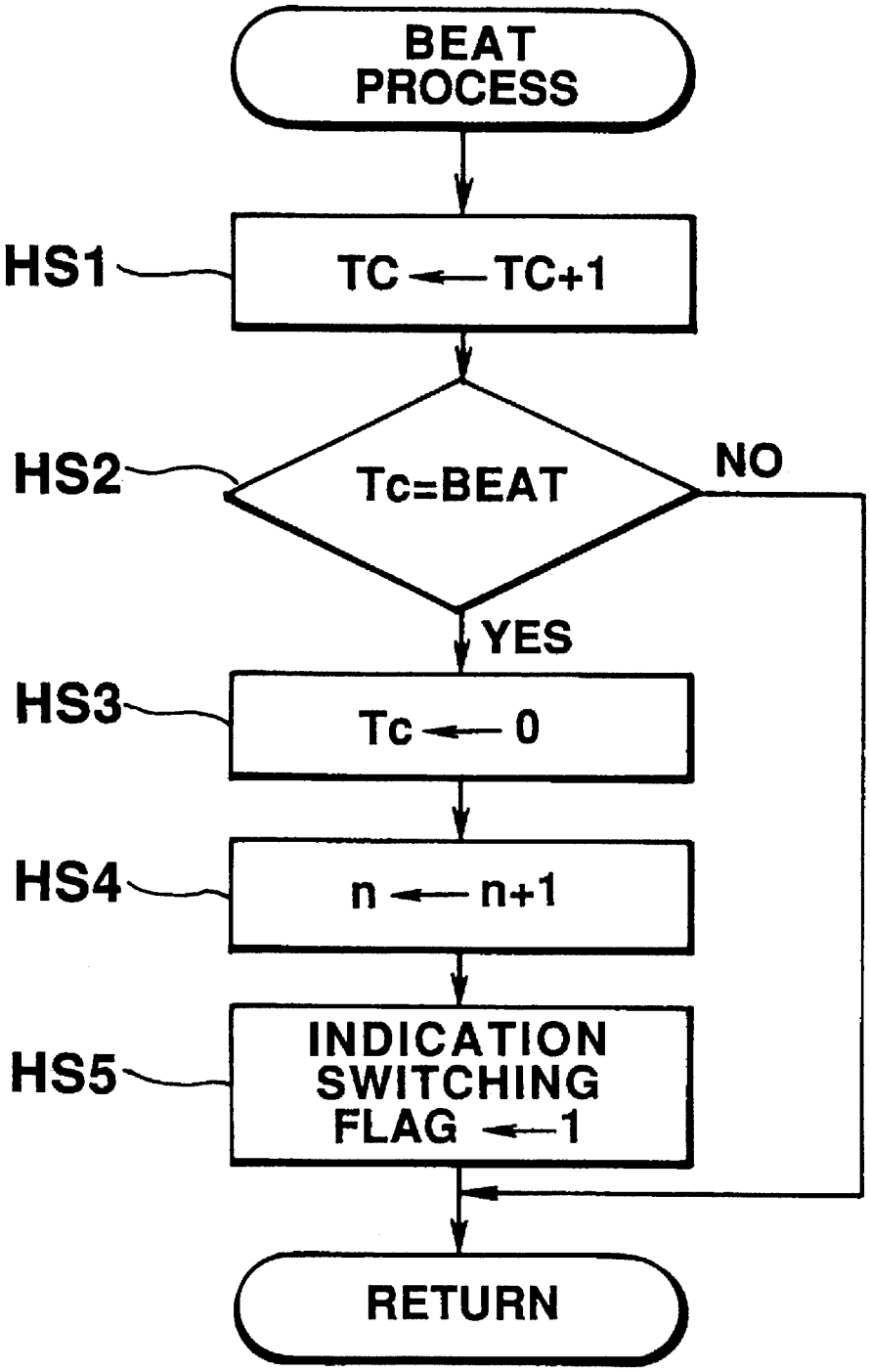
FIG. 80 is a flow chart of a beat process for switching indication data in association with beats of FIG. 75.

The beat process will be executed in accordance with the flow chart of FIG. 80.

The timing counter TC is incremented at step HS1, and it is judged at step HS2 if a value the timing counter TC is equivalent to the number of beats. When the value the timing counter TC is not equivalent to the number of beats, CPU 1 judges that the timing for switching the indication has not been reached, finishing the beat process. When the value of the timing counter TC has reach the number of timings of a beat, CPU 1 resets the timing counter TC to "0" at step HS3, and increments the variable n at step HS4. Then, CPU 1 sets the indication switching flag at "1", setting the timing for effecting the indication switching timing, and finishes the beat process at step HS5. As described above, the indication switching flag is set every timing of beat, and indication data are switched. As a result, the indication on the LCD unit 5 can be switched every beat.

When the beat process is finished, CPU 1 returns to the main routine process of FIG. 75, executing the following gate-time process at step S11.

Figure 81:
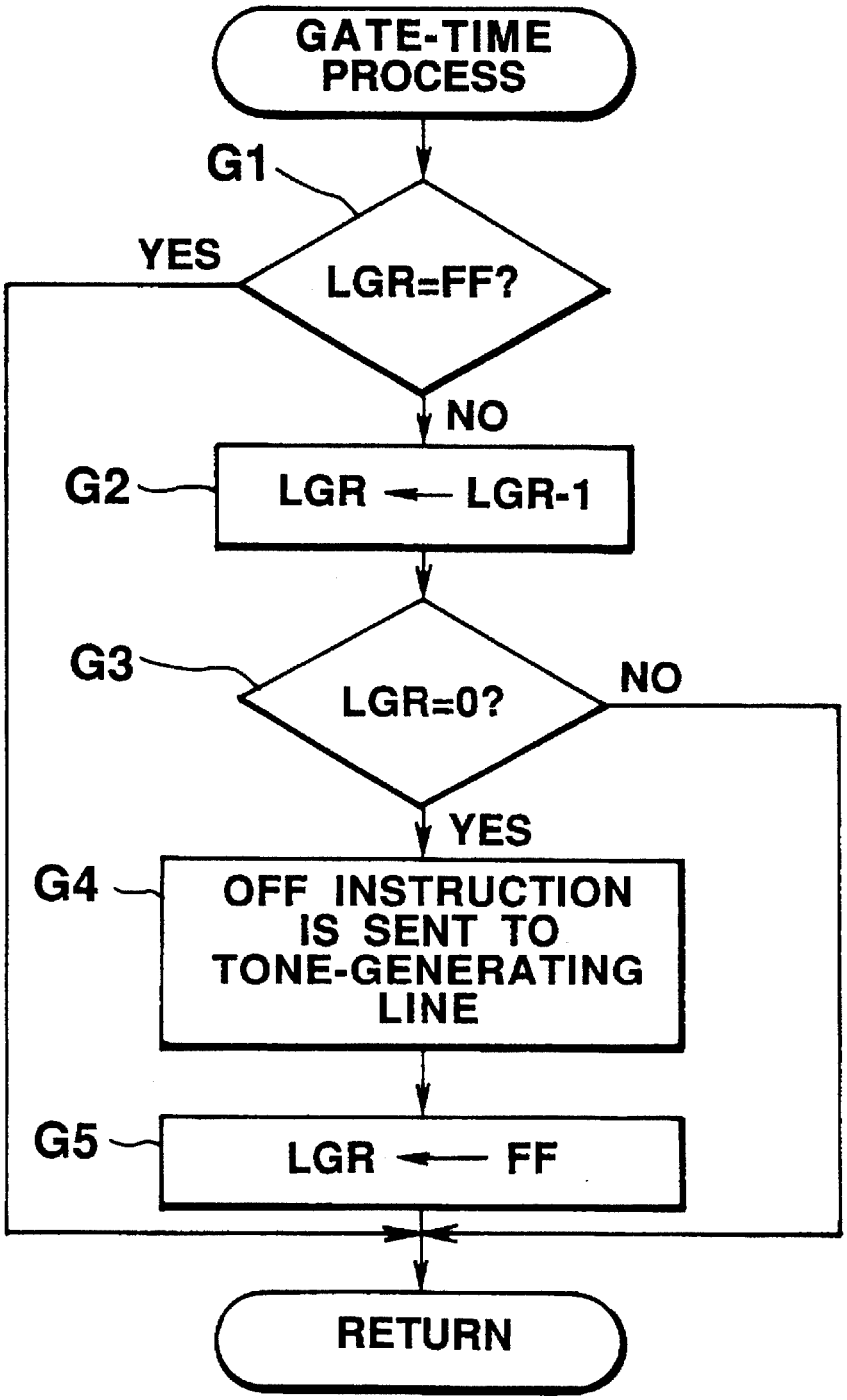
FIG. 81 is a flow chart of a detailed gate time process of FIG. 75.

The gate-time process will be executed in accordance with the flow chart of FIG. 81. It is judged at step G1 if the line gate-time register LGR is set at "FF". When the line gate-time register LGR is set at "FF", CPU 1 judges that the relevant tone-generating line is not on tone-generating operation, finishing the process. When the line gate-time register LGR is not set at "FF", CPU 1 decrements the line gate-time register LGR at step G2, and judges at step G3 if the line gate-time register LGR has reached "0". When the line gate-time register LGR is not at "0", CPU 1 judges that a tone-generating period has not passed, finishing the process. When the line gate-time register LGR is at "0", CPU 1 judges at step G4 that the tone-generating period has passed, sending an OFF instruction to the tone-generating line to make the line cease generating a tone, and sets "FF" to the line gate-time register LGR at step G5, finishing the gate-time process.

When the gate-time process is finished, CPU 1 goes to step S4 of the main routine process of FIG. 75. CPU 1 judges at step S4 if the step-time register STR is set at "0". The value of the step-time register STR is decremented every time when the timer-clock process is executed as described above. When the value of the step-time register STR has not reached "0", CPU 1 waits the timer-clock timing at step S8, and decrements the step-time register STR at step S9. Further, CPU 1 executes the beat process at step S10 and the gate-time process at step S11.

When it is judged at step S4 that the value of the step-time register STR is set at "0", CPU 1 executes the step process at step S5. In the step process at step S5, CPU 1 executes the tone-generating process and further executes the indication switching process at the indication switching timing. When the step process is finished, CPU 1 judges at step S6 if the step-time register STR has reached "FF". When it is judged that the step-time register STR has not reached "FF", i.e., when it is judged that a step time has not passed, CPU 1 judges at step S7 if the stop switch 22 has been switched on.

CPU 1 repeatedly executes the above processes, and executes the stop process at step S12, when the step-time register STR has reached "FF" or when the stop switch 22 is switched on.

Figure 82:
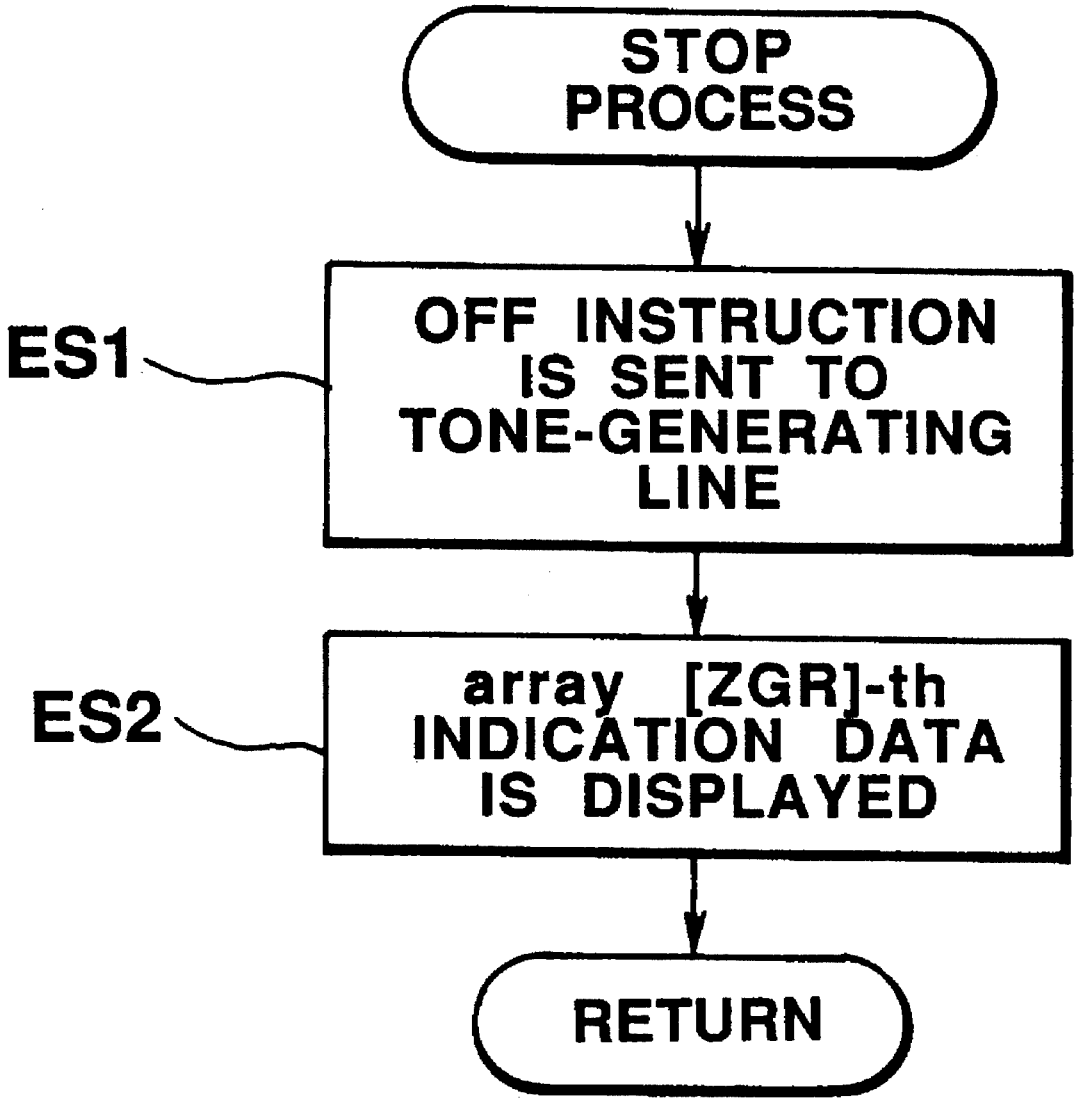
FIG. 82 is a flow chart of a detailed stop process of FIG. 75.

The stop process will be executed in accordance with the flow chart of FIG. 82. At step ES1, CPU 1 sends the OFF instruction to all the tone-generating lines in the sound source 9 to make them cease generating tones. In other words, CPU 1 sets "FF" to an end-flag register E to cease generation of all musical tones. CPU 1 reads out a value of the previous-indication register ZGR, and sends a display instruction at step ES2. More specifically, CPU 1 allows the indication to be displayed on the LCD unit 5, which indication was displayed on the LCD unit 5 when the start switch 21 was turned on for the first time, and finishes the stop process.

With the arrangement of the eighth embodiment, indication data can be sequentially switched to other indication data, as shown in FIGS. 43 to 56, every time CPU 1 detects the beat timings, and an image indication of a keyboard of a piano is completed finally. Indication data to be displayed on the LCD unit 5 can be switched based on the beats as performance data. Indications can be displayed on the LCD unit 5, which indications represent that beats of tune as being played change. The user therefore can learn from these indications on the unit 5 that the beat of the tune as being played has changed. Indications on the LCD unit 5 can be used more conveniently, and can be more attractive.

In the above embodiment, indication data are switched based on beats, but the indication data can be switched every measure, beat or strong beat, and the same indication can be displayed at every beat of a measure.

Now, the above cases will be described in detail. Process in which indication data is switched every time a measure of a tune changes will be executed in accordance with the flow chart of FIG. 83.

CPU 1 increments the timing counter TC at step HS11, and judges at step HS12 if a value of t timing counter TC corresponds to beat. When the value of the timing counter TC does not correspond to beat, CPU 1 judges that it is not an indication switching timing, finishing the beat process. When the value of the timing counter TC corresponds to beat, CPU 1 resets the timing counter TC to "0" at step HS13, and increments the variable m at step HS14. Then, CPU 1 judges at step HS14 if the variable m has reached the number of beats in a measure. When the variable m is not equivalent to the number of beats in a measure, CPU 1 judges that a timing for switching the indication has not been reached, finishing the process. When the variable m is equivalent to the number of beats in a measure, CPU 1 sets the variable m to "0" at step HS16, and increments the variable n at step HS17. Then, CPU 1 sets "1" to the indication switching flag at step HS18, finishing the beat process.

The indication on the LCD unit 5 can be switched every time a measure changes. Since the indication on the LCD unit 5 represents that a measure of a tune has changed, the user can learn from the indication that a measure of a tune has changed.

Figure 84:
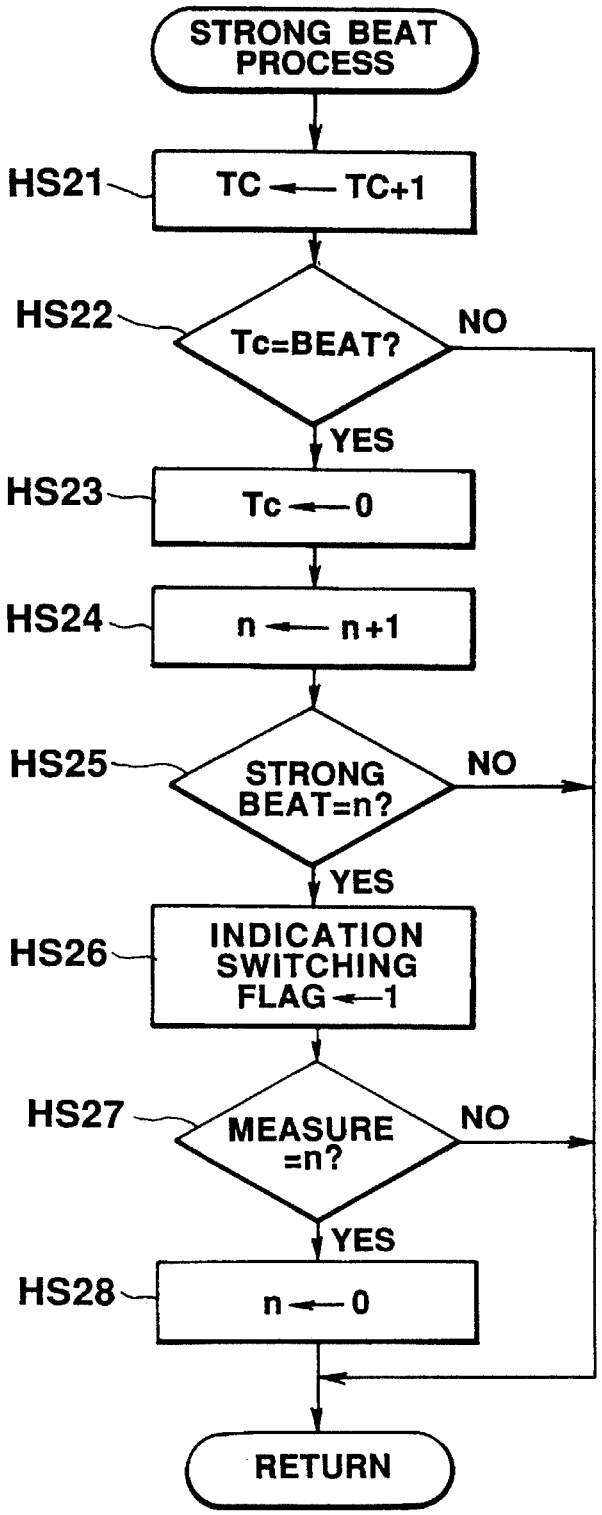
FIG. 84 is a flow chart of a detailed beat process to be executed when indication data is switched in association with strong beats.

A process in which indication data is switched every strong beat will be described with reference to the flow chart of FIG. 84.

CPU 1 increments the timing counter TC at step HS21, and judges at step HS22 if a value of t timing counter TC corresponds to the timing number of a beat. When the value of the timing counter TC does not correspond to the timing number of a beat, CPU 1 judges that it is not an indication switching timing, finishing the beat process. When the value of the timing counter TC corresponds to the timing number of a beat, CPU 1 resets the timing counter TC to "0" at step HS23, and increments the variable n at step HS24. Then, CPU 1 judges at step HS25 if the variable n corresponds to strong beats. When the variable n corresponds to strong beats, CPU 1 judges that a timing for switching the indication has not been reached, finishing the process. When the variable n corresponds to strong beats, CPU 1 sets "1" to the indication-switching flag at step HS26, and judges at step HS27 if the variable n corresponds to the number of beats in a measure. When the variable n does not correspond to the number of beats in a measure, CPU 1 finishes the process. When the variable n corresponds to the number of beats in a measure, CPU 1 sets the variable n at "0" at step HS28, finishing the beat process.

The indication on the LCD unit 5 can be switched every strong beat. Since the indication on the LCD unit 5 indicates timings of strong beats, the user can learn the timings of strong beats from the indication.

Figure 85:
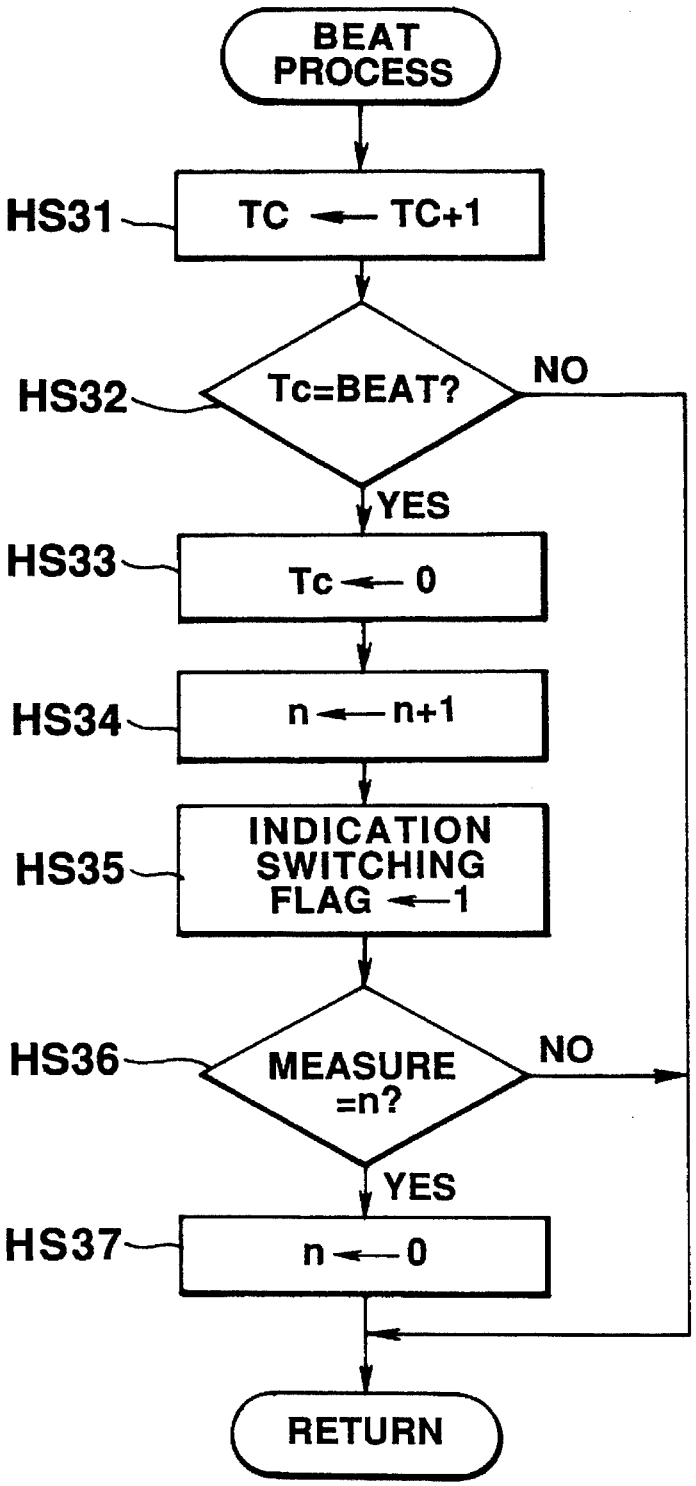
FIG. 85 is a flow chart of a detailed beat process to be executed when the same indication data is indicated at respective beats in a measure in association with beats.

A process in which indication data is switched every measure and the same indication is displayed at respective beats of a tune will be described with reference to FIG. 85.

CPU 1 increments the timing counter TC at step HS31, and judges at step HS32 if a value of t timing counter TC corresponds to the timing number of a beat. When the value of the timing counter TC does not correspond to the timing number of a beat, CPU 1 judges that it is not an indication switching timing, finishing the beat process. When the value of the timing counter TC corresponds to the timing number of a beat, CPU 1 resets the timing counter TC to "0" at step HS33, and increments the variable n at step HS34. Then, CPU 1 sets "1" to the indication-switching flag at step HS35, and judges at step HS36 if the variable n corresponds to the number of beats in a measure. When the variable n does not correspond to the number of beats in a measure, CPU 1 finishes the beat process. When the variable n corresponds to the number of beats in a measure, CPU 1 sets the variable n at "0" at step HS37, allowing the variable n to start from "0", such that the same indication data is read out from the first every measure, and finishes the beat process.

The indication data can be switched every strong beat, and the same indication data is read out every beat in a measure. The indication on the LCD unit 5 indicates that the measures of a tune are switched. The user can learn from the indication that at what beat of respective measures of a tune the tune is being played.

FIGS. 86 to 90 are views illustrating the ninth embodiment of the automatic playing apparatus with a display unit of the invention. In the above eighth embodiment, CPU counts timings to detect beats, switching indication data while, in the ninth embodiment, CPU switches indication data based on the switching data which are combined into performance data at every beat.

The present embodiment is applied to an electronic musical instrument. In the present embodiment, like components as those in the eighth embodiment are designated by like reference numerals, and their description will be omitted.

In the present embodiment, octave data, key-number data, step-time data and gate-time data are stored as performance data in the automatic performance-data memory unit 2. As shown in the previous figures, switching data of one byte, all the bit data in which byte are set at "1", are stored in the embodiment. CPU 1 is provided with various registers and counters shown in FIGS. 20, 21 and 70 to 74.

Figure 86:
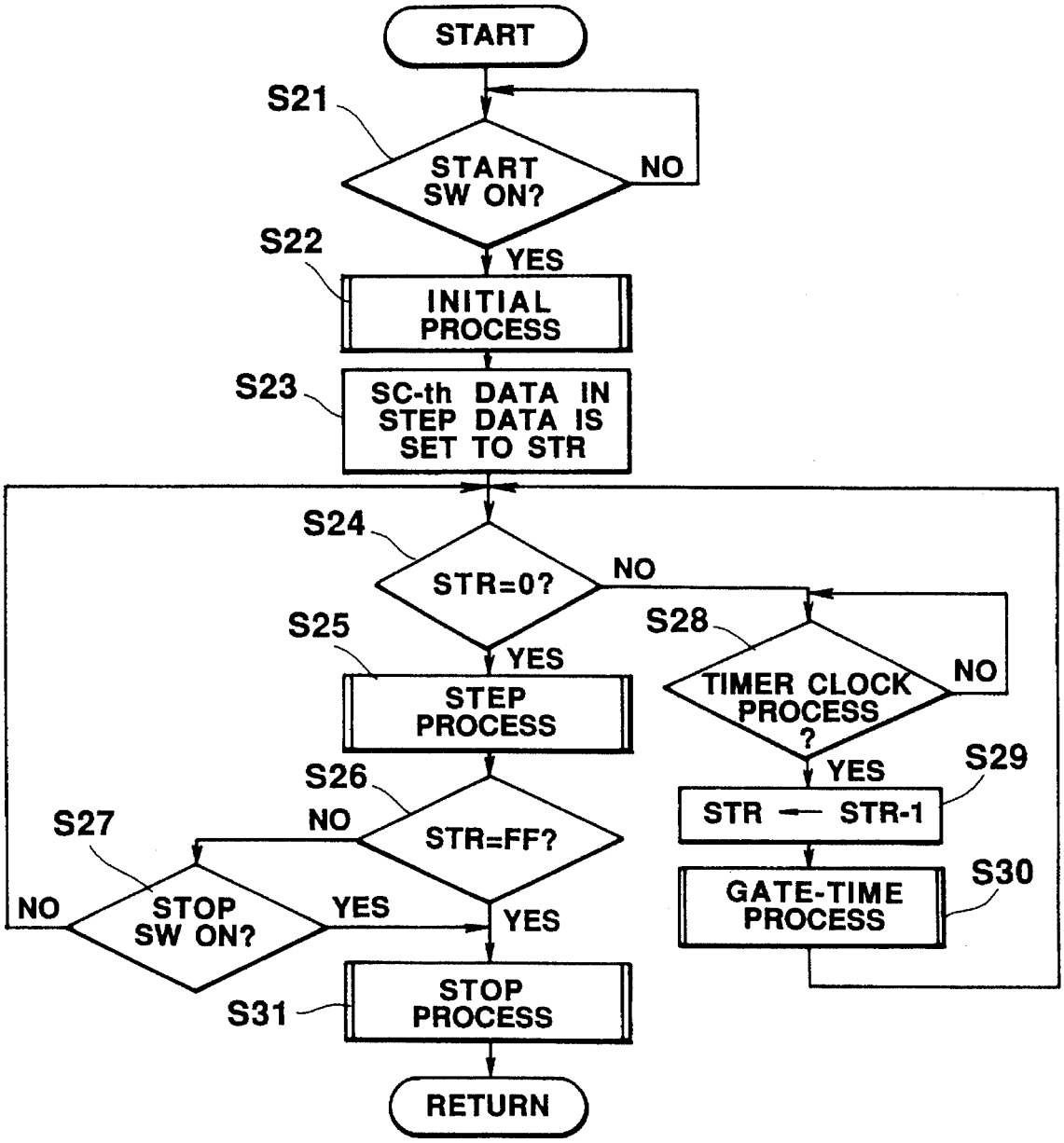
FIG. 86 is a flow chart of a main routine process in a ninth embodiment.
Figure 87:
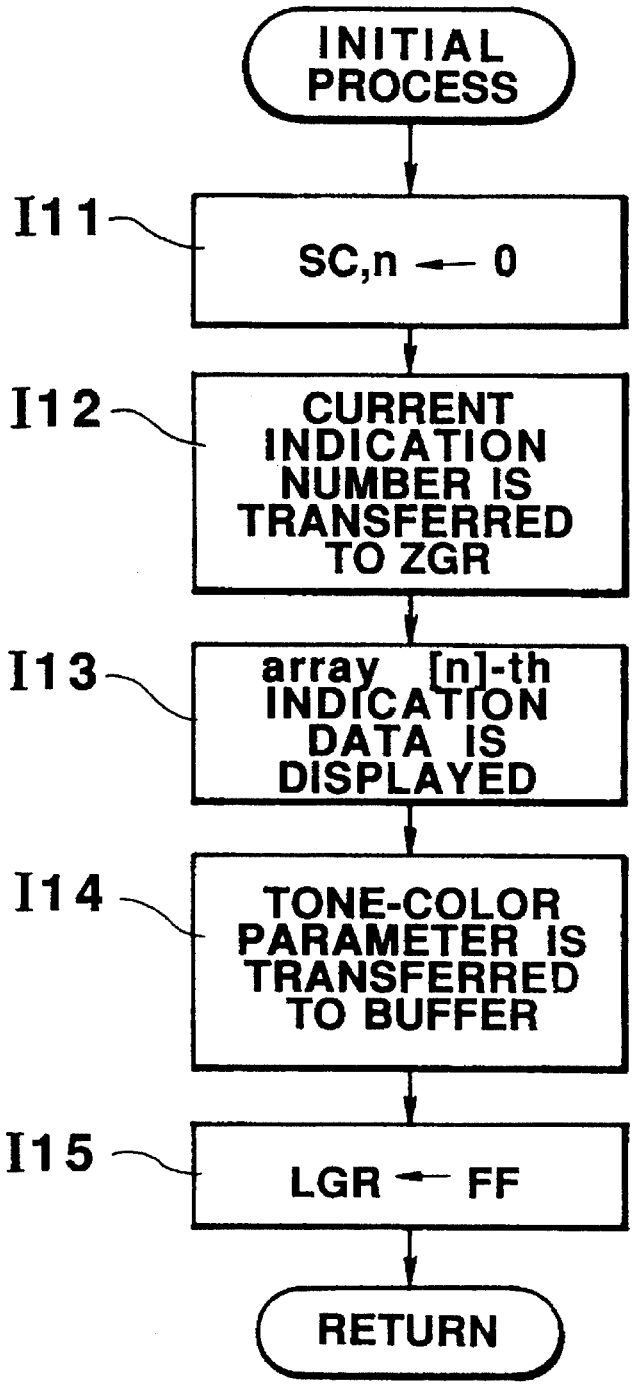
FIG. 87 is a flow chart of a detailed initial process of FIG. 86.

CPU 1 of the present embodiment will executes the main routine in accordance with the flow chart of FIG. 86.

When the power of the electronic musical instrument is turned on and the start switch 21 is switched on at step S21, CPU 1 executes an initial process at step S22.

In the initial process, CPU 1 sets an initial value "0" to the step counter SC and to a variable n, and initializes performance data of respective channels at step Ill for performing performance. At step Ill, the timing counter TC is not initialized. Because the timing counter TC is not used to detect beats, and the beats are detected based on switching data. An indication number of a current indication is transferred and set to the previous-indication register ZGR in CPU 1 at step I12. In other words, an indication number of an indication which is displayed on the LCD unit 5 when the start switch 21 is turned on is transferred and set to the previous-indication register ZGR at step I12. At step I13, n-th indication data is displayed, i.e., data stored at array [n] of the display-image memory unit 4, where n=0, is read out and displayed on the LCD unit 5. Then, tone-color parameter is read out form the tone-color parameter memory unit 6 and is transferred to the tone-color parameter buffer 10 of the sound source 9 at step I14. CPU 1 sets "FF" to the line-gate time register LGR at step I15, finishing the initial process.

When the initial process is finished, CPU 1 returns to the main routine process of FIG. 86. CPU 1 sets SCth data (an initial data) in step data to the step-time register STR, and increments the step counter SC at step S23. CPU 1 judges at step S24 if the step-time register STR is set at "0", i.e., if a step time has passed. When the step-time register STR is set at "0", CPU 1 executes the step process at step S25.

Figure 88:
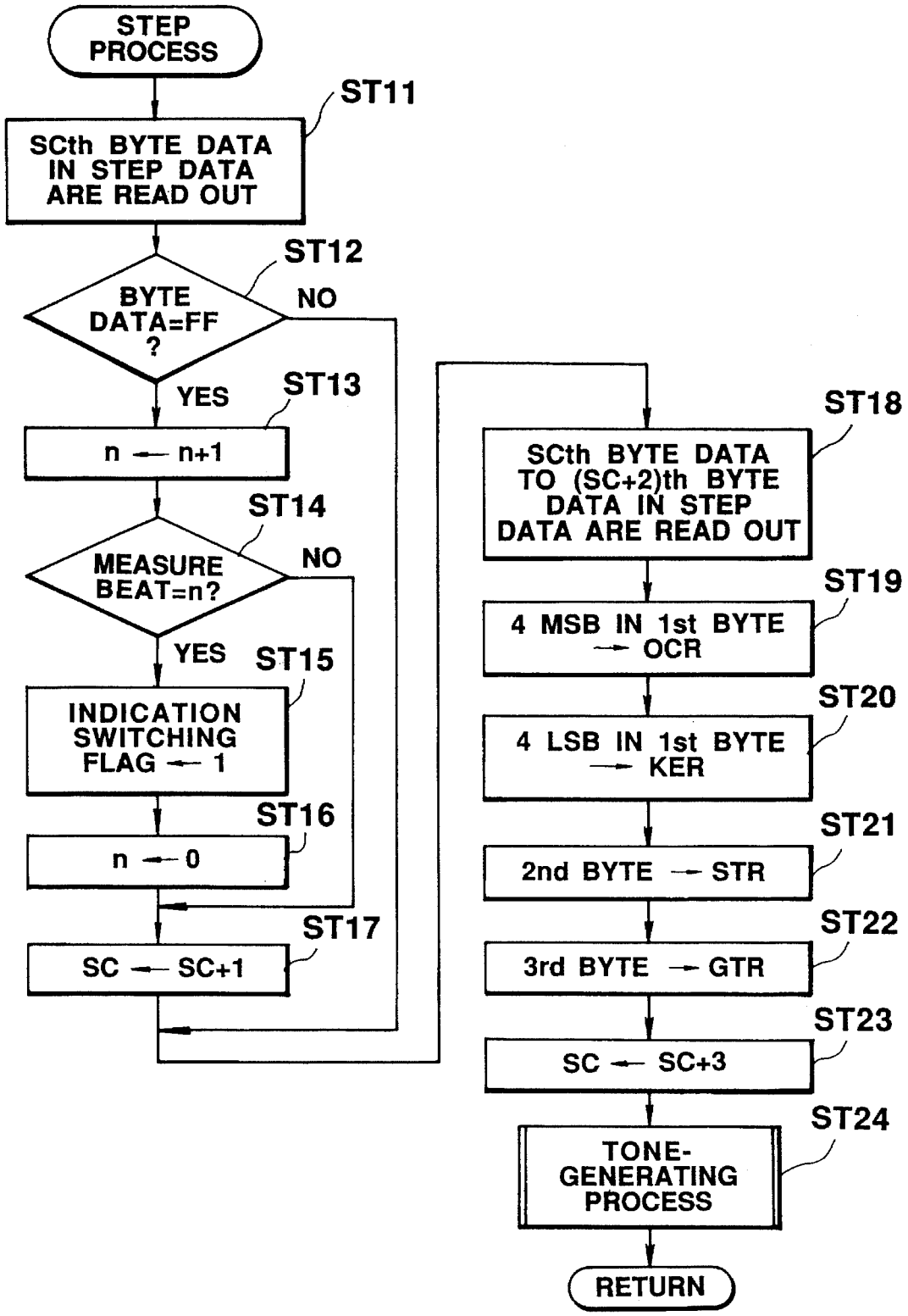
FIG. 88 is a flow chart of a step process of FIG. 86 to be executed when indication data is switched every measure.
Figure 89:
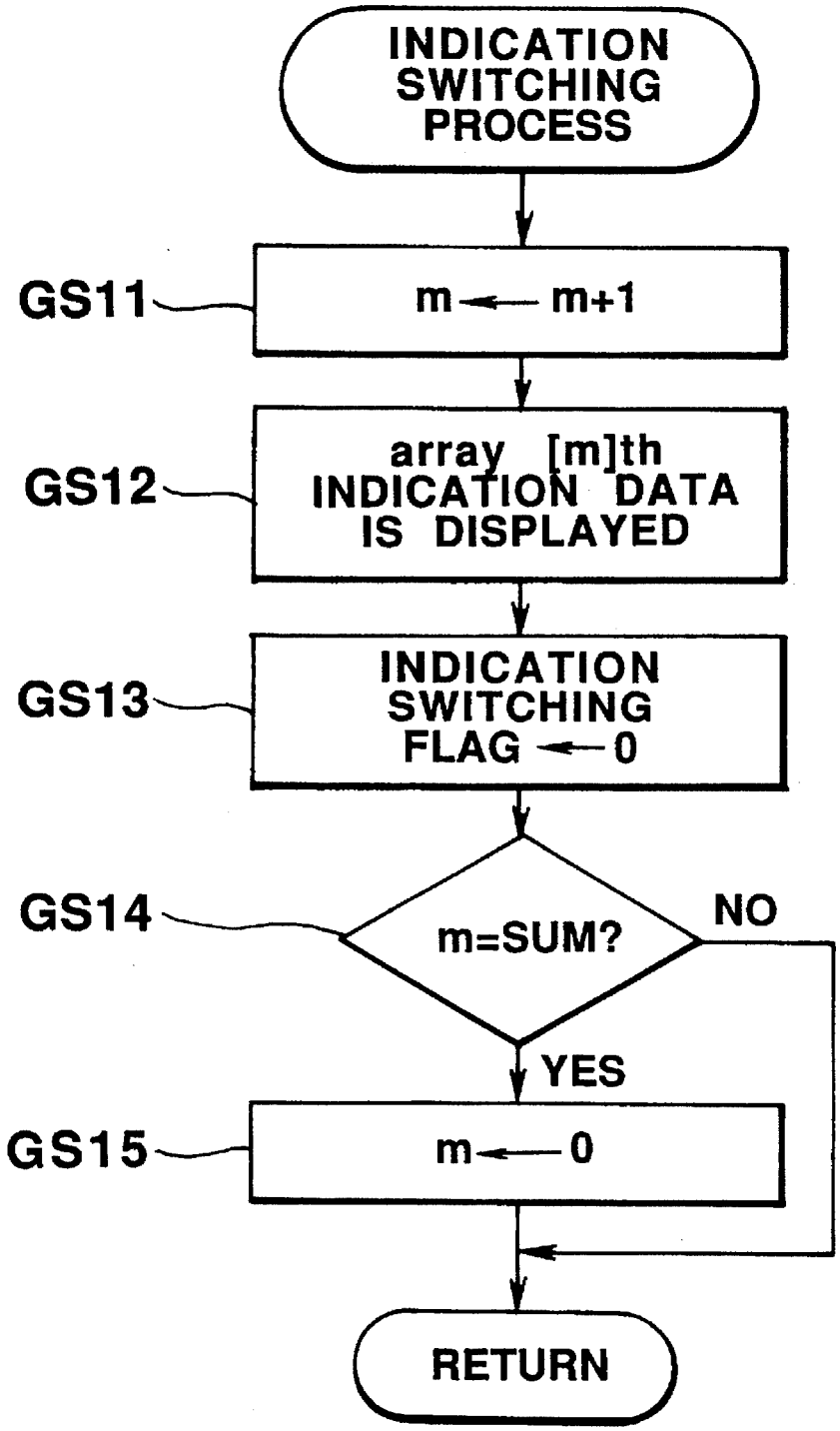
FIG. 89 is a flow chart of a detailed indication switching process of the ninth embodiment.

The step process will be executed in accordance with the flow chart of FIG. 88. CPU 1 reads out data at SCth byte in step data at step ST11, and judges at step ST12 if the read out byte data is "FF". When the read out byte data is "FF", CPU 1 judges that the read out byte data is switching data (see FIG. 57). CPU 1 increments the variable n at step ST13, and judges at step ST14 if the variable n corresponds to the number of beats in a measure. When the variable n corresponds to the number of beats in a measure, CPU 1 judges that an indication switching timing has been reached, and sets the indication switching flag at "1" at step ST15 and resets the variable n to "0" at step ST16.

CPU 1 increments the step counter SC at step ST17, and reads out data at SCth byte to (SC+2)th byte in step data, i.e., performance data shown in FIGS. 32 to 34, at step ST18.

Meanwhile, when the read out data at SCth byte is not "FF", CPU 1 judges that the read out byte data is not switching data, and goes to step ST18, where CPU 1 reads out performance data. When the variable n does not correspond to the number of beats in a measure, CPU 1 judges that it is not an indication switching timing, and increments the step counter SC. Then, CPU 1 reads performance data at step ST18.

A process for setting read out performance data to the relevant registers will be executed at steps ST19 to ST22. More specifically, data of 4 more significant bits in the first byte of the read out performance data, i.e., octave data (see FIG. 32) are transferred to the octave register OCR at step ST19 while data of 4 less significant bits in the first byte of the performance data, i.e., key-number data (see FIG. 32) are transferred to the key register KER at step ST20. The second byte data, i.e., step-time data (see FIG. 33) are transferred to the step-time register STR at step ST21. Finally, the third byte data, i.e., gate-time data (see FIG. 34) are transferred to the gate-time register GTR at step ST22. When a register setting process is finished, the step-counter SC advances a pointer of data step by "3". When a process for the step counter SC is finished, CPU 1 performs the tone-generating process at step ST24, and finishes the step process.

The tone-generating process is similar to the tone-generating process of FIG. 78, and the description thereof will be omitted. But an indication switching process in the tone-generating process will be executed in accordance with the flow chart of FIG. 89.

In the indication-switching process, CPU 1 increments the variable m at step GS11. At step GS12, indication data of the indication-number m is converted into indication reading out data, and is sent to the LCD unit 5. At the following step GS13, the indication switching flag is reset to "0". CPU 1 judges at step GS3 if the variable m takes the maximum SUM. When the variable n is not the maximum SUM, CPU 1 finishes the process. When the variable m is the maximum SUM, CPU 1 resets the variable m to "0", finishing the indication-switching process at step GS15.

When the indication switching process is finished, CPU 1 returns to the tone-generating process of FIG. 78, executing the tone-generating process.

When the tone-generating process is finished, CPU 1 returns to the step process of FIG. 88, and when the tone-generating process is finished, the step process is finished.

When the step process is finished, CPU 1 returns to the main routine process of FIG. 86, again. CPU 1 judges at step S26 if a value of the step-time register STR is "FF", i.e., if the final data has been reached. When the value of the step-time register STR is not "FF", CPU 1 judges that a step time has not passed, and judges at step S27 if the stop switch 22 has been switched on. When the stop switch 22 has not been switched on, CPU 1 returns to step S24, where CPU 1 judges again if the step-time register STR has been set at "0". When the step-time register STR has been set at "0", CPU 1 executes the step process at step S25. When the step-time register STR has not been set at "0", CPU 1 judges at step S28 if a timing has been reached for generating a timer-clock signal in the timer-clock process. When the timing has been reached for generating the timer-clock signal, CPU 1 waits the timing for generating the timer-clock signal, and decrements the step-time register STR at step S29 and further executes a gate-time process at step S30.

The gate-time process is similar to the process shown in FIG. 81, and further explanation thereof will be omitted.

When the gate-time process is finished, CPU 1 goes to step S24 of the main routine process of FIG. 75. CPU 1 judges again at step S24 if the step-time register STR has reached "0". The value of the step-time register STR is decremented every time when the timer-clock process is executed as described above. When the value of the step-time register STR has not reached "0", CPU 1 waits the timer-clock timing at step S28, and decrements the step-time register STR at step S29. Further, CPU 1 executes the gate-time process at step S30.

When it is judged at step S24 that the value of the step-time register STR has reached "0", CPU 1 executes the step process at step S25. In the step process at step S25, CPU 1 executes the tone-generating process and further executes the indication switching process at the indication switching timing. When the step process is finished, CPU 1 judges at step S26 if the step-time register STR has reached "FF". When it is judged that the step-time register STR has not reached "FF", i.e., when it is judged that a step time has not passed, CPU 1 judges at step S27 if the stop switch 22 has been switched on.

CPU 1 repeatedly executes the above processes, and executes the stop process at step S31, when the step-time register STR has reached "FF" or when the stop switch 22 is switched on.

The stop process will be executed in a similar manner to that executed in accordance with the flow chart of FIG. 82, and further explanation thereof is omitted.

With the above arrangement of the present embodiment, beats are detected based on the switching data which are inserted into performance data for respective beats, and indication data is switched when the detected beat is a measure beat. As a result, indication data is switched to other indication data every measure beat. The user can learn from the indication on the LCD unit 5 that a measure changes to other measure.

When indication data is switched based on switching data, the indication data may be switched not only every measure but also, for example, every beat.

Figure 90:
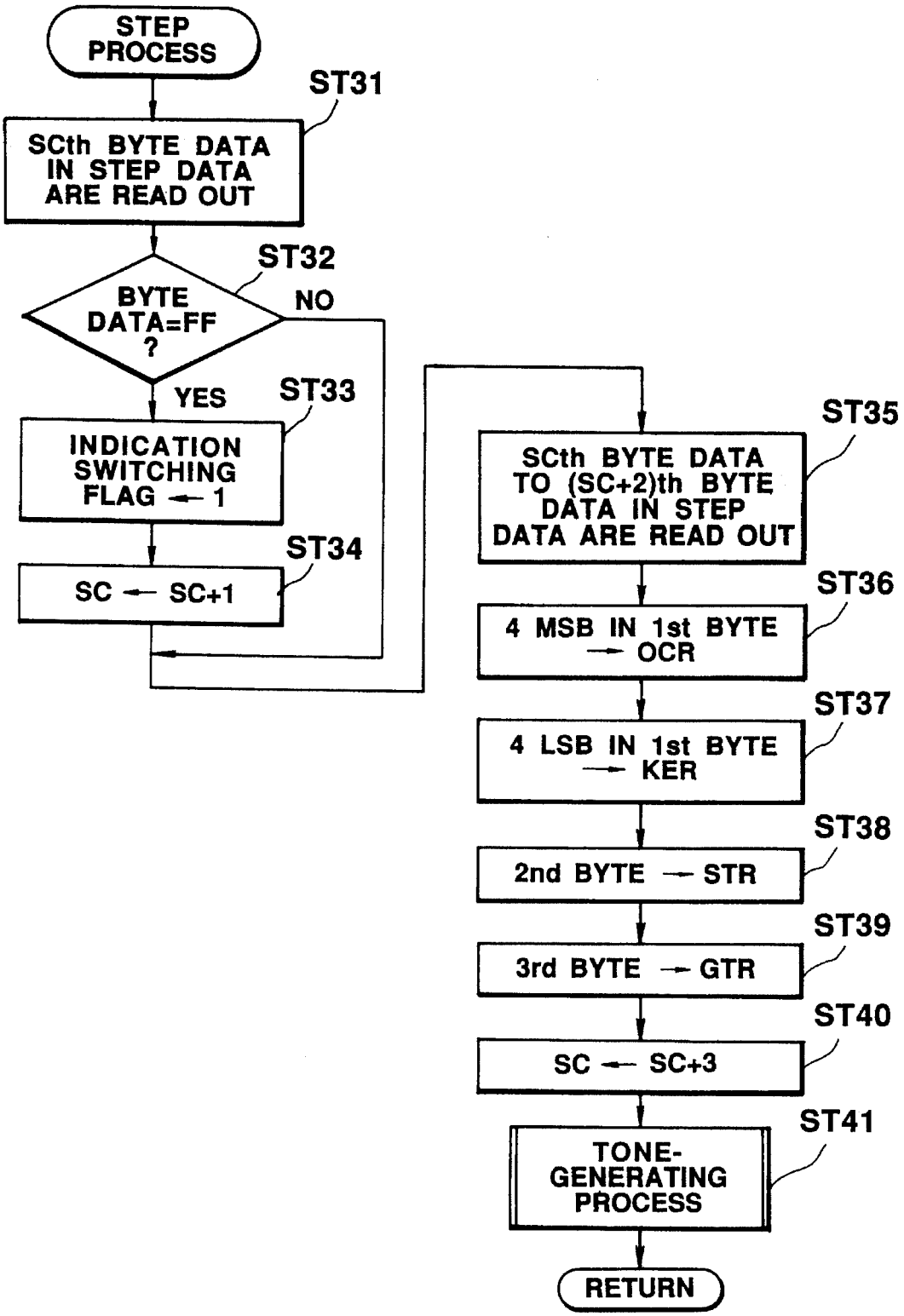
FIG. 90 is a flow chart of a detailed step process of FIG. 87 to be executed when indication data is switched every beat.

The indication data can be switched every beat in the step process of FIG. 90.

The step process will be executed in accordance with the flow chart of FIG. 90. CPU 1 reads out data at SCth byte in step data at step ST31, and judges at step ST32 if the read out byte data is "FF". When the read out byte data is "FF", CPU 1 judges that the read out byte data is switching data and it is a timing for switching the indication on the LCD unit 5. CPU 1 sets the indication switching flag at "1" at step ST33, and increments the step counter SC at step ST34. CPU 1 reads out data at SCth byte to (SC+2)th byte in step data, i.e., performance data shown in FIGS. 32 to 34, at step ST35.

Meanwhile, when the read out data at SCth byte is not "FF", CPU 1 judges that the read out byte data is not switching data, and goes to step ST35, where CPU 1 reads out performance data.

A process for setting read out performance data to the relevant registers will be executed at steps ST36 to ST39. More specifically, data of 4 more significant bits in the first byte of the read out performance data, i.e., octave data (see FIG. 32) are transferred to the octave register OCR at step ST36 while data of 4 less significant bits in the first byte of the performance data, i.e., key-number data (see FIG. 32) are transferred to the key register KER at step ST37. The second byte data, i.e., step-time data (see FIG. 33) are transferred to the step-time register STR at step ST38. Finally, the third byte data, i.e., gate-time data (see FIG. 34) are transferred to the gate-time register GTR at step ST39. When the register setting process is finished, the step-counter SC advances a pointer of data step by "3". When a process for advancing the step counter SC is finished, CPU 1 performs the tone-generating process at step ST41, and finishes the step process.

The tone-generating process is similar to the tone-generating process of FIG. 78, and the description thereof will be omitted. The indication switching process to be executed in the tone-generating process will be executed in accordance with the flow chart of FIG. 89.

With the arrangement of the present embodiment, switching data for every beat inserted into performance data allow indication data to be switched every beat, and the user can learn form the indications on the LCD unit 5 a way of advancement of beats.

FIGS. 91 to 94 are views illustrating the tenth embodiment of the present invention. The present embodiment is applied to an electronic musical instrument which can be played as a hi-hat cymbals.

In the present embodiment, like components as those in ninth embodiment are designated by like reference numerals, and their description is omitted. The sound source 9 of the present embodiment is provided with seven tone-generating units, and the counter 8 has seven counting functions for effecting counting operation for respective tone-generating lines.

In the present embodiment, the automatic performance-data memory unit 2 stores as performance data tone-color data, velocity data, octave data, key-number data, step-time data and gate-time data shown in FIGS. 31 to 34.

CPU 1 is provided with the tone-color register TNR (FIG. 18), velocity register VER (FIG. 19), octave register OCR (FIG. 20), key register (FIG. 21), step-time registers STR0 to STR6 (FIG. 22), gate-time registers GTR0 to GTR6 (FIG. 23), step counters SC0 to SC6 (FIG.24), previous indication register ZGR (FIG. 25), tone-generation line register n (FIG. 26), indication-number register G (FIG. 27), line gate-time register LGR0 to LGR6 (FIG. 28) and end-flag register E (FIG. 29), which are used to perform automatic playing operation, and are used to execute an indication process in association with beats of a hi-hat line.

Figure 91:
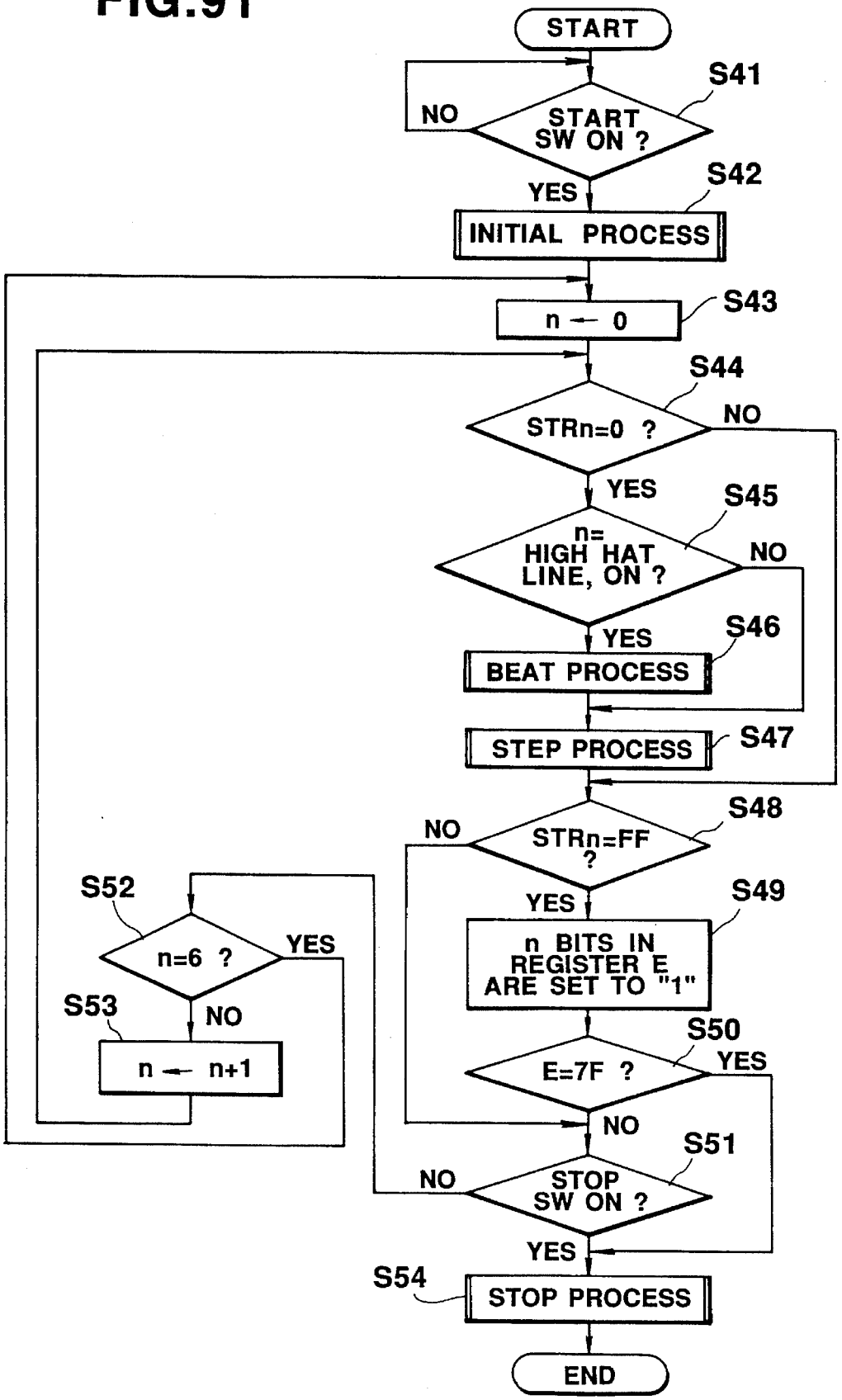
FIG. 91 is a flow chart of a main process of a tenth embodiment.

The main routine process of the present embodiment will be executed in accordance with the flow chart of FIG. 91.

When the power of the electronic musical instrument is turned on and the start switch 21 is switched on at step S41, CPU 1 executes the initial process at step S42.

Figure 92:
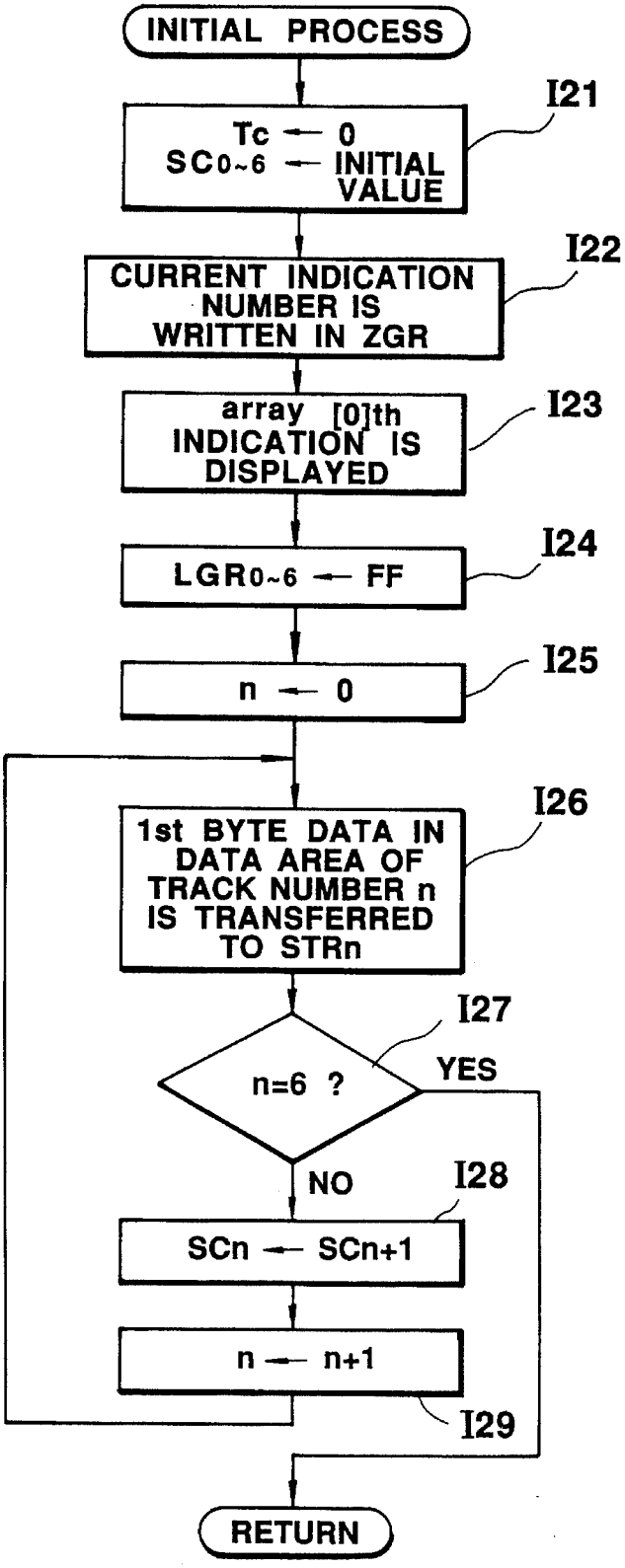
FIG. 92 is a flow chart of a detailed initial process of FIG. 91.

The initial process will be executed in accordance with the flow chart of FIG. 92. CPU 1 resets the timing counter TC to "0", the initial value is set to the step counters SC 0 to SC 6, and performance data for respective channels are initialized to execute a preparing process for performance at step I21. An indication number of a current indication is transferred and set to the previous-indication register ZGR, i.e., an indication number of an indication which is displayed on the LCD unit 5 when the start switch 21 is turned on is transferred and set to the previous-indication register ZGR at step I22. An indication of 0-th indication data or an indication of the initial indication data is displayed at step I23. More specifically, data at array [0]-th area in the automatic performance-data memory unit 2 are read out and displayed on the LCD unit 5 at step I23. At step I24, a value FF is set to the line-gate time registers LGR 0 to LGR 6, and a variable n is reset to "0" at step I25. Data stored at the first byte memory area for a track of track number n are transferred to the step-time register STR n at step I26. It is judged at step I27 if a variable n has reached "6". When the variable n has not reached "6", CPU 1 judges that processes for all channels have not been finished. Then, CPU 1 increments the step counter SC n at step I28. Further, CPU 1 increments the variable n and returns to step I26. Data stored at the first byte memory area for the track of the incremented track number are transferred to the step-time register STRn. CPU 1 judges if the variable n has reached to "6". When the variable n has not reached to "6", CPU 1 increments the step counter SCn and the variable n, and further repeatedly executes the processes. When it is judged at step I27 that the variable n has reached to "6", the initial process is finished.

When the initial process is finished, CPU 1 returns to the main routine process of FIG. 91. CPU 1 sets the variable n at "0" at step S43, and judges at step S44 if the step-time register STRn has reached to "0", i.e., if a step time of the tone-generating line has passed. When the step-time register STRn has reached to "0", CPU judges at step S45 if the variable n corresponds to a hi-hat line and hi-hat-on is raised. When the variable n corresponds to the hi-hat line and the line is to generate tones, CPU 1 executes a beat process at step S46.

Figure 93:
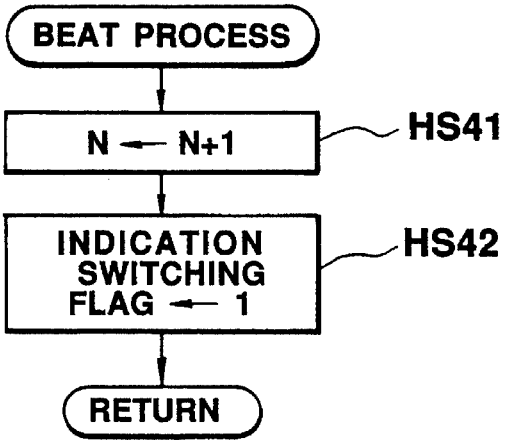
FIG. 93 is a flow chart of a detailed beat process of FIG. 91.

The beat process is executed in accordance with the flow chart of FIG. 93. CPU 1 increments a variable N at step HS41, and set the indication-switching flag at "1" at step HS42.

When the beat process is finished, CPU 1 returns to the main routine process, and performs a step process at step S47.

The step process will be performed. CPU 1 reads out data (performance data) of SCn-th byte to (SCn+ 3)th byte in step data, and sets the read out performance data to registers (a register-setting process).

The register-setting process will be performed in accordance with the flow chart of FIG. 38. Data of 4 more significant bits in the first byte, i.e., tone-color data (see FIG. 31) are transferred to the tone-color register TNR at step RS1 while data of 4 less significant bits in the first byte, i.e., velocity data (see FIG. 31) are transferred to the velocity register VER at step RS2. Data of 4 more significant bits in the second byte, i.e., octave data (see FIG. 32) are transferred to the octave register OCR at step RS3 while data of 4 less significant bits in the second byte, i.e., key-number data (see FIG. 32) are transferred to the key register KER at step RS4. Data in the third byte, i.e., step-time data (see FIG. 33) are transferred to the step-time register STR of the relevant channel at step RS5 while data in the fourth byte, i.e., gate-time data (see FIG. 34) are transferred to the gate-time register GTR of the relevant channel at step RS6.

When the register-setting process is finished, CPU 1 returns to the step process of FIG. 37. CPU 1 advances a step-data pointer of the step counter SCn by "3" for the following process. Then, a tone-generating process is performed, and the step process is finished.

Figure 94:
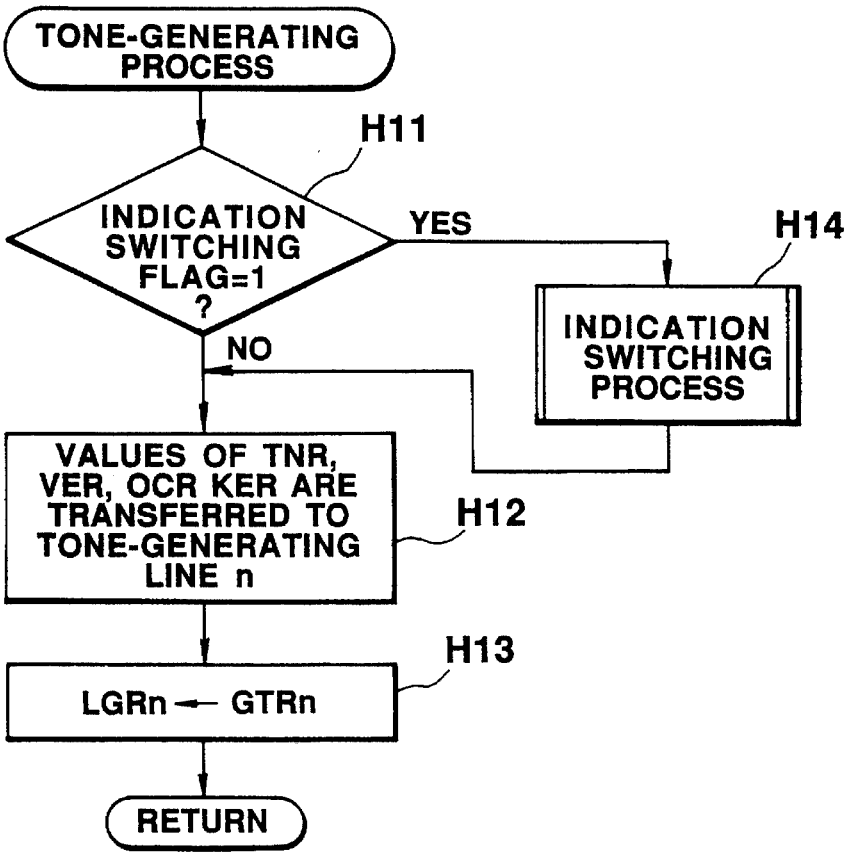
FIG. 94 is a flow chart of a detailed tone-generation process of FIG. 91.

The tone-generating process will be executed in accordance with the flow chart of FIG. 94. At step H11 of FIG. 94, CPU 1 judges that an indication-switching flag is set at "1". When the indication-switching flag is not set at "1", CPU 1 transfers a value of the tone-color register TNR and a value of the velocity register VER, a value of the octave register OCR and a value of the key register KER to the tone-generating line at step H12. The performance data transferred to the tone-generating line n are further transferred to the sound source 9. The sound source 9 produces a musical-tone waveform, and outputs the same through the sound system 18. Then, CPU 1 transfers and sets a value of the gate-time register GTRn to the line-gate time register LGRn at step H13, and prepares for controlling gate-time, finishing the tone-generating process.

Meanwhile, when it is judged at step H11 that the indication switching flag is set at "1", CPU 1 judges that a switching timing has been reached, and executes an indication switching process at step H14.

Figure 83:
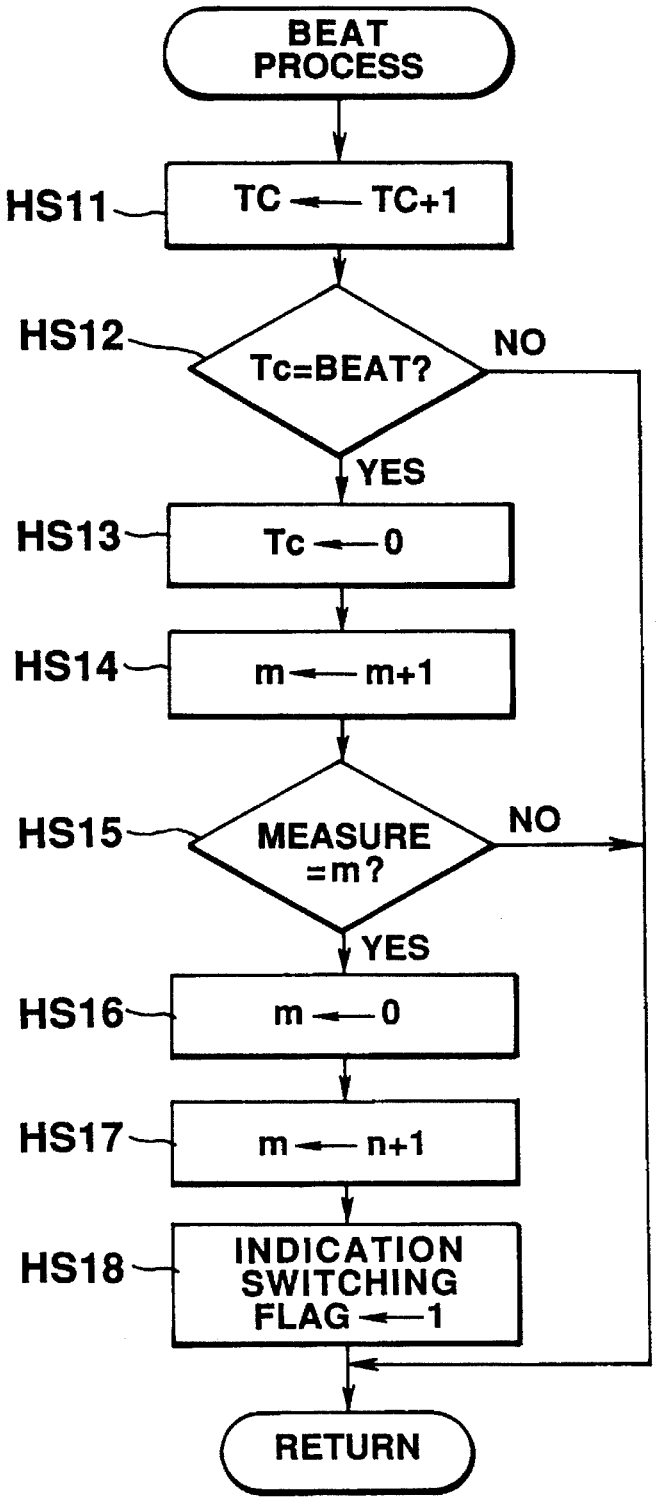
FIG. 83 is a flow chart of a detailed beat process to be executed when indication data is switched in association with measures.

The indication switching process will be executed in accordance with the flow chart of FIG. 83. At step GS31, indication data of the indication-number M is converted into indication reading out data, and is sent to the LCD unit 5. At the following step GS32, the indication switching flag is reset to "0". CPU 1 judges at step GS33 if the variable M is the maximum SUM. When the variable M is not the maximum SUM, CPU 1 finishes the process. When the variable M is the maximum SUM, CPU 1 resets the variable M to "0", finishing the indication-switching process at step GS34.

When the indication switching process is finished, CPU 1 returns to the tone-generating process of FIG. 94. CPU 1 transfers a value of the tone-color register TNR, a value of the velocity regiseter VER, a value of the octave register OCR and a value of the key register KER to the tone-generating line n at step H12, and further transfers a value of the gate-time register GTRn to the line gate-time register LGRn at step H13, finishing the tone-generating process.

When the tone-generating process is finished, CPU 1 returns to the step process, finishing the step process.

When the step process is finished, CPU 1 returns to the main routine process of FIG. 91. CPU 1 judges at step S48 if a value of the step-time register STRn is set at "FF", i.e., if the final data has been reached. The line gate-time register LGRn enters a timer interrupt service caused by a given clock signal from the timer clock signal generating circuit CK, and is subjected to a subtracting operation during the main routine process. The timer interrupt service is similar to the service shown in FIG. 41.

When the timer interrupt service is effected, a value of the step-time register STRn is subjected to a subtracting operation. It is judged at steps S44 and S48 of the main routine process of FIG. 91 if the value of the step-time register STRn is "FF". When the value of the step-time register STRn is not "FF", i.e., when the relevant tone-generating line has not finished a playing operation, CPU 1 goes to step S51, where it judges if the stop switch 22 has been switched on. When the stop switch 22 has not been switched on, it is judged at step S52 if a tone-generating line n is "6", i.e., if the main routine process has been executed on all the tone-generating lines. When the tone-generating line n is not "6", CPU 1 increments a value of the tone-generating line n, and returns to step S44.

When it is judged at step S52 that the tone-generating line n is "6", CPU 1 returns to step S43, where it resets the tone-generating line n to "0", and judges at step S44 if the step-time register STRn is "0".

When the step-time register STRn has reached a value "FF" at step S48, CPU 1 judges that a step time has passed, and sets a value "1" to n-th bit corresponding to the tone-generating line of the end flag register E at step S49. It is judged at step S50 if the end flag register E has reached 7F, i.e., if all the bits corresponding to all the channels has reached a value "1". When the end flag register E has not reached 7F, CPU 1 judges that any of the tone-generating lines is generating a tone, i.e., that a playing operation of a turn to be played is not finished, and judges at step S51 if the stop switch 22 has been turned on. When the stop switch 22 has not been turned on, CPU 1 goes to step 52 and repeatedly executes similar processes.

When the value of the end-flag register E has reached "7F", i.e., when the stop switch has been switched on, CPU 1 judges executes a stop process of FIG. 86.

With the arrangement of the present embodiment, indication data is switched in accordance with a hi-hat performance that generates sounds in response to beats. The player of the electronic musical instrument can learn from the indications on the LCD unit 5 how the beats of the tune change. In the present embodiment, indication data are sequentially switched in association with beats when a tone-generating line is a hi-hat line, but indication data may be switched every beat and the same indication data is displayed at the same beat in measures, or indication data may be sequentially switched every measure.

Figure 95:
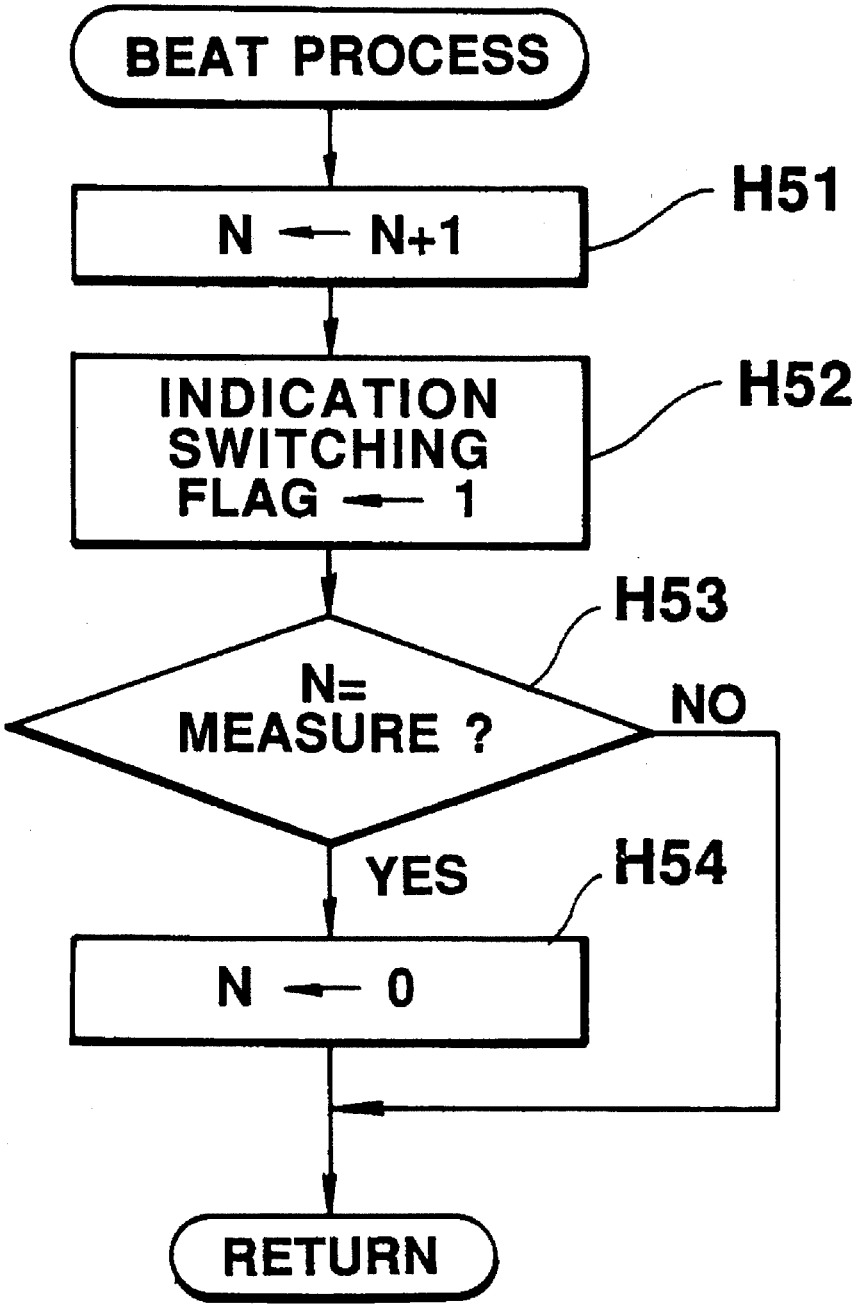
FIG. 95 is a flow chart of a detailed beat process to be executed when indication data are switched every beat and the same indication data is allowed to be displayed at respective beats of a measure in the tenth embodiment.

A beat process of FIG. 95 is executed for switching indication data every beat and displaying the same indication data at the same beat in measures.

A variable N is incremented at step H51. The indication switching flag is set to "1" to switch indication data at step S52. It is judged at step H52 if the variable N corresponds to a measure. When the variable N does not correspond to a measure, CPU 1 finishes the beat process. When the variable N corresponds to a measure, CPU 1 resets the variable N to "0". When the indication switching process of FIG. 66 is executed based on the indication switching flag and the variable N which are set in the above beat process, indication data can be switched every beat of the hi-hat line, and the same indication data may be displayed at the same beat in measures since the variable N is reset every measure.

Figure 96:
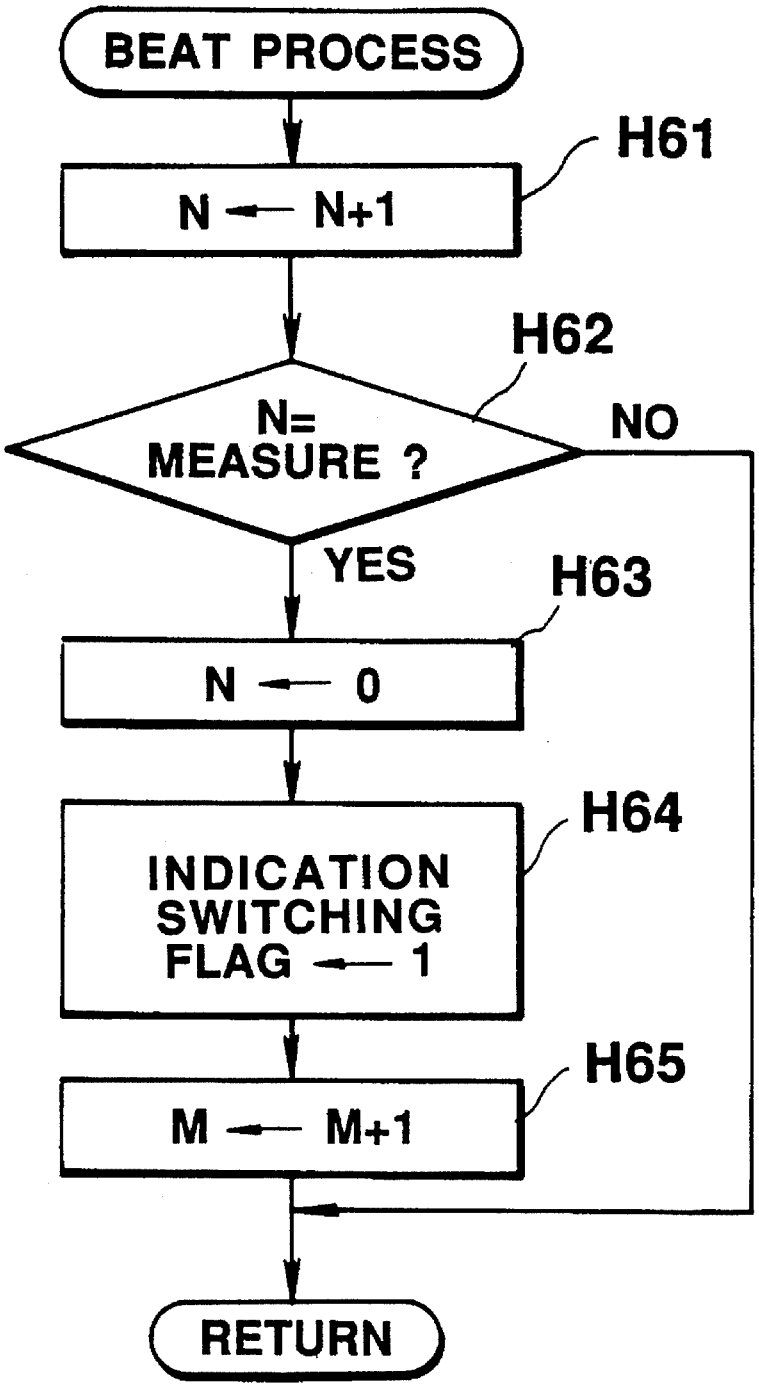
FIG. 96 is a flow chart of a detailed beat process to be executed when indication data are sequentially switched every measure in the tenth embodiment.
Figure 97:
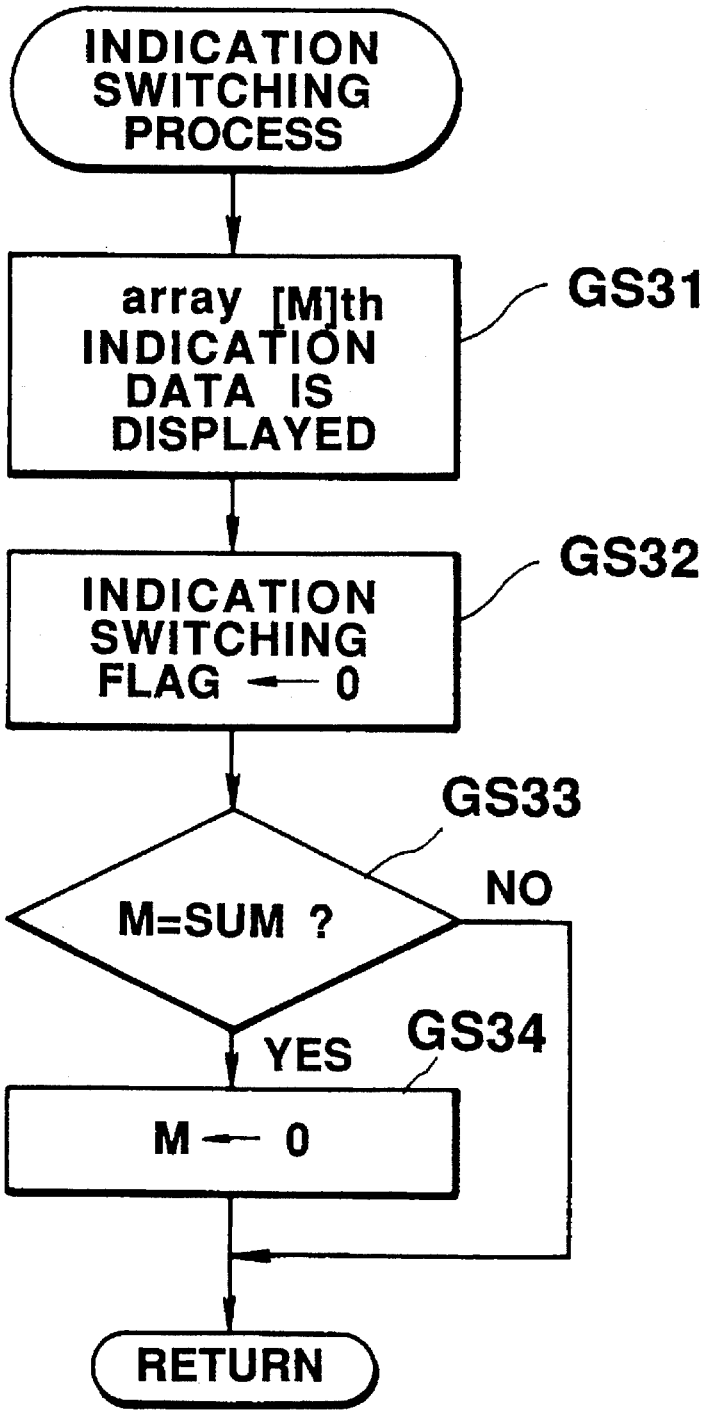
FIG. 97 is a flow chart of a detailed indication switching process to be executed when indication data are sequentially switched every measure in the tenth embodiment.

A beat process of FIG. 96 and an indication process of FIG. 97 are executed, for switching indication data every measures.

A variable N is incremented at step H61. CPU 1 sets "1" to the indication switching flag, and judges if the variable N corresponds to the number of beats in a measure, at step H62. When the variable N does not correspond to the number of beats in a measure, CPU 1 judges that it is not a timing for switching indication data, finishing the beat process. When the variable N corresponds to the number of beats in a measure, CPU 1 judges that it is a timing for switching indication data, and resets the variable N to "0" at step H63. Then, CPU 1 sets "1" to the indication switching flag for switching indication data at step H64. Further, CPU 1 increments a variable M, finishing the beat process.

The indication switching process and resetting process for the variable M based on the indication switching flag set in the above beat process are executed in the indication switching process shown in FIG. 97.

In the indication-switching process, CPU 1 converts indication data of the indication-number m into indication reading out data, and sends the indication reading out data to the LCD unit 5 to display the same thereon at step GS31. At the following step GS32, CPU 1 reset the indication switching flag to "0". CPU 1 judges at step GS33 if the variable M takes the maximum SUM. When the variable M is not the maximum SUM, CPU 1 finishes the process. When the variable M is the maximum SUM, CPU 1 resets the variable M to "0", finishing the indication-switching process at step GS34.

With the above arrangement of the embodiment, indication data can be switched every measure. The user can learn from the indication on the LCD unit 5 how measure changes.

The above embodiments are arranged to operate in association with beats based on the fundamental beat, but may be modified to operate to switch indication data in association with times.

FIG. 98 to 109 are views illustrating the eleventh embodiment of the electronic musical instrument of the present invention. In the present embodiment, performance data to be used are not previously stored therein, but a player of the electronic musical instrument generates performance data by operating a keyboard. Particularly, an indication on a display unit of the electronic musical instrument is switched in accordance with the number of keys which are operated simultaneously.

Figure 98:
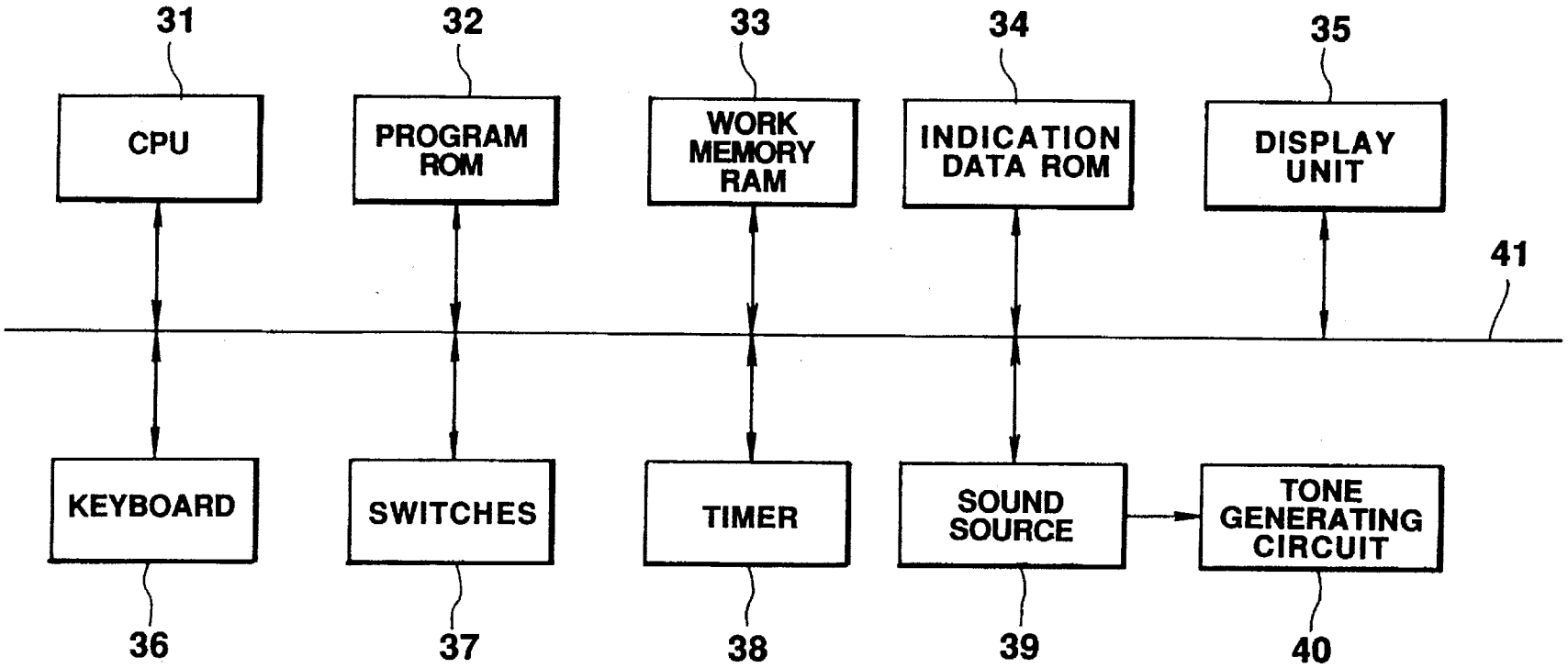
FIG. 98 is a block diagram of a whole structure of an embodiment (an eleventh embodiment) of an electronic musical instrument according to the present invention.

As shown in FIG. 98, the present embodiment of the musical instrument comprises CPU 31 for controlling whole instrument, ROM 32 in which control program is memorized, a working memory or a working RAM 33, an indication-data ROM 34 in which indication data are memorized, a display unit 35 for displaying an indication, a keyboard 36 for inputting performance data, switch group 37 for inputting operation data to CPU 31, a timer 38 for counting time which is necessary for controlling the display unit 35, a sound source 39 which is capable of electronically generating a plurality of musical tone signals simultaneously and a tone-generating circuit 40 for processing the musical tone signals to audibly output sound. These elements are connected to one another through a bus 41.

The indication-data ROM 34 memorizes a plurality of indication data for displaying indications on the display unit 35. The indication-data ROM 34 corresponds to storing means for storing indication data.

CPU 31 reads out data from the working RAM 33 and process the read out data to generate musical tones, in accordance with the control program memorized in the program ROM 32. Further, CPU 31 reads out indication data from the indication-data ROM 34 based on externally input performance data, i.e., key data (performance data) input from the keyboard 36 as a playing-operation detecting means, and controls indication-switching operation to display on the display unit 35 an indication selected out of a plurality of indications. CPU 31 corresponds to an indication-data selecting means.

The indication unit 35 composed of LCD or the like displays one of a plurality of indications based on indication data memorized in the indication-data ROM 34. The indication unit 35 has given size, and is mounted on a surface of the electronic musical instrument, allowing the player to watch the indication.

The switches 37 are operated in accordance with key data from the keyboard 36 to decide tone color which is needed when CPU 31 executes a tone-generating process. The timer 38 counts a time period during which a key of the keyboard 36 is not operated and is used for a process for switching the indication of the display unit 35.

Figure 99:
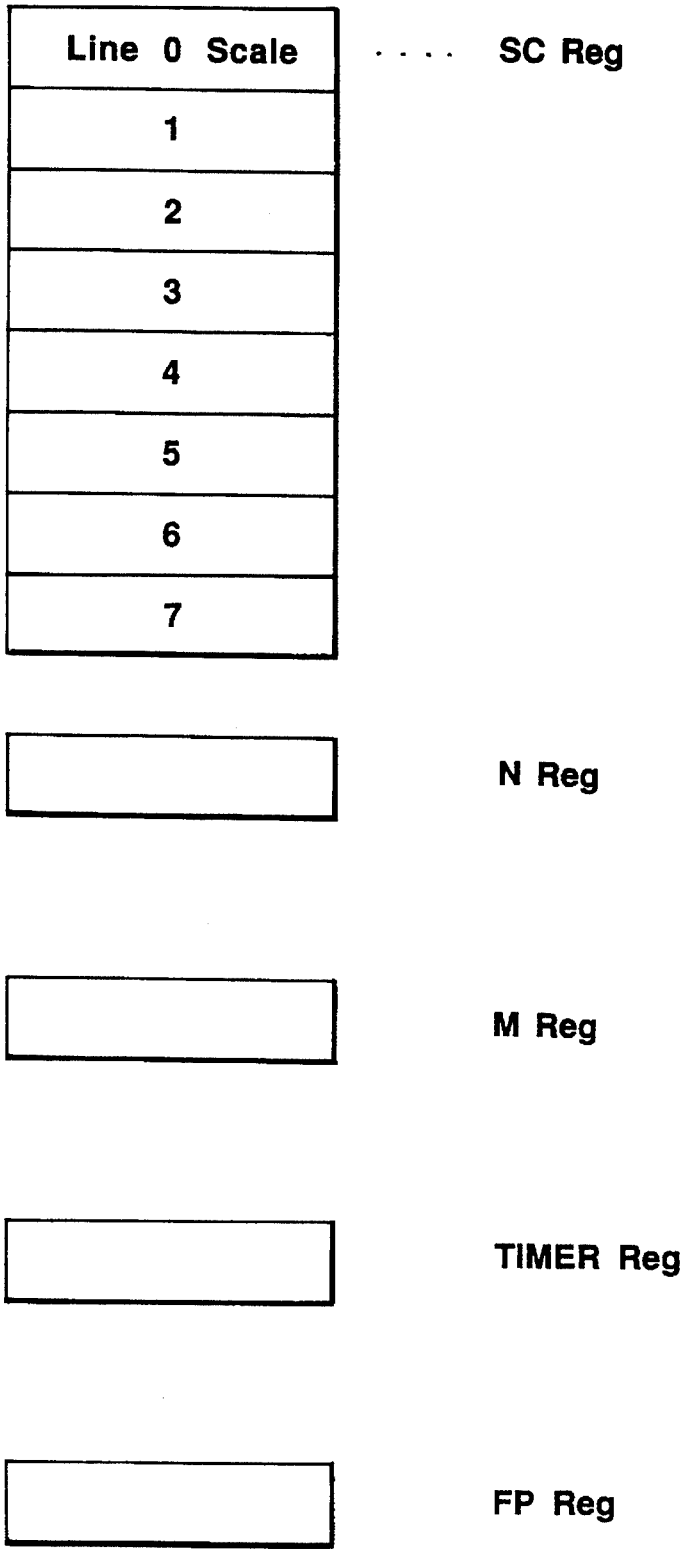
FIG. 99 is a view showing a structure of a register in CPU of the eleventh embodiment.
Figure 100:
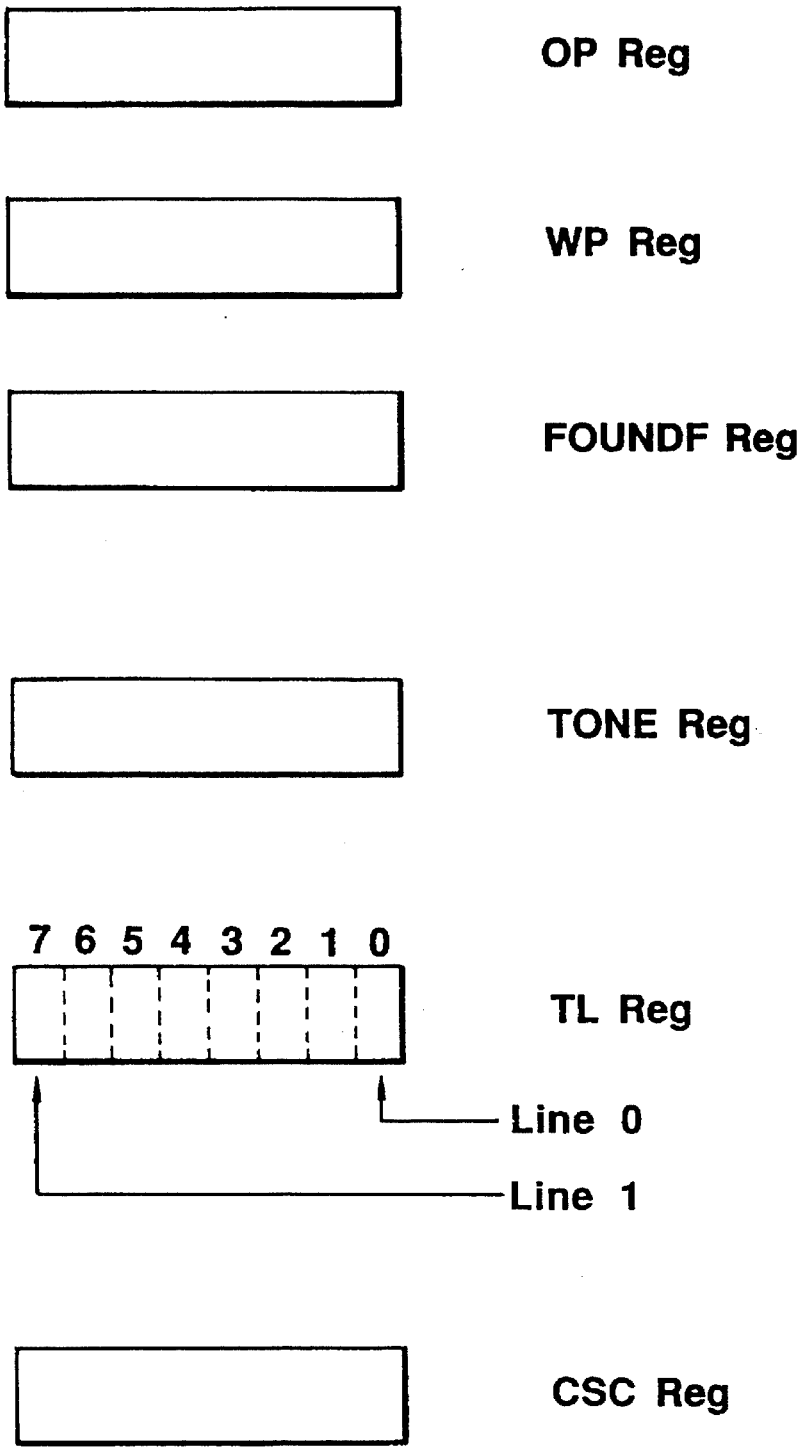
FIG. 100 is a view showing a structure of a register in CPU of the eleventh embodiment.

CPU 31 is provided with the following registers and counters shown in FIG. 99 and 100: OP Reg, WP Reg and FP Reg are used for designating line (channels).

SC Reg. (Scale Code) includes 8 units of registers of 8 bits, each of registers corresponds to one of channels 0 to 7, and memorizes a scale code of a key which is assigned to the corresponding channel. In other words, SC Reg is for storing tone-pitch data.

N Reg stores numbers corresponding indication data, and is used as a pointer of indication data.

M Reg stores numbers corresponding to switches for selecting indications, and is used as a pointer of indication data.

Timer Reg is used to store a counted time period necessary for a indication process, for example, a time period during which a key is not operated.

EP Reg. is sued for storing a number of a line, which is idle.

OP Reg stores a number of a channel in which a key is operated.

WP Reg is a work pointer for a key assigner, which is a circuit that assigns a channel corresponding to a operated key in accordance with operating process of CPU 31.

FOUNDF Reg is a register to which CPU 31 sets data of TRUE when there is an idle line, and sets data of FALSE when there is no idle line.

TONE Reg stores a number corresponding to a pointer for selecting tone color data, and is immediately renewed when tone color data is switched.

TL Reg (Trigger line Status) stores data of 8 bits, the least significant bit to the most significant bit of which correspond to channels 0 to 7 respectively. When a key is switched on, TL Reg is turned on while when a key is switched off, TL Reg is turned off. The 0th bit, 1st bit, 2nd bit, . . . , 7th bit of TL Reg correspond to 0 channel, 1 channel, 2 channel, . . . , 7 channel, respectively. When a new channel is designated, the corresponding bit is turned on. Contents of all the bits of YL Reg are turned off every time all the lines have been checked.

CSC Reg (Current Scale Code) is used to set a scale code of key which is ON.

The main routine process and the indication process of the present embodiment will be described with reference to flow charts of FIGS. 101 to 109.

Figure 43:
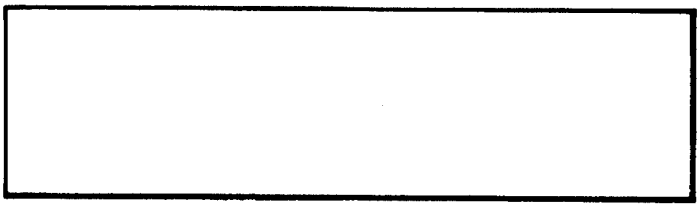
FIG. 43 is a view showing a first indication on LCD unit.
Figure 108:
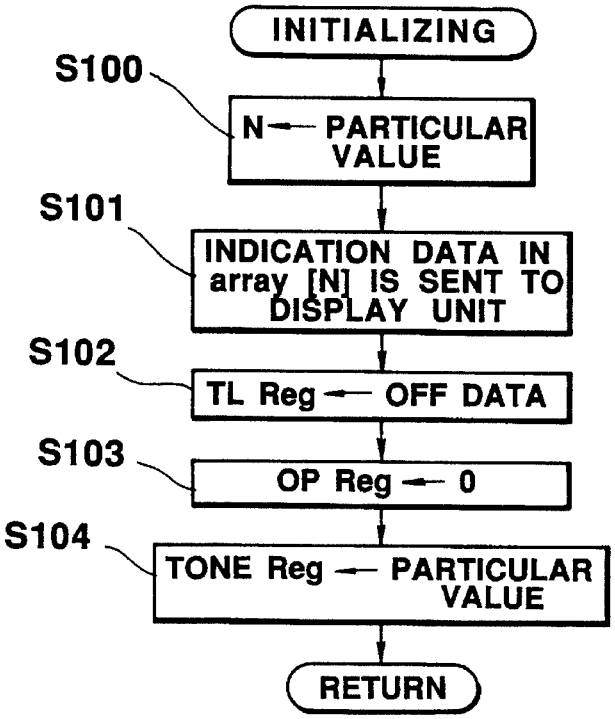
FIG. 108 is a flow chart of a sub-routine process of an initializing process executed by CPU in the eleventh embodiment.

CPU 31 executes an initializing process at step S1. A detailed routine process of the initializing process is shown in FIG. 108. In the initializing process of FIG. 108, CPU 31 sets a pointer N at a particular value at step 100. The pointer N represents a number which is to be stored in N register, and corresponds to indication data. At the initial routine, a number corresponds to a particular indication, for example, an indication shown in FIG. 43, will be the above particular value for displaying the initial indication on the display unit 35. This is the case that the indication of FIG. 43 is set as the initial indication.

Figure 44:
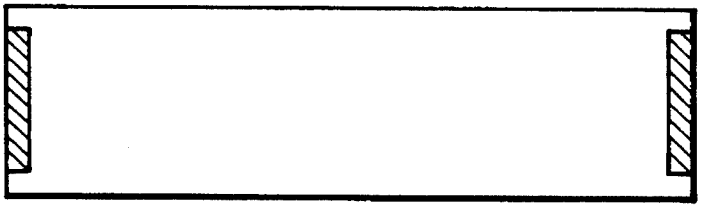
FIG. 44 is a view showing a second indication on LCD unit.
Figure 45:
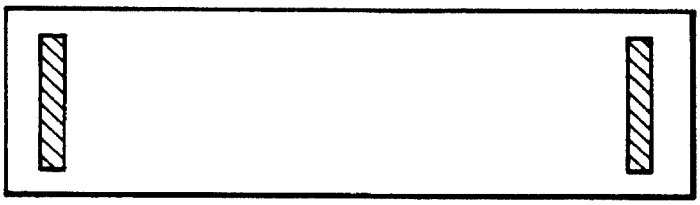
FIG. 45 is a view showing a third indication on LCD unit.
Figure 46:
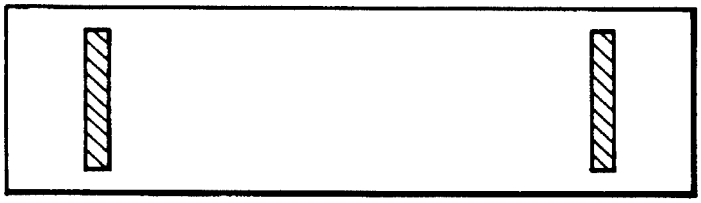
FIG. 46 is a view showing a fourth indication on LCD unit.
Figure 47:
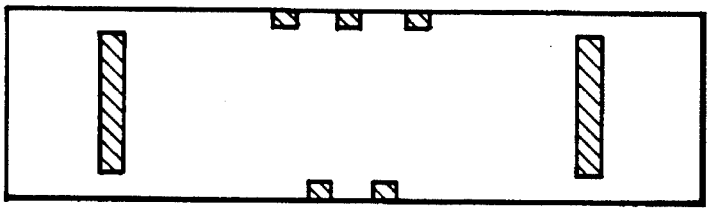
FIG. 47 is a view showing a fifth indication on LCD unit.
Figure 48:
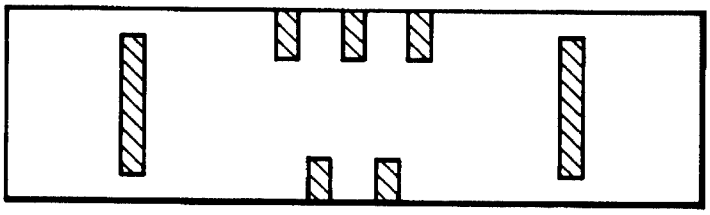
FIG. 48 is a view showing a sixth indication on LCD unit.
Figure 49:
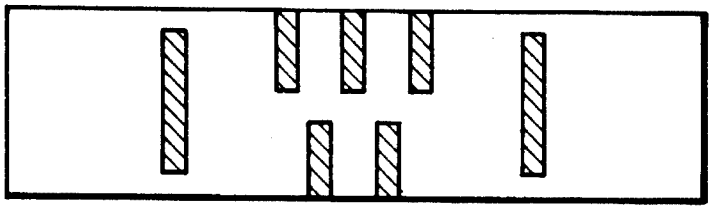
FIG. 49 is a view showing a seventh indication on LCD unit.
Figure 50:
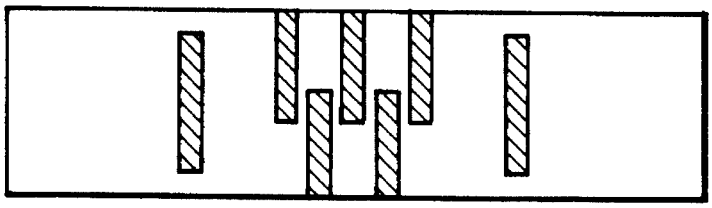
FIG. 50 is a view showing an eighth indication on LCD unit.
Figure 51:
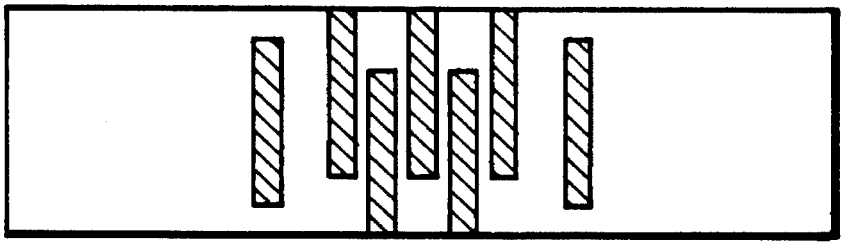
FIG. 51 is a view showing a ninth indication on LCD unit.
Figure 52:
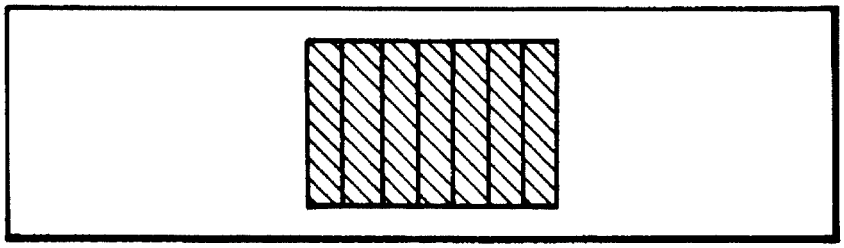
FIG. 52 is a view showing a tenth indication on LCD unit.
Figure 53:
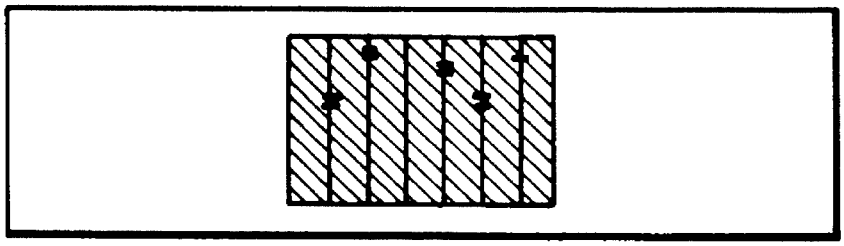
FIG. 53 is a view showing an eleventh indication on LCD unit.
Figure 54:
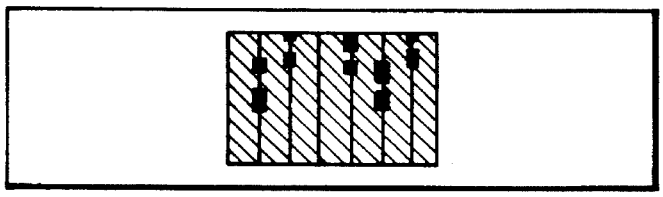
FIG. 54 is a view showing a twelfth indication on LCD unit.
Figure 55:
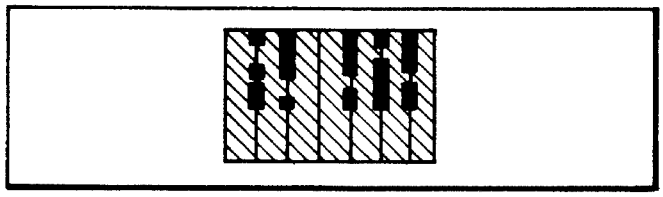
FIG. 55 is a view showing a thirteenth indication on LCD unit.
Figure 56:
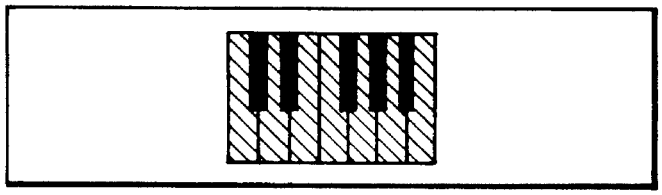
FIG. 56 is a view showing a final indication on LCD unit.

Indication data in array [N] corresponding to the particular value which is set as the pointer N at step S101 is selected from indication-data memory (indication-data ROM 34), and is sent to the display unit 35. The array [N] is one of indication data array [1], array [2], array [3], . . . , array [n]. One of indications shown in FIGS. 43 to 45 is displayed on the display unit 35 based on one of data in these indication data arrays.

OFF data is stored in TL register at step S102, because key is off at the initial time. Accordingly, OFF data is stored in respective channels of 8 bits, i.e., OFF data is stored in all of channels: 0 channel, 1st channel, 2nd channel, . . . 7th channel (Line 0, Line 1, Line 2, . . . Line 7).

OP register is set to "0" at step S103. OP register is for storing a value of a channel in which a key is switched on. But, since no key has not been switched on, OP register is set at "0" at the initial time.

A particular value is stored in TONE register at step S104. TONE register is for storing a number of a pointer for selecting tone color data. Since, at the initial time, no key has not been switched on, the particular value is stored in TONE register at step S104. The particular value stored in TONE register allows a musical tone of a particular tone color (for example, piano) to be generated. When the process at step S104 is finished, CPU 1 returns to the main routine process of FIG. 101.

Figure 101:
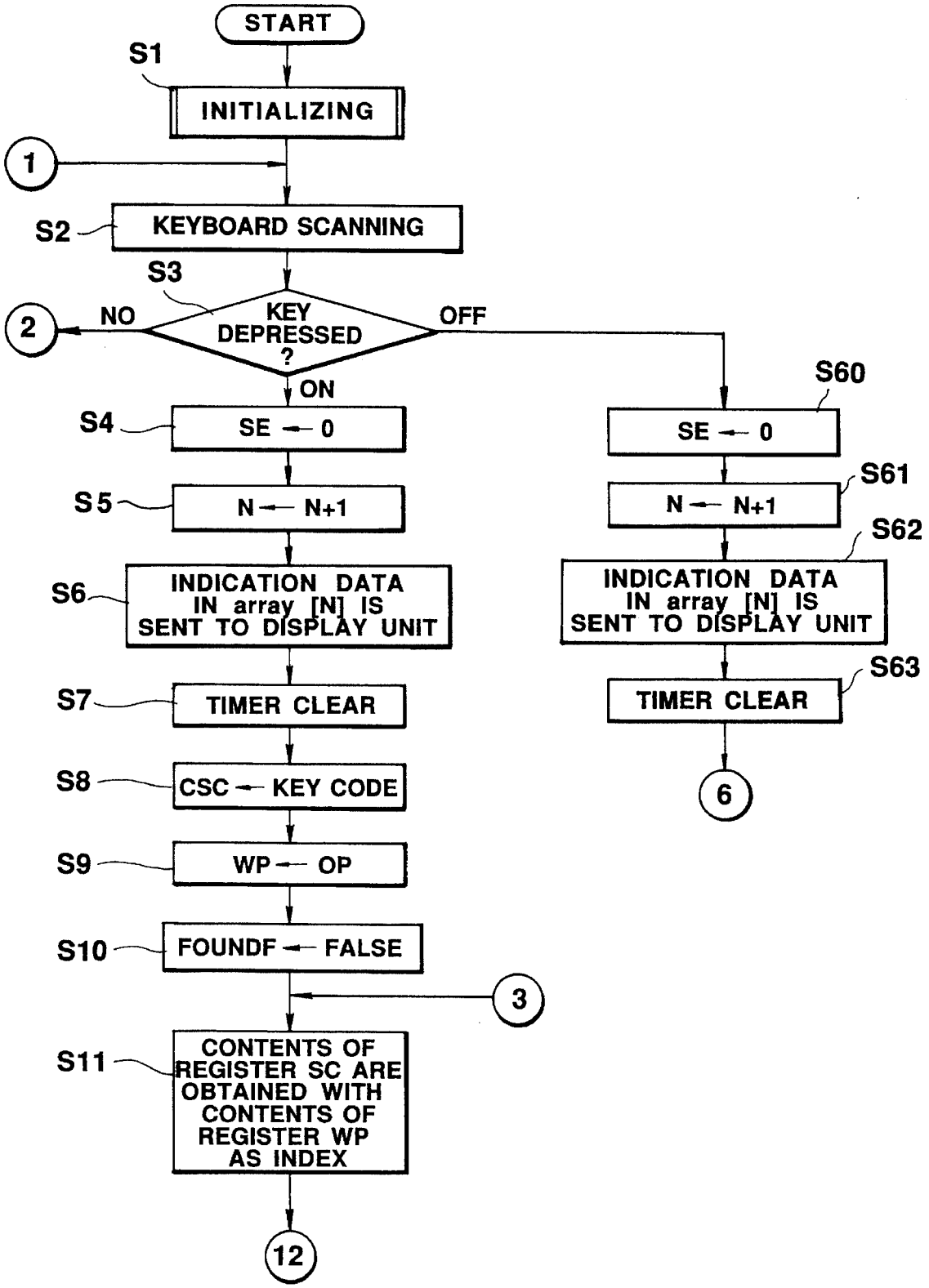
FIG. 101 is a flow chart of a part of tone-generation process and an indication-display process executed by CPU in the eleventh embodiment.

At step S2 of FIG. 101, CPU 31 scans the key board, and judges at step S3 if any change in key operation in the keyboard 36 has been caused. In this case, for example, CPU 1 sends a key common signal to the key board 36 via a bus 41 to scan the keys of the keyboard 36, and outputs of respective keys of the keyboard 36 are written into the work RAM 33 through an interface. CPU 31 judges from data in the work RAM 33 if either of keys has been depressed.

Figure 105:
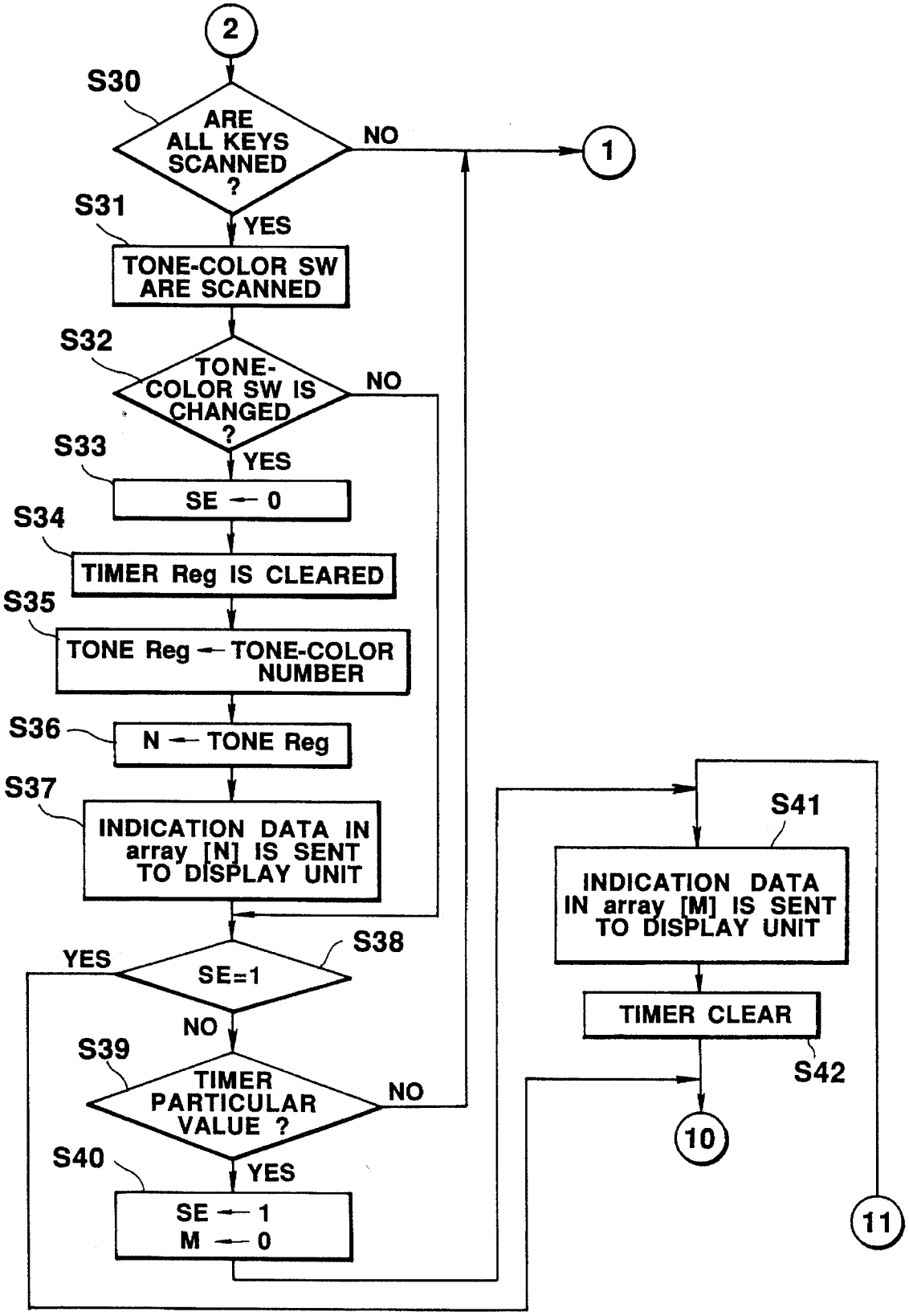
FIG. 105 is a flow chart of a part of tone-generation process and an indication-display process executed by CPU in the eleventh embodiment.
Figure 106:
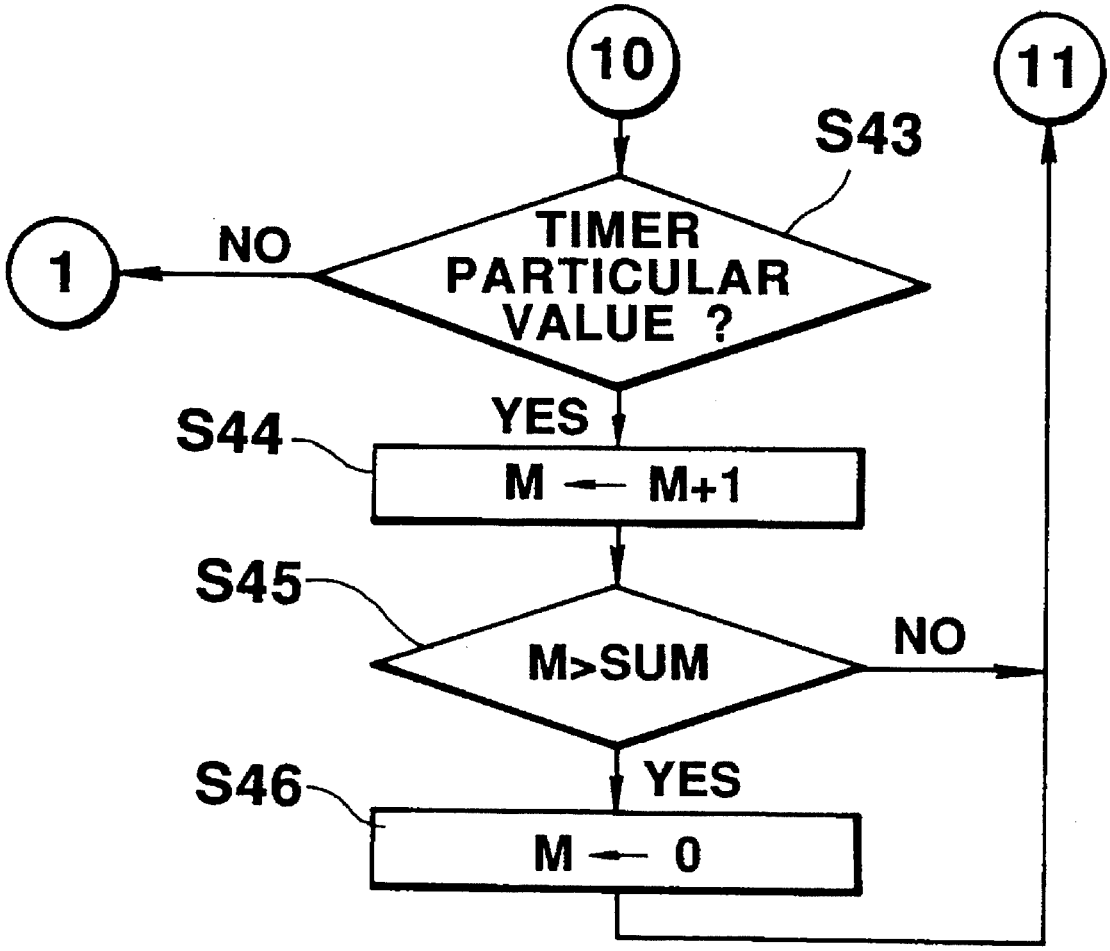
FIG. 106 is a flow chart of a part of tone-generation process and an indication-display process executed by CPU in the eleventh embodiment.

When CPU 31 judges at step S3 that no change in key operation has been caused, i.e., when no key has been operated, CPU 31 jumps to step S30 shown in FIG. 105, where CPU 31 judges if a key scan with respect to all keys has been finished. When the key scan is not finished, CPU 31 returns to step S2, and repeatedly executed similar processes.

When CPU 31 judges at step S30 that all the keys have been scanned, CPU 31 scans tone-color switches at step S31, and judges at step S32 if any change in tone-color switches. The tone-color switch is operated to select one from among tone colors which corresponds to various musical instruments, respectively.

When no change in the tone-color switches has been caused (for example, when a tone color of piano is selected and the tone color of piano is not changed to other tone color), the result of the judgement at step S32 is NO, and CPU 31 goes to step S38, where it judges if a demonstration flag (a demo flag) SE has been set at "1".

The demo flag is a judge flag for controlling to display a particular still indication for demonstration at the initial time, and then to switch the still indication to another indication based on performance data. The demo flag SE is reset to "0", when the power is turned on. Therefore, the demo flag SE is set at "0" at the first time, and a particular still indication for demonstration is displayed on the display unit 35.

A result of the judgement at step S38 in the first routine process is NO, and CPU 31 goes to step S39, where it judges if the timer register takes a particular value. The timer register is for storing a counted time period which passed after a key is operated or a counted time period in which no key is operated.

Figure 109:
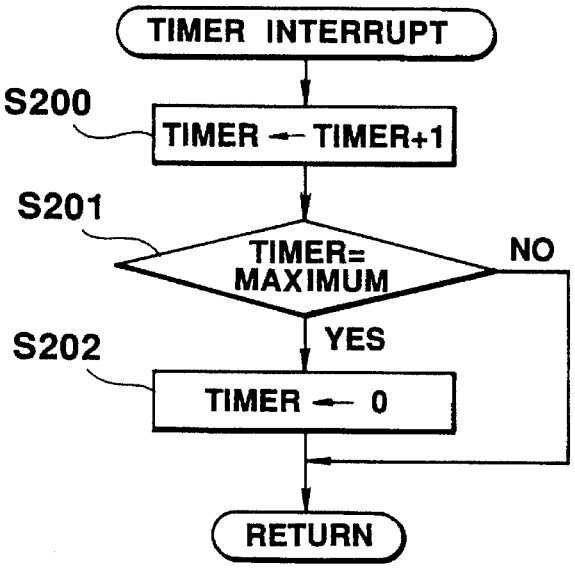
FIG. 109 is a flow chart of a sub-routine process of a timer interrupt process executed by CPU in the eleventh embodiment.

A sub-routine process of a timer interrupt service for counting a time period to be stored in the timer register is shown in FIG. 109. At step S20, a counted time period stored in the timer register is incremented. CPU 31 judges at step S201 if the incremented time period stored in the timer register has reached the maximum value (a predetermined time period). When the incremented time period stored in the timer register has not reached the maximum value, CPU 31 returns. When the incremented time period stored in the timer register has reached the maximum value, CPU 31 goes to step S202, where it clears the timer register. In this manner, a necessary time period is counted in the timer interrupt service.

Now, CPU 31 returns to the flow chart of FIG. 105. The process at step S34 corresponds to a time-counting start of counting a time period lapsed from a time when the demo indication flag SE=0. When a counted lapse-time is not a particular value, CPU 31 returns to step S30 to repeatedly execute similar processes. When a counted lapse-time has reached a particular value, CPU 31 goes to step S40, where it sets the demo indication flag SE to "1", and clears M register.

M register stores a number corresponding to a switch for selecting an indication, and is used as a pointer of an indication. When M register is cleared, an indication (an indication corresponding to M=0) following the initial still indication will be displayed at step S41.

Indication data in array [M] corresponding to the content "0" of M register is selected from data in the indication-data memory and is supplied to the display unit 35, whereby an indication different from the previous indication will be displayed based on the selected indication data on the display unit 35.

The timer register is cleared at step S42, whereby a measuring operation starts counting a time after the indication is switched to a new indication. CPU 31 judges at step S43 if the timer register takes a particular value. When the timer register takes no particular value, CPU 31 returns to step S2, again, and repeatedly executes similar processes until a time for switching the indication to a new indication has been reached.

Judging at step S43 that the timer register has reached the particular value, CPU 31 judges that a timing has been reached for switching the indication, and increments M register at step S44, whereby the indication will be switched to a new indication at the following step S41.

CPU 31 judges at step S45 if a value of M register exceeds the maximum number SUM of indications. When the value of M register does not exceed the maximum number SUM of indications, CPU 31 returns to step S41, where indication data in array [M] corresponding to data of M register is selected from data in the indication-data memory and is supplied to the display unit 35, whereby an indication different from the previous indication is displayed based on the selected indication data on the display unit 35.

When the similar processes are repeatedly executed and it is judged at step S45 that the value of M register has exceeded the maximum number SUM of indications, CPU 31 goes to step S46, where it resets M register to "0" and returns to step S41, switching the indication.

As described above, when no key has been operated and a state of tone-color switches has remained unchanged, the above routine process is repeatedly executed and still indications for demonstration are sequentially selected and displayed on the display unit 35.

When it is judged at step S32 that the state of tone-color switches has changed (for example, when another tone color different from the previously selected tone color of piano is selected), CPU 31 goes to step S33 where it resets the demo indication flag SE to "0" in accordance with the selection of tone color. Further, CPU 31 clears the timer register at step S34, whereby a measuring operation starts counting a time lapse after the indication on the display unit 35 is switched to a new indication.

At step S35, a number of newly selected tone color is stored in the tone register. The content of the tone color register is transferred to N register at step S36. Data in array [N] corresponding to the content of N register is selected from among data in indication-data memory, and transferred to the display unit 35, whereby a new indication different from the previous indication is displayed based on the selected indication data on the display unit 35. Then, CPU 31 goes to step S38, where a similar process is executed. In other words, when a tone color different from the previously selected tone color is selected, a new indication different from the previous indication will be displayed in accordance with the selection of the tone color.

Now, operation will be described which CPU 31 will perform when a key of the keyboard 36 is depressed.

When a state of keys changes, i.e., for example, when a key is depressed for the first time, a result of the judgement at step S3 will be ON, and CPU 31 goes to step S4. When the state of keys changes but the key is off, CPU 31 goes to processes at step S60 and thereafter, which will be described later in detail.

CPU 31 resets the demo indication flag SE to "0" at step S4, and increments the pointer N by "1" at step S5. Data in array [N] corresponding to the value of the pointer N (n+1) is selected from among data in indication-data memory, and transferred to the display unit 35, whereby a new indication of performance data different from the above still indication is displayed based on the selected indication data on the display unit 35.

Further, CPU 31 clears the timer register at step S7. The timer register stores a counted time period which lapses after a key is operated or during which no key is operated. The timer register is therefore cleared for another measurement.

Key code which is on at present is set to CSC register at step S8. Contents of OP register are transferred to WP register at step S9. Since OP register stores a value of a channel in which a key-on is caused (data corresponding to the value of the channel is "0" at the first key-on: 0 channel), WP register will be "0". In the following routine, a value of a channel corresponding to a depressed key which is detected at step S3 will be transferred to WP register, a key-assigner work pointer. The key assigner assigns a channel to an operation key.

Data, "FALSE", representing that there is no idle line is written into FOUNDF register at step S10. Contents of SC register are obtained with contents "0" of WP register as an index at step S11. WP register stores a value of a channel corresponding to a depressed key which is detected at step S3. Since, in this case, it is the first key-on (data is "0" at first), no scale code is assigned to 0 channel of SC register.

In the second and after routine processes, contents of SC register are obtained with the value of the channel stored in WP register as the index, in other words, a scale code (tone pitch data) assigned to the channel is obtained.

Figure 102:
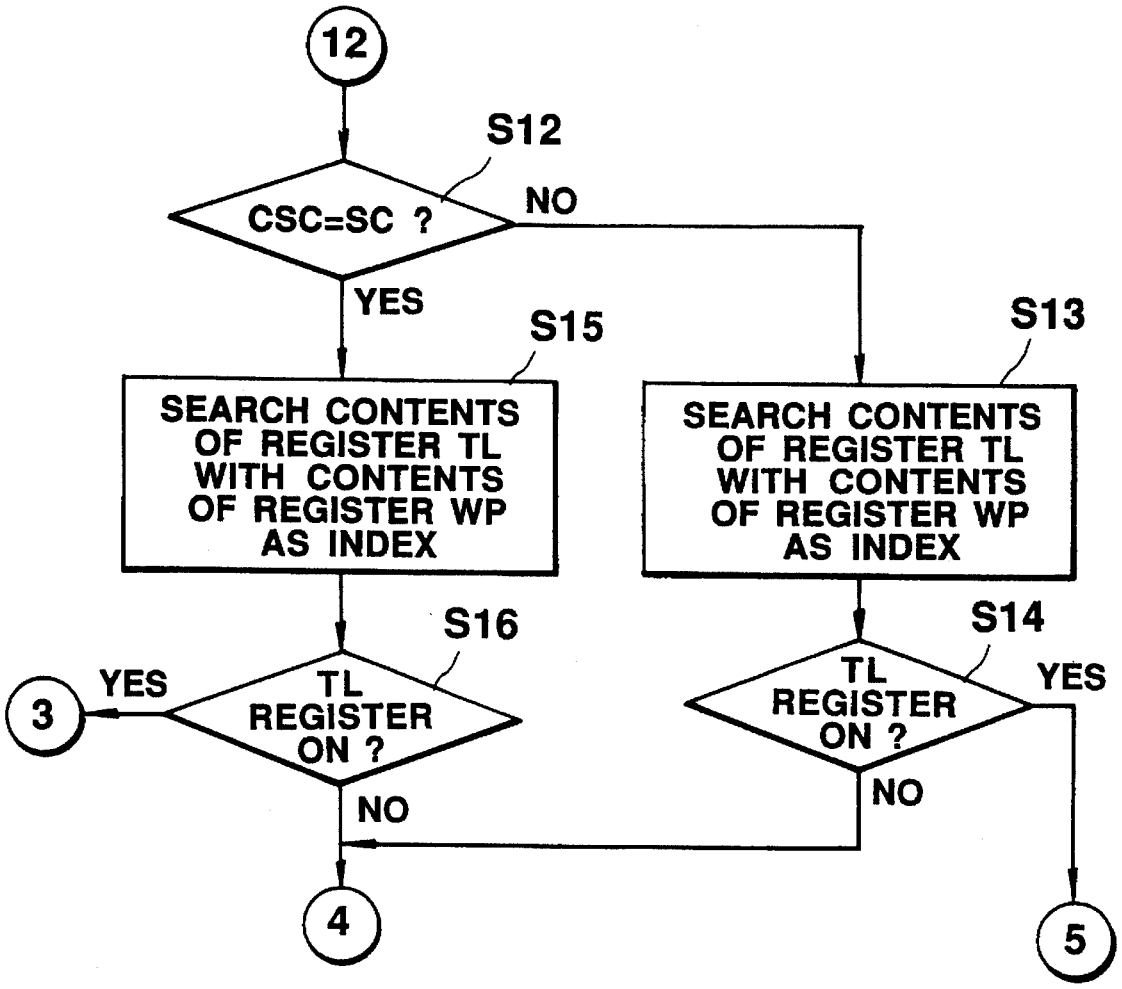
FIG. 102 is a flow chart of a part of tone-generation process and an indication-display process executed by CPU in the eleventh embodiment.
Figure 103:
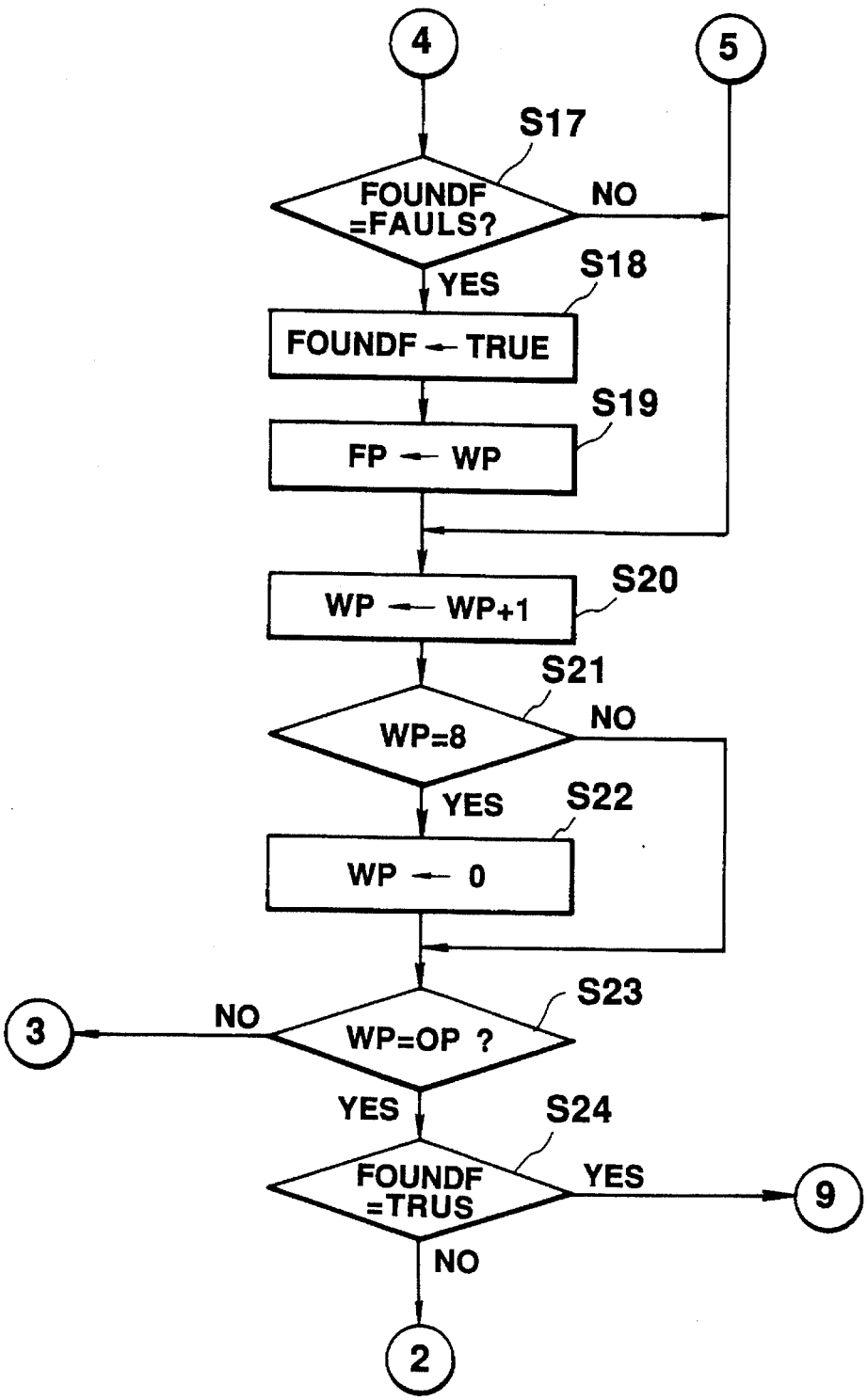
FIG. 103 is a flow chart of a part of tone-generation process and an indication-display process executed by CPU in the eleventh embodiment.
Figure 104:
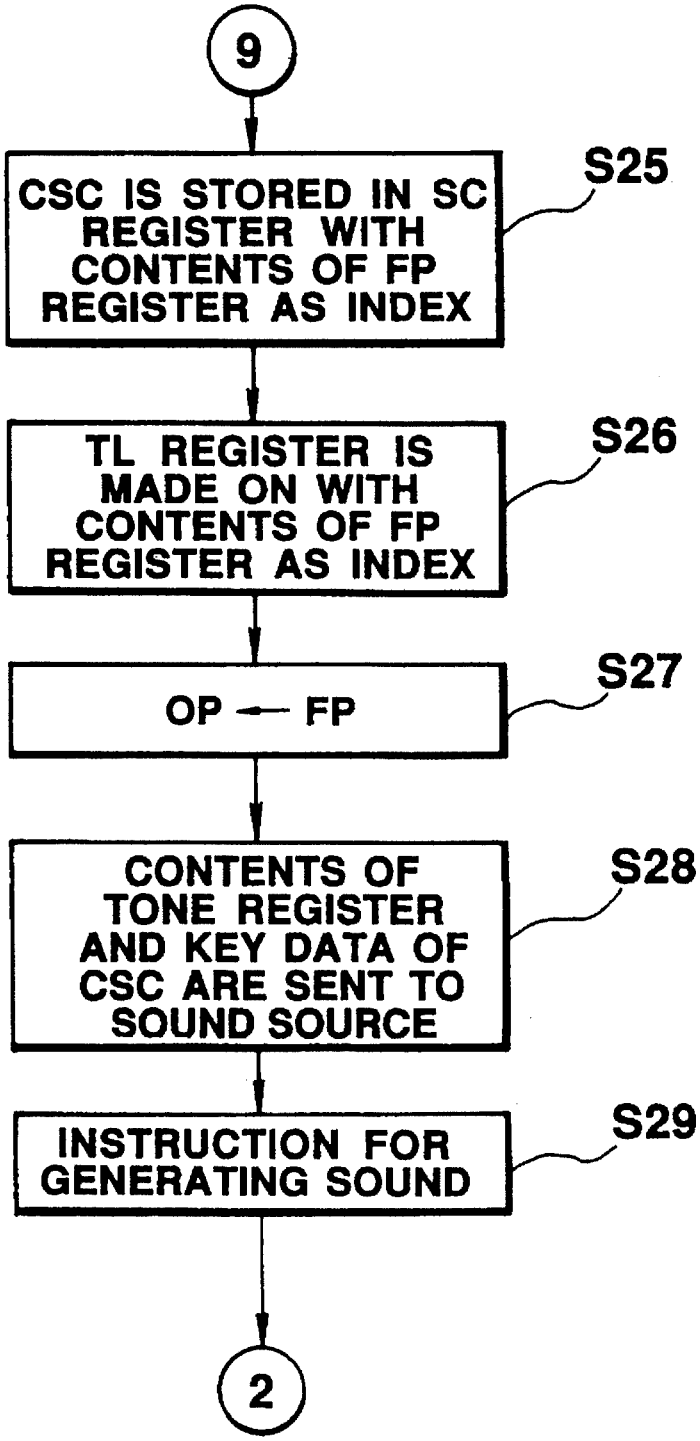
FIG. 104 is a flow chart of a part of tone-generation process and an indication-display process executed by CPU in the eleventh embodiment.

CPU 31 goes to step S12 of FIG. 102, where it judges if data of CSC register coincides with data of SC register (a scale code). In the first routine process, data is "0", and is not a scale code of 0 channel of SC register. The result of judgement at step S12 therefore is NO, and CPU 31 goes to step S13. CPU 31 searches contents (0 channel is off) of TL register with contents "0" of WP register as the index at step S13. CPU 31 judges at step S14 if TL register is on. Since 0 channel of TL register is off at first, CPU 31 goes to step S17 of FIG. 103.

CPU 31 judges at step S17 if data of FOUNDF register is "FALSE". Since the result of the judgement at step S17 is YES (there is no idle line), CPU 31 goes to step S18, where it sets data, "TRUE", to FOUNDF register. Further, CPU 31 sets data [0] of WP register to FP register at step S19, and increments WP register by "1" at step S20. CPU 31 judges at step S21 if WP register has reached "8".

In the first routine process, the result of the judgement at step S21 is NO and CPU 31 jumps to step S23. When WP register reaches "8", CPU 31 resets WP register to "8" at step S22. Meanwhile, when the result of the judgement at step S17 is NO, CPU 31 jumps to step S20.

CPU 31 judges at step S23 if data "1" of WP register coincides with data "0" of OP register. Since the result of the judgement at step S23 is NO, CPU 31 returns to step S11 of FIG. 101.

Processes at steps S23, S11, S12, S13, S14, S17, S18, S19, S20, S21 and S23 are repeatedly executed for seven times while data of WP register is incremented at step S20 until it reaches "0" from "1". More specifically, WP register sequentially takes values "1", "2", "3", "4", "5", "6", "7" and "0". When it is judged at step S24 that data "0" of WP register coincides with data "0" of OP register, CPU 31 goes to step S24, where it judges if data of FOUNDF register is "TRUE". Since the result of the judgement at step S24 is YES (there is an idle line), CPU 31 goes to step S25 of FIG. 104, where it stores data of CSC register in SC register with data "0" of FP register as the index. As a result, a scale code of key-on is stored in 0 channel of SC register.

CPU 31 sets "ON" to 0 channel of TL register with the content "0" of FP register as the index at step S26. Further, CPU 31 transfers a content "0" of the FP register to OP register at step S27, whereby a pointer of search start line of the key assigner is renewed.

The contents of tone register and key-on data of CSC register are transferred to the sound source 39 at step S28. An instruction of sound generation is issued at step S29, whereby the sound source 39 generated a musical tone based on the key-on scale code in 0 channel. The tone generating circuit 40 audibly outputs the musical tone.

Then, CPU 31 goes to step S30, where it judges if all the keys have been scanned. If not, CPU 31 returns to step S2, and repeatedly executes similar processes until all the keys are scanned.

When it is judged at step S30 that all the keys have been scanned, CPU 31 goes to step S31, and executes similar processes thereafter. When a result of the judgement at step S43 is NO, CPU 31 returns to step S2, and executes similar processes. When another keys are depressed while CPU 31 is executing the processes, a process for switching the indication on the display unit 35 is executed depending on how many keys are depressed simultaneously.

Meanwhile, when a result of the judgement at step S43 is YES, still indications are sequentially switched and displayed at a certain timings.

Now, operation will be described which CPU 31 will perform when another key of the keyboard 36 is depressed in addition to the previously depressed key.

When another key of the keyboard 36 is depressed in addition to the previously depressed key, the result of judgement at step S3 is ON, and CPU 31 goes to step S4, where the demo indication register SE is reset to "0".

CPU 31 increments the pointer N by "1" at step S5. Data in array [N] corresponding to the value of the pointer N (n+1) is selected from among data in indication-data memory, and transferred to the display unit 35, whereby a new indication of performance data (key-on signal) different from the above indication is displayed based on the selected indication data on the display unit 35.

Further, CPU 31 clears the timer register at step S7. Key code which is key-on at present is set to CSC register at step S8. Contents of OP register are transferred to WP register at step S9. Since OP register stores a value of a channel in which a key-on is caused (current data corresponding to the value of the channel is "1:1 channel), WP register will be "1".

Data, "FALSE", representing that there is no idle line is written into FOUNDF register at step S10. Contents of SC register are obtained with a content "1" of WP register as an index at step S11. WP register stores a value of a channel corresponding to a depressed key which is detected at step S3. The current key-on is different from the previous key-on.

CPU 31 goes to step S12 of FIG. 102, where it judges if data of CSC register coincides with data of SC register (a scale code). In the current routine process, data is "1", and a scale code of 0 channel of SC register is stored. The result of judgement at step S12 therefore is YES, and CPU 31 goes to step S15. CPU 31 searches contents (1 channel is off) of TL register with contents "1" of WP register as the index at step S15.

CPU 31 judges at step S16 if TL register is on. Since 1 channel of TL register is off, CPU 31 goes to step S17 of FIG. 103. Thereafter, similar processes are executed, and a tone generating process is performed in accordance with the depressed key. The indications to be displayed on the display unit 35 are switched depending on the number of depressed keys.

Operation will be described which will be performed by CPU 31 when one of depressed keys is released.

When one key of the depressed keys is released, the result of judgement at step S3 is OFF, and CPU 31 goes to step S60, where the demo indication register SE is reset to "0". CPU 31 increments the pointer N by "1" at step S62. Indication data in array [N] corresponding to the value of the pointer N (N−1) is selected from among data in indication-data memory, and transferred to the display unit 35, whereby another indication different from the indication which has been on display is displayed based on the selected indication data on the display unit 35. Then, CPU 31 clears the timer register at step S63. Measurement operation starts counting a time lapse after the key is released.

Figure 107:
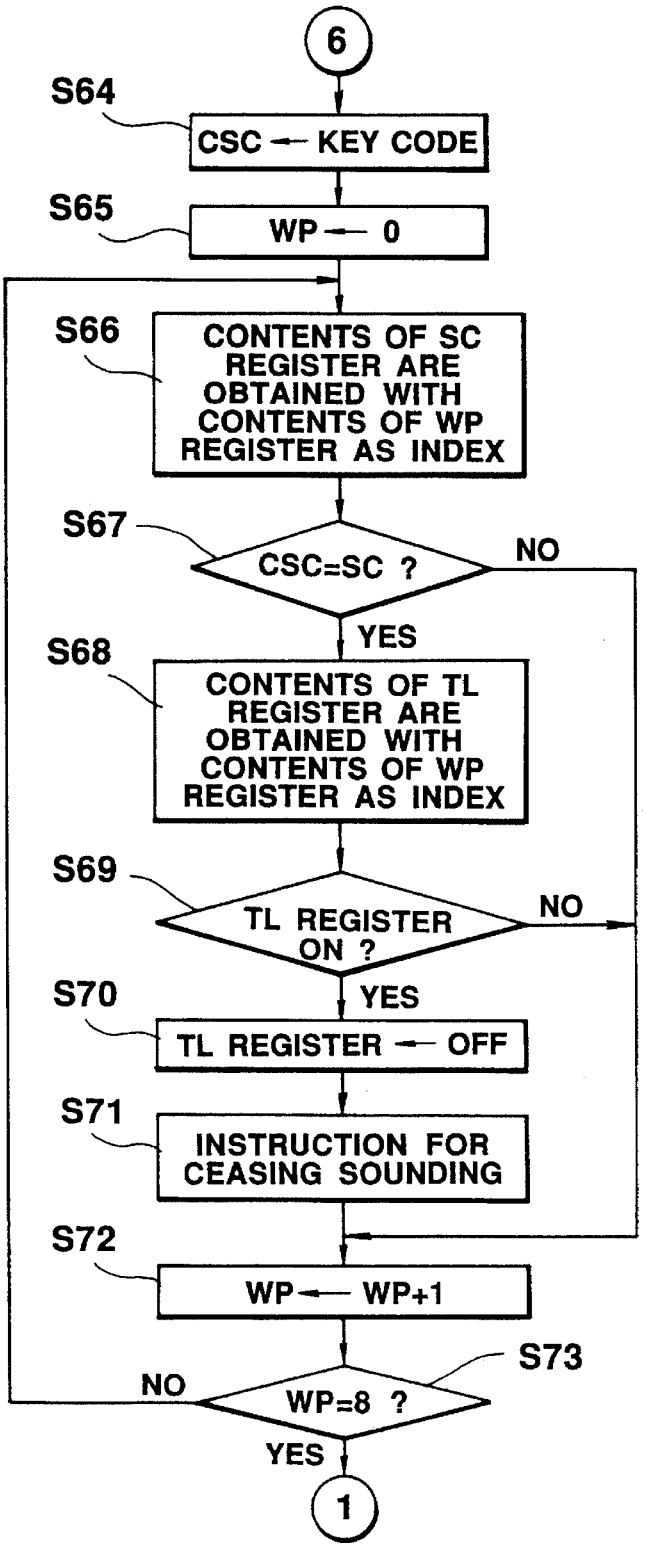
FIG. 107 is a flow chart of a part of tone-generation process and an indication-display process executed by CPU in the eleventh embodiment.

Then, CPU 31 goes to step S64 of FIG. 107, where a (key off) key code of the released key is set to CSC register. CPU 31 sets WP register to "0" at step S65 and obtains contents of SC register with a content "0" of WP register as the index. More specifically, CPU 31 obtains contents of SC register, i.e., a scale code of a key assigned to 0 channel, with a value of 0 channel of WP register as the index. Since the content of WP register is "0", no scale code is assigned to 0 channel of SC register.

CPU 31 judges at step S67 if data of CSC register coincides with data (a scale code) of SC register. In the current process data is "0" and is not a scale code of 0 channel. The result of judgement at step S67 therefore is NO, and CPU 31 goes to step S72, where it increments WP register, and further judges if data of WP register has reached "8".

Since data of WP register in not "8", CPU 31 returns to step S66, and increments WP register while it repeatedly executes similar processes. CPU 31 repeatedly executes similar processes until data of WP register reaches data of SC register. In other words, a process for searching a (key-off) key code is performed.

When a (key off) key code of a released key is found, the result of the judgement at step S67 is YES, and CPU 31 goes to step S68, where it searches contents (0 channel is off) of TL register with a content "0" of WP register as the index. Further, CPU 31 judges at step S69 if TL register is on.

Since 0 channel of TL register is still on when a key is released, CPU 31 goes to step S72, where it makes TL register off, and outputs an instruction of ceasing sounds at step S71, whereby the scale code of 0 channel is made key-off. The sound source 39 stops generating a musical tone upon the instruction of ceasing sounds, and the tone generating circuit 40 stops sounding. When the incremented WP register reaches "8" at step S73, CPU 31 returns to step S2 of FIG. 101.

In the above described embodiment, the indication on the display unit 35 is switched in accordance with the number of keys which are depressed simultaneously. More specifically, a value of array [N] in the indication data memory for selecting indication data is incremented or decremented, and the indication on the display unit 35 is switched.

In the present embodiment, the indication on the display unit 35 can be switched in accordance with externally input key-on/off data (performance data). The apparatus of the invention shows peculiar features as an electronic musical instrument, and allows the user to visually understand dynamism of performance.

The indication on the display unit is associated with input performance data, so that the indication can be more attractive, and raises commercial value of the apparatus.

FIGS. 110 to 114 are views illustrating the twelfth embodiment of an electronic musical instrument of the invention. In the present embodiment, the indication is switched based on velocity data (key-depressing speed and key-touch strength).

Figure 110:
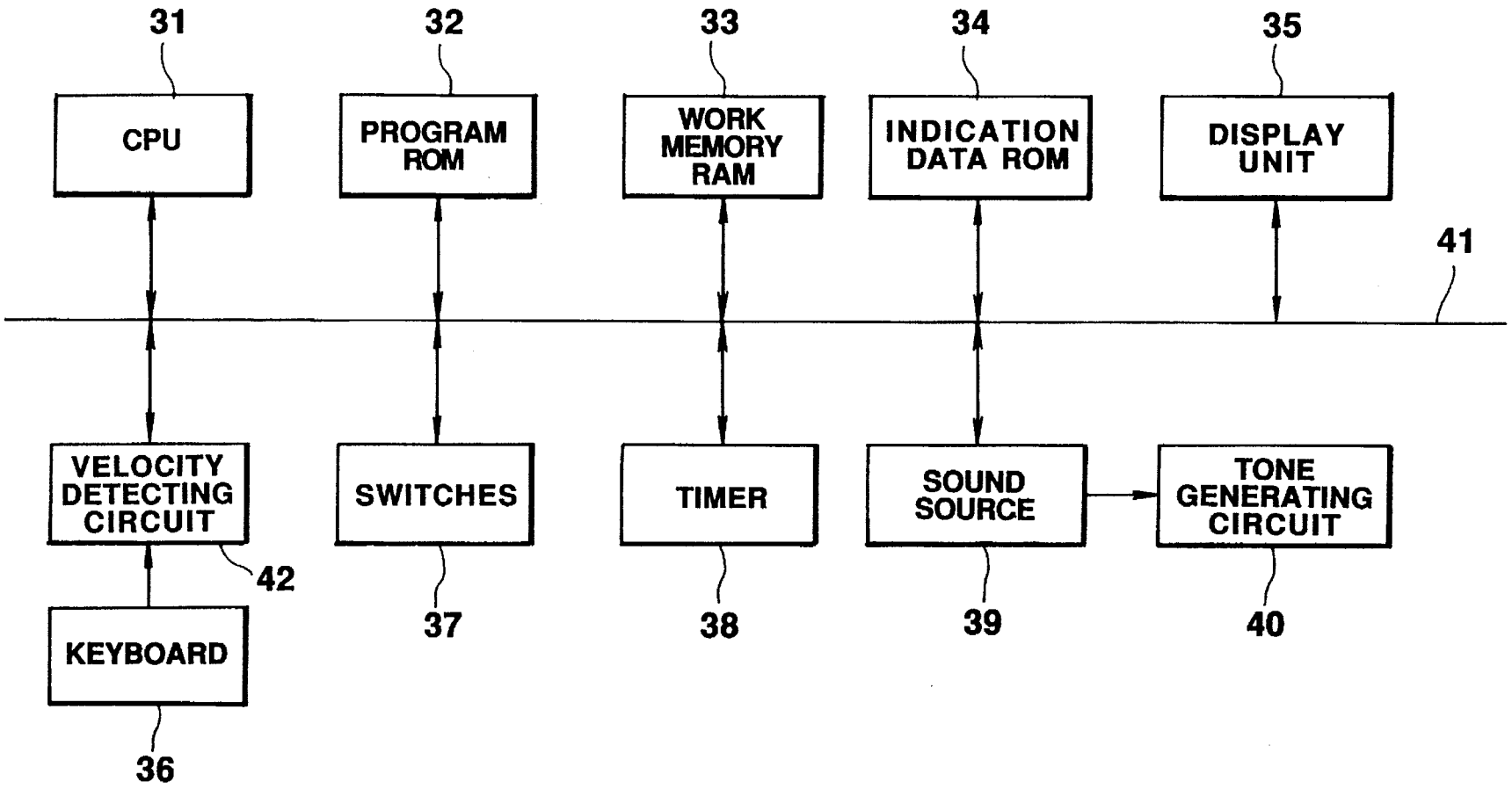
FIG. 110 is a block diagram of a whole structure of an embodiment (a twelfth embodiment) of an electronic musical instrument according to the present invention.

FIG. 110 is a block diagram of the whole structure of the twelfth embodiment. As shown in FIG. 110, a velocity detecting circuit (playing-operation detecting circuit) 42 is provided between the bus 41 and the keyboard 36. The velocity detecting circuit 42 detects a key-depressing speed and key-touch strength, and outputs the same to CPU 31.

Figure 111:
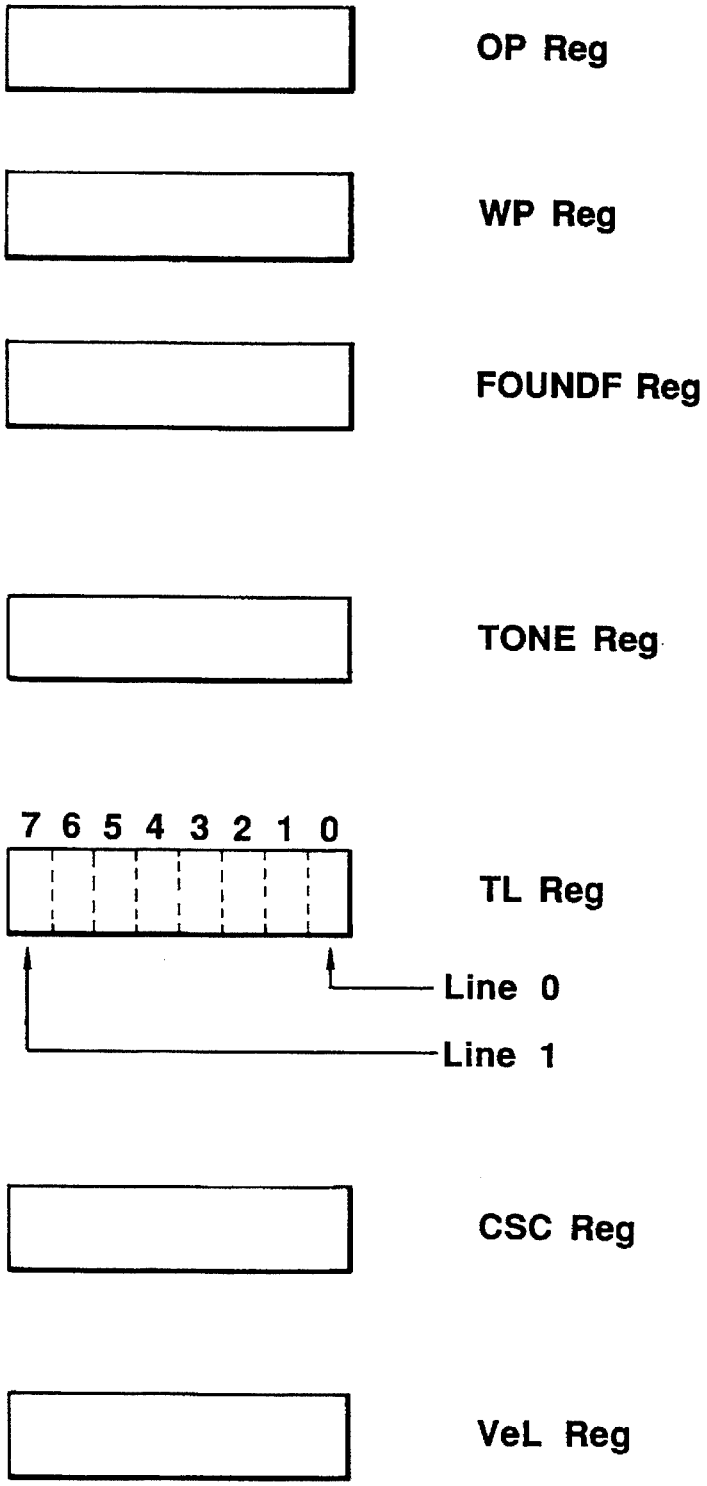
FIG. 111 is a view showing a structure of a register in CPU of the twelfth embodiment.

As shown in FIG. 111, the present embodiment is different in registers of CPU 31 from the embodiments described above. CPU 31 is provided with an additional Vel Reg (Vel register), which stores velocity values (particularly, key-depressing speed and key-touch strength) of a key (key-on key) which is touched or depressed.

Many processes performed by CPU 31 in the tone-generating process and indication-displaying process in the present embodiment are similar to those in the eleventh embodiment, so that only processes different from those in the above embodiments will be described.

Figure 112:
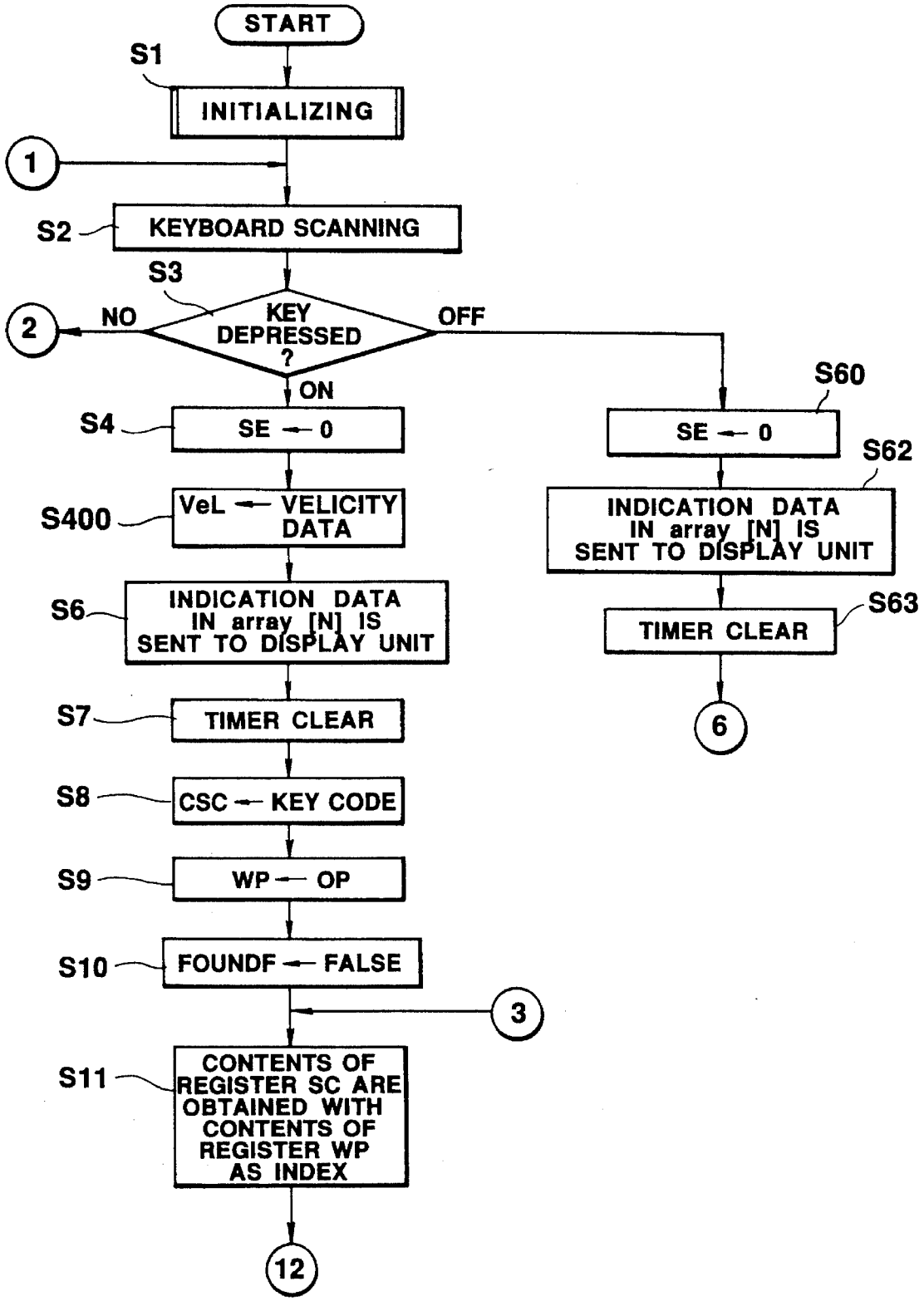
FIG. 112 is a flow chart of a part of tone-generation process and an indication-display process executed by CPU in the twelfth embodiment.
Figure 113:
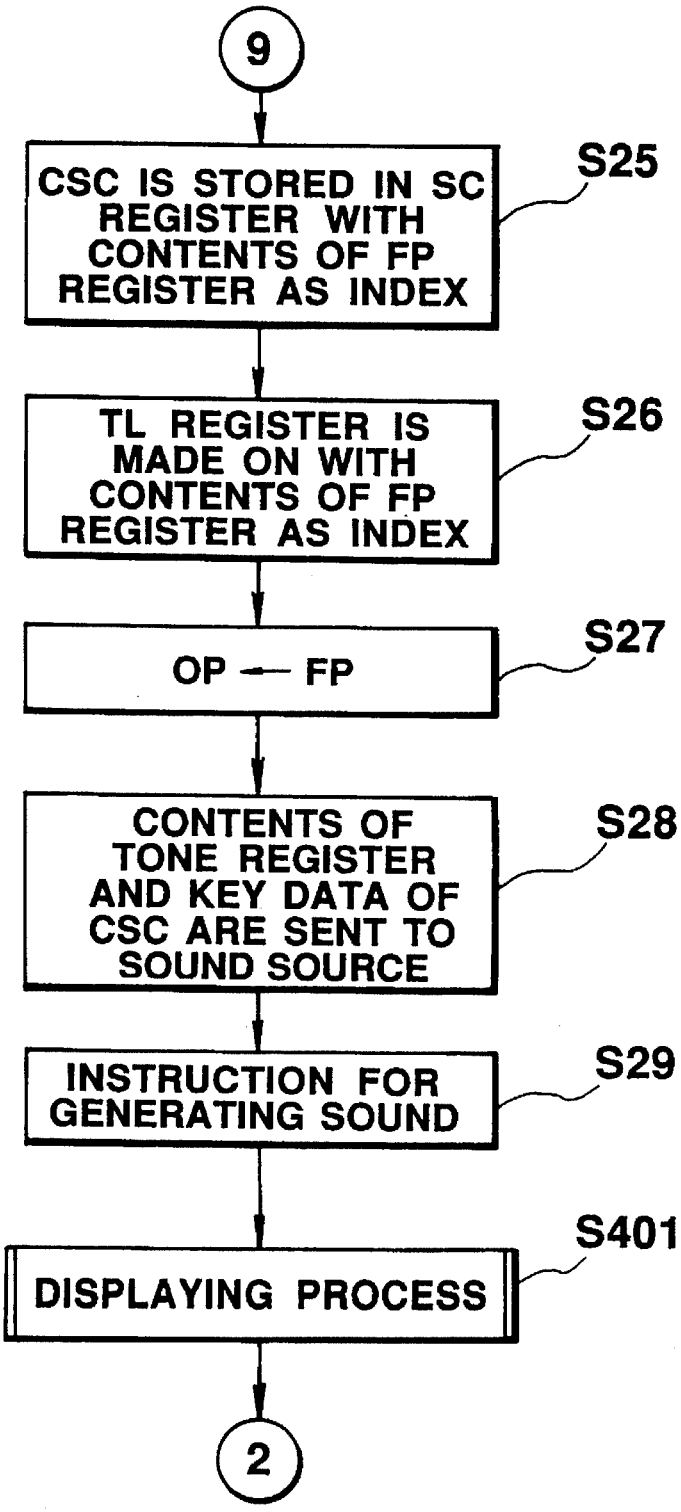
FIG. 113 is a flow chart of a part of tone-generation process and an indication-display process executed by CPU in the twelfth embodiment.

When, in the main routine process of FIG. 112, a depressed key of the keyboard 36 is detected at step S3, velocity data (key-depressing speed and key-touch strength) of the depressed key is stored in Vel register at step S400. Processes at steps S6 to S29 are similar to those in the eleventh embodiment. Executing the process of step S29, CPU 31 executes a display process at step S401, and goes to step S30.

Figure 114:
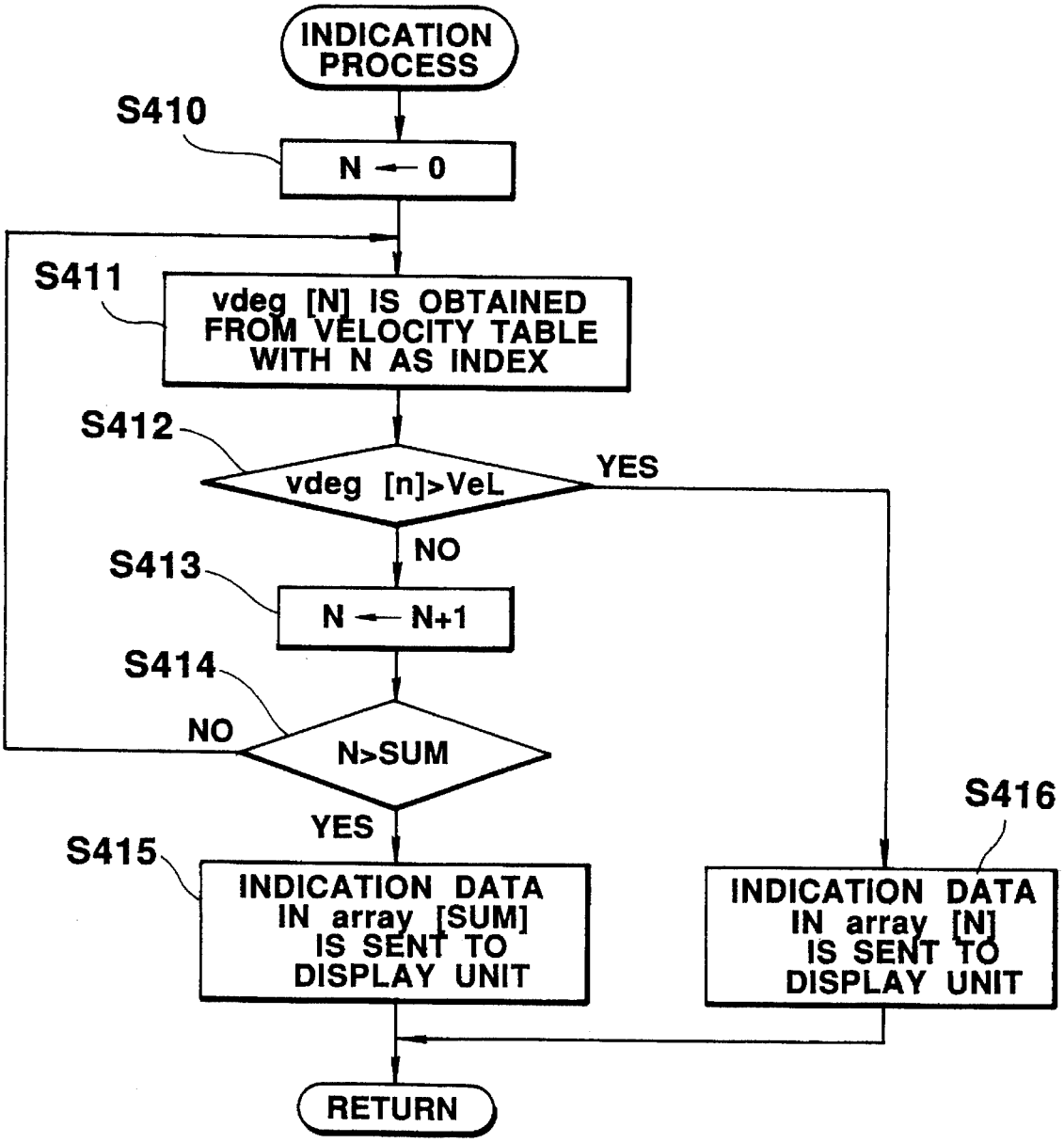
FIG. 114 is a flow chart of a sub-routine process of a display process executed by CPU in the eleventh embodiment.

A sub-routine process of the display process at step S401 is shown in FIG. 114. A pointer N for selecting indication data is set to "0" at step 410, and a velocity level Vdeg [N] is obtained from a predetermined velocity table with the pointer N as the index at step S411. The velocity levels Vdeg [N] corresponding to values of the pointer N are stored in the velocity table. The velocity level Vdeg [N] is previously set, for example, with reference to a key-depressing speed and key-touch strength or results of an experiment, so as to be an appropriate indication.

CPU 31 judges at step S412 if the velocity level Vdeg [N] is larger than the detected velocity data. When the former is larger than the latter, CPU 31 goes to step S416, where it selects indication data in array [N] corresponding to the pointer N from among data in the display-data memory, and sends the same to the display unit 35, whereby an indication corresponding to the velocity level Vdeg [N] will be displayed on the display unit 35.

Meanwhile, when the velocity level Vdeg [N] is not larger than the detected velocity data, CPU 31 increments the pointer N at step S414, and judges at step S413 if the incremented pointer N exceeds a predetermined maximum value SUM. If not, CPU 31 returns to step S411, and executes repeatedly the same processes. When the pointer N exceeds the maximum value SUM, CPU 31 goes to step S415, where it reads out indication data in array [SUM] corresponding to the maximum value of the pointer N from the indication-data memory, and sends the same to the display unit 35, whereby an indication corresponding to the maximum value of the velocity level Vdeg is displayed on the display unit 35.

As described above, the indication on the display unit is switched in accordance with the velocity data (key-touch strength, key-depressing speed) in the twelfth embodiment.

Figure 115:
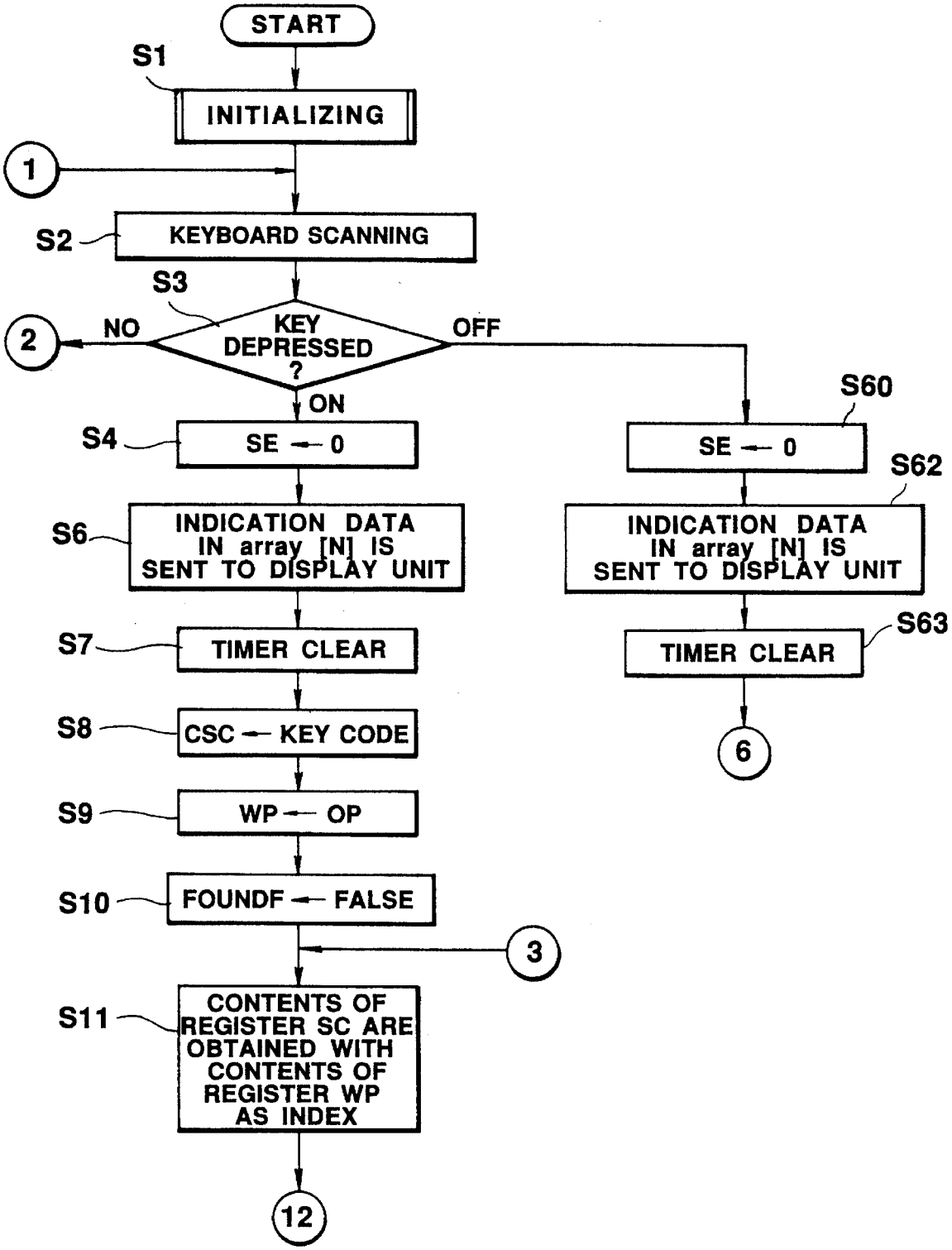
FIG. 115 is a flow chart of a part of tone-generation process and an indication-display process executed by CPU in an embodiment (a thirteenth embodiment) of an electronic musical instrument according to the invention.
Figure 116:
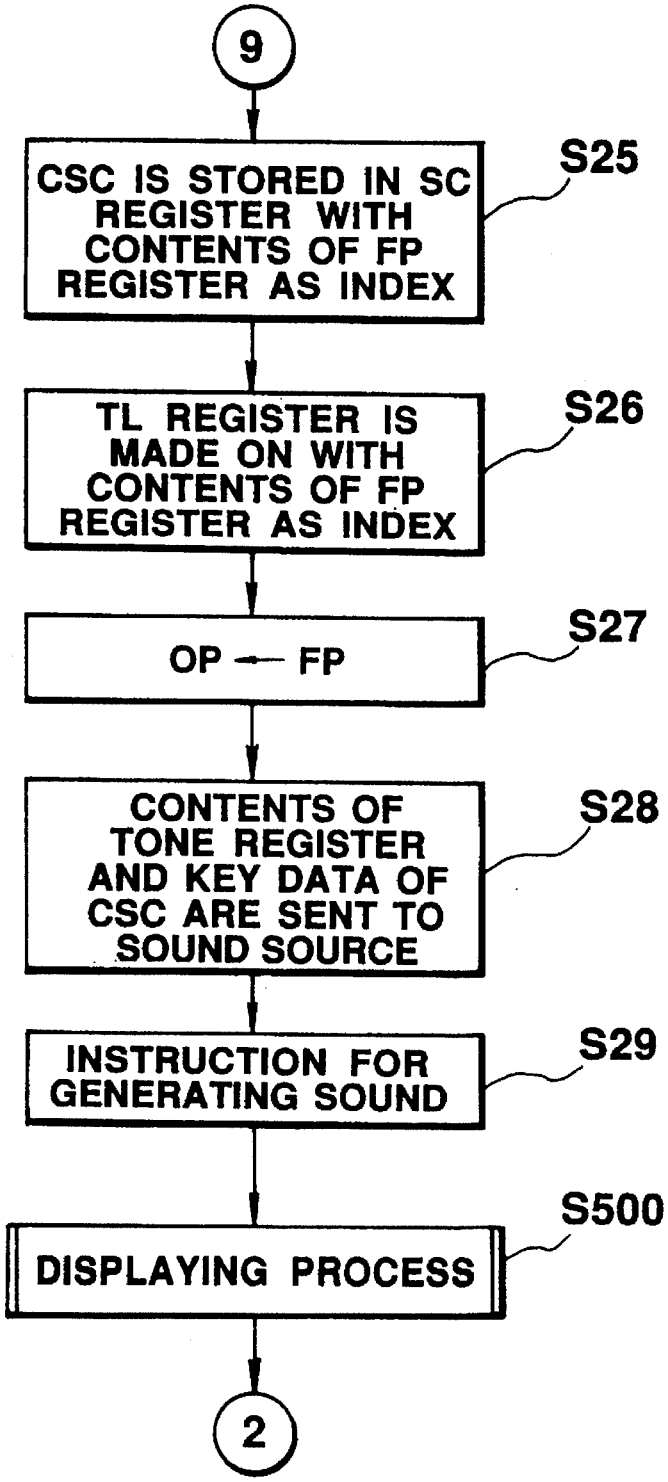
FIG. 116 is a flow chart of a part of tone-generation process and an indication-display process executed by CPU in the thirteenth embodiment.
Figure 117:
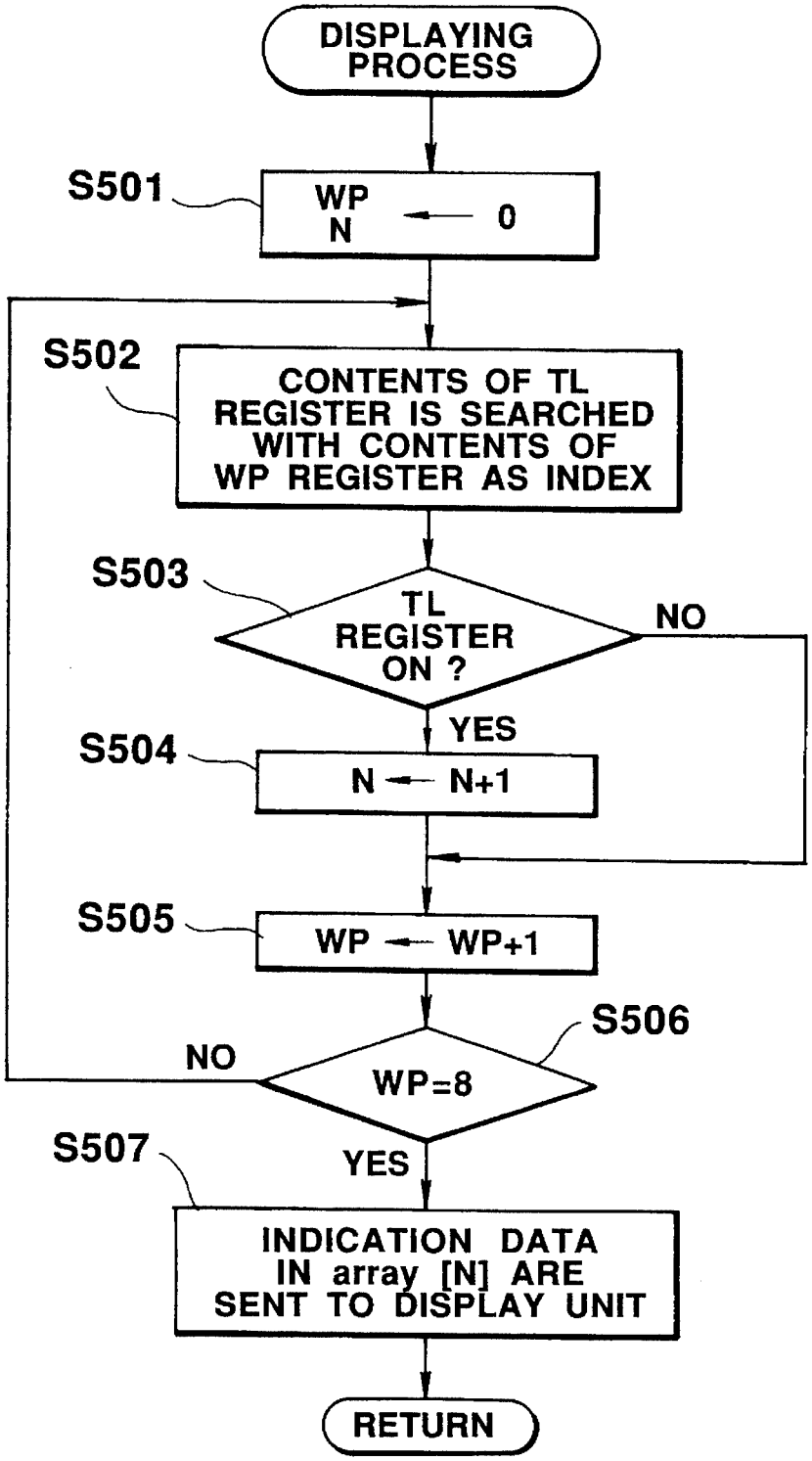
FIG. 117 is a flow chart of a sub-routine process of a display process executed by CPU in the thirteenth embodiment.

FIGS. 115 to 117 are views illustrating a thirteenth embodiment of an electronic musical instrument of the invention.

In the thirteenth embodiment, the indication of the display unit is switched in accordance with number of tones which are generated simultaneously.

The hardware structure of the present embodiment is similar to that of the eleventh embodiment, and a description thereof is omitted.

The tone-generating process and indication-displaying process in the present embodiment are similar to those in the eleventh embodiment, so that only processes different from those in the above embodiments will be described.

The main routine process of the present embodiment is different in processes at steps S5 and S61 of FIG. 101 from that of the eleventh embodiment. These two steps are omitted from the main routine process of FIG. 115. When the process at step S4 has been executed, CPU 31 goes directly to step S7 as shown in FIG. 115 while, when the process at step S60 has been executed, CPU 31 goes directly to step S62.

In the routine process of FIG. 116, when a process at step S29 has been executed, CPU 31 executes the display process at step S500, and then goes to step S30.

A sub-routine process of the display process at step S500 is shown in FIG. 116. At step S501 in the sub-routine process of FIG. 116, data "0" is stored in the pointer N and WP register in which a value of a channel corresponding to a depressed key that is detected at step S501, and contents of TL register are searched with a content [0] of WP register as the index at step S502.

More specifically, contents (0 channel is on) of TL register are searched with a value of 0 channel of WP register as the index. When the content of TL register is ON, CPU 31 increments the pointer N at step S504, and further increments WP register at step S505. Then, CPU 31 judges at step S506 if WP register takes "8".

When WP register does not take "8", CPU 31 returns to step S502 and executes repeatedly similar processes. Meanwhile, when the content of TL register is off, CPU 31 skips step S504 and jumps to step S505. CPU 31 goes through 8 channels to find out a channel in which a content of TL register is ON or to find out a channel which is ON.

In the above described manner, when a channel which is ON has been found out from 8 channels, indication data in array [N] corresponding to the pointer N is selected from among data in the display-data memory and is sent to the display unit 35, whereby an indication different from the indication which has been on display will be displayed on the display unit 35 based on the selected indication data. In the thirteenth embodiment, the indication is switched based on the channel which is ON.

Figure 118:
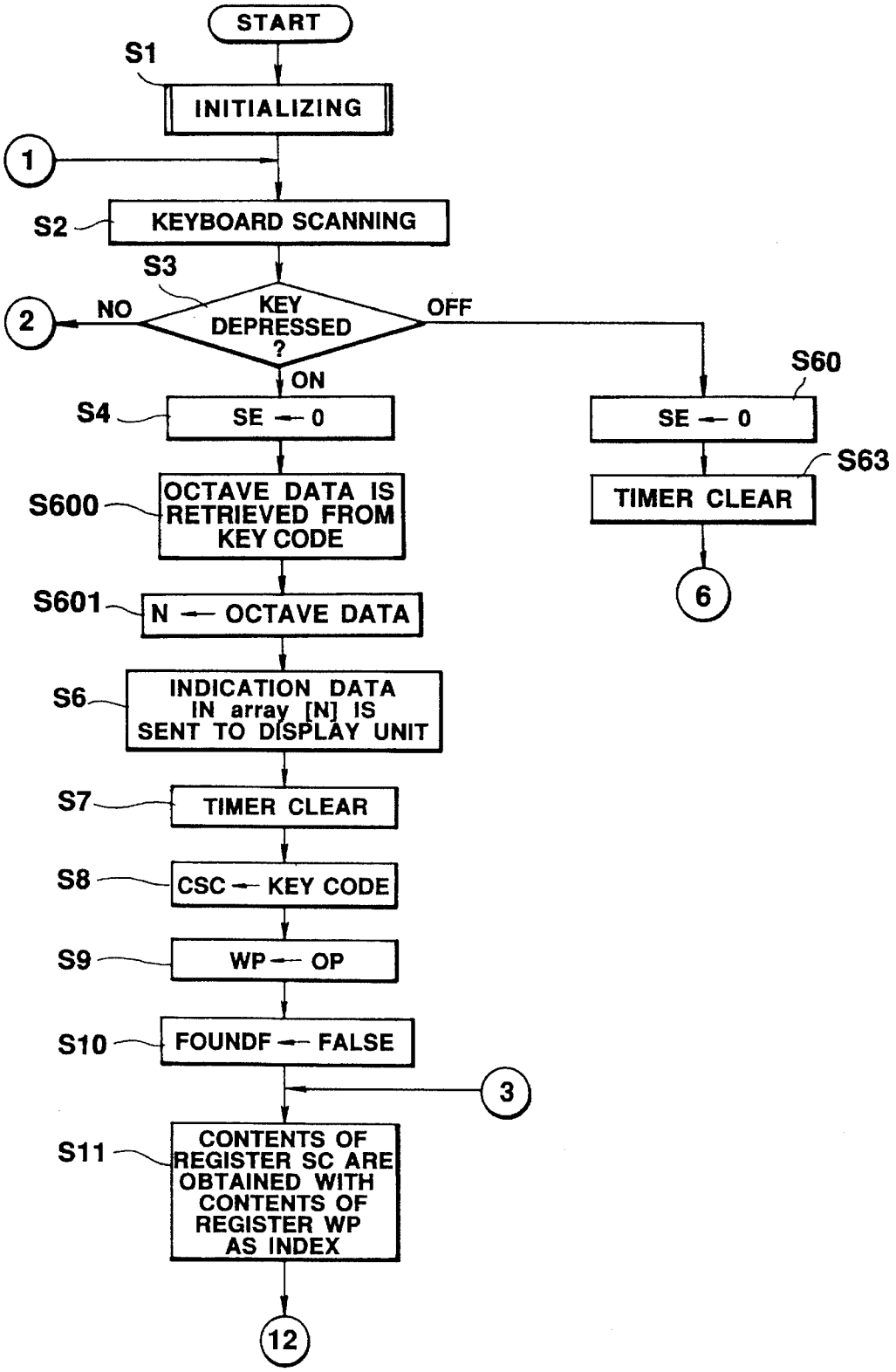

FIG. 118 is a view illustrating a fourteenth embodiment of an electronic musical instrument of the invention. In the fourteenth embodiment, the indication of the display unit is switched in accordance with an tone-range of a key-on key.

The hardware structure of the present embodiment is similar to that of the eleventh embodiment, and a description thereof is omitted.

The tone-generating process and indication-displaying process in the present embodiment are similar to those in the eleventh embodiment, so that only processes different from those in the above embodiments will be described.

In the main routine process of FIG. 118, CPU 31 clears the demo indication flag SE to "0" at step S4, and reads out, at step S600, octave data from a key code of a key that is being depressed at present. In other word, CPU 31 reads out data representing within which octave the key code of the depressed key falls. CPU 31 sets the read out octave data to the pointer N at step S601, and goes to step S6.

In the present embodiment, the indication on the display unit 35 is switched in accordance with a tone range (octave) of the key-on key (depressed key).

The modifications of the present invention may be made in various manners within the scope and spirit of the invention. For example, the playing-operation detecting means is not limited to the keyboard and other device may be used as the playing-operation detecting means. In the above described embodiments, the indication on the display unit is switched in accordance with externally input performance data, but data other than the performance data described in the above embodiments may be used to switch indications on the display unit.

In the above 1st to 13th embodiments, a plurality of indication data for still indications are selectively used to display indications, but indication data for moving indications may be used in place of the indication data for still indications. More specifically, a plurality of indication data for moving indications are selectively used in response to performance data to display moving indications on the display unit. The indication data for moving indications may be composed of a plurality of indication data for still indications, and the plurality of indication data for still indications may be switched at a high switching rate to display a false moving indication.

What is claimed is:

1. An automatic playing apparatus with a display unit, comprising:

performance-data storing means for storing a series of performance data necessary for executing an automatic playing operation, the performance data comprising plural sorts of data elements, said data elements including at least one-pitch data which is representative of a tone pitch of a musical tone to be generated;

reading means for sequentially reading out performance data from said performance-data storing means;

musical-tone signal generation instruction means for instructing generation of a musical-tone signal based on the performance data read out by said reading means;

image data storing means for storing plural sorts of image data;

image data selecting means for selecting any of the image data stored in said image data storing means in response to a change in predetermined data elements, the predetermined data elements being included in the performance data read out by said reading means, and wherein said image data selecting means selects image data only when a tone pitch designated by the tone-pitch data belongs to a particular tone range; and display means for displaying an image based on the image data selected by said image data selecting means.

2. An automatic playing apparatus with a display unit according to claim 1, wherein said image data selecting means selects image data based on the tone-pitch data.

3. An automatic playing apparatus with a display unit according to claim 1, wherein the image data selecting means selects image data for each tone range to which the tone pitch designated by the tone-pitch data belongs.

4. An automatic playing apparatus with a display unit according to claim 1, wherein said data elements of the performance data further include velocity data which determines a tone volume and a tone quality of a musical tone to be generated, and said image data selecting means selects image data in accordance with the velocity data.

5. An automatic playing apparatus with a display unit, comprising:

performance-data storing means for storing performance data of a musical piece to be automatically played;

playing means for sequentially reading out performance data stored in said performance-data storing means at predetermined playing timings, and for performing an automatic playing operation based on the read out performance data;

image data storing means for storing a plurality of image data;

image data selecting means for detecting timings of respective beats from playing timings at which said playing means performs an automatic playing operation, and for selecting any of the image data stored in said image data storing means on the basis of the detected timings of respective beats;

wherein said image data selecting means counts a number of timings of beats and switches image data to be selected every time when the counted number of beats reaches a number for one measure of music; and display means for displaying an image based on the image data selected by said image data selecting means.

6. An automatic playing apparatus with a display unit according to claim 5, wherein:

said performance data stored in said performance-data storing means includes a plurality of performance lines; and said image data selecting means detects and counts beats from playing timings of a performance line among the plurality of performance lines which generates sounds in association with timings of beats, and switches image data to be selected based on the detected beats.

7. An electronic musical instrument comprising:

a plurality of performance operators each for designating a tone pitch of a musical tone to be generated;

tone-range detecting means for detecting a tone range to which a tone pitch designated by said performance operator belongs;

musical-tone generation instruction means for instructing generation of a musical tone of a tone pitch corresponding to an operated performance operator;

image data storing means for storing plural sorts of image data necessary for displaying an image;

image data selecting means for selecting any of the image data stored in said image data storing means in accordance with the tone range detected by said tone-range detecting means; and display means for displaying an image based on the image data selected by said image data selecting means.

* * * * *